US009005868B2

(12) United States Patent
Murata et al.

(10) Patent No.: US 9,005,868 B2
(45) Date of Patent: Apr. 14, 2015

(54) PROCESS FOR PRODUCING TONER FOR ELECTROPHOTOGRAPHY

(75) Inventors: Shoichi Murata, Wakayama (JP); Takayuki Ikenaga, Wakayama (JP); Takashi Okuno, Wakayama (JP); Hiroshi Mizuhata, Wakayama (JP); Keishi Yokota, Wakayama (JP); Koji Shimokusa, Wakayama (JP); Koji Kameyama, Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 13/996,292

(22) PCT Filed: Dec. 9, 2011

(86) PCT No.: PCT/JP2011/079114

§ 371 (c)(1),
(2), (4) Date: Jul. 16, 2013

(87) PCT Pub. No.: WO2012/086523

PCT Pub. Date: Jun. 28, 2012

(65) Prior Publication Data

US 2013/0295499 A1 Nov. 7, 2013

(30) Foreign Application Priority Data

| | | |
|---|---|---|
| Dec. 22, 2010 | (JP) | 2010-286721 |
| Mar. 29, 2011 | (JP) | 2011-071969 |
| Jul. 21, 2011 | (JP) | 2011-159861 |

(51) Int. Cl.

| | |
|---|---|
| ***G03G 9/00*** | (2006.01) |
| ***G03G 9/093*** | (2006.01) |
| ***G03G 9/08*** | (2006.01) |
| ***G03G 9/087*** | (2006.01) |

(52) U.S. Cl.

CPC ..... *G03G 9/093* (2013.01); *G03G 9/0804* (2013.01); *G03G 9/08755* (2013.01); *G03G 9/08795* (2013.01); *G03G 9/08797* (2013.01); *G03G 9/09328* (2013.01); *G03G 9/09371* (2013.01); *G03G 9/09392* (2013.01)

(58) Field of Classification Search

CPC ... G03G 9/08; G03G 9/0804; G03G 9/08759; G03G 9/08782

USPC ..... 430/137.14, 109.1, 109.4, 110.2

See application file for complete search history.

(56) References Cited

U.S. PATENT DOCUMENTS

| | | | | |
|---|---|---|---|---|
| 5,482,812 | A * | 1/1996 | Hopper et al. | 430/137.14 |
| 2007/0207402 | A1 | 9/2007 | Takagi et al. | |
| 2008/0026312 | A1 | 1/2008 | Kamiyoshi | |
| 2008/0233508 | A1* | 9/2008 | Kamiyoshi et al. | 430/137.14 |
| 2009/0325098 | A1 | 12/2009 | Veregin et al. | |
| 2010/0015544 | A1 | 1/2010 | Agur et al. | |
| 2012/0258392 | A1 | 10/2012 | Murata et al. | |

FOREIGN PATENT DOCUMENTS

| | | |
|---|---|---|
| CN | 1746777 | 3/2006 |
| CN | 101762997 | 6/2010 |
| CN | 101788771 | 7/2010 |
| JP | 2008 164808 | 7/2008 |
| JP | 2009 75342 | 4/2009 |
| JP | 2009 122674 | 6/2009 |
| JP | 2010 39102 | 2/2010 |
| JP | 2010 78993 | 4/2010 |
| JP | 2010 113112 | 5/2010 |
| JP | 2010 145611 | 7/2010 |
| JP | 2012 233982 | 11/2012 |
| WO | 2010 027071 | 3/2010 |
| WO | 2012 086523 | 6/2012 |

OTHER PUBLICATIONS

International Search Report Issued Mar. 19, 2012 in PCT/JP11/79114 Filed Dec. 9, 2011.

* cited by examiner

*Primary Examiner* — Thorl Chea

(74) *Attorney, Agent, or Firm* — Oblon, McClelland, Maier & Neustadt, L.L.P.

(57) ABSTRACT

The present invention relates to a process for producing a toner for electrophotography which includes the step of fusing aggregated particles containing resin particles (A) and releasing agent particles in an aqueous mixed solution containing the aggregated particles and an anionic surfactant having a polyalkylene glycol moiety with an average molar number of addition of an alkylene oxide having 2 to 3 carbon atoms of from 5 to 100 after and/or while adjusting a pH value of the aqueous mixed solution to 2.0 to 6.0 as measured at 25° C., and a toner for electrophotography obtained by the process.

19 Claims, No Drawings

PROCESS FOR PRODUCING TONER FOR ELECTROPHOTOGRAPHY

TECHNICAL FIELD

The present invention relates to a process for producing a toner for electrophotography, and a toner for electrophotography obtained by the process.

BACKGROUND ART

In the field of toners for electrophotography, with the progress of electrophotographic systems, it has been demanded to develop toners adaptable for high image quality and high copying speed.

From the viewpoint of high image quality, in order to well control or reduce a particle size of the toner, it is known that the toner is produced by an aggregating and unifying method (aggregation/fusion method) in which fine resin particles and the like are aggregated and fused together in an aqueous medium.

For example, Patent Document 1 discloses a process for producing a toner for developing electrostatic images which contains at least a crystalline polyester resin and a colorant and has a specific dielectric loss factor for the purpose of improving a low-temperature fixing property, a high-density image forming property and an anti-fogging property thereof. The production process of Patent Document 1 includes an aggregated particle-forming step of mixing a dispersion of resin particles prepared by dispersing binder resin particles containing a crystalline polyester resin in a dispersing medium with a colorant dispersion prepared by dispersing a colorant in a dispersing medium and then adding an aggregating agent to the resulting mixed dispersion to form aggregated particles, and a fusing and unifying step of heating the aggregated particles to fuse and unify the particles while adding an acid and a surfactant thereto.

Patent Document 2 discloses a process for producing a developer which includes a step of adding an aggregating agent to a dispersion containing a binder resin and colorant-containing fine particles to aggregate the fine particles with the binder resin, and a step of fusing the resulting aggregated particles together to form toner particles, for the purpose of attaining a high image quality and producing a developer having a good particle size distribution. In the production process, a pH value of the dispersion before adding the aggregating agent thereto, a pH value of the dispersion after adding the aggregating agent thereto and a pH value of the dispersion after the fusion are controlled to satisfy a specific relationship with each other.

Patent Document 3 discloses a process for producing a toner for electrophotography which includes a step of emulsifying a binder resin containing a polyester in an aqueous medium, a step of aggregating emulsified particles in the resulting emulsion at a temperature not higher than a "glass transition point of binder resin+20° C.", a step of terminating aggregation of the emulsified particles by adding a salt of an alkylethersulfate or a salt of an alkylsulfate thereto, and a step of heating the aggregated particles at a specific temperature to unify the particles, for the purpose of obtaining toner particles having a high circularity.

Patent Document 4 discloses a toner for electrophotography which is produced by a process including a step of emulsifying a raw polyester containing amorphous polyester containing a constitutional unit derived from a trivalent or higher-valent carboxylic acid in an amount of from 2.0 to 12.0 mol % and a crystalline polyester in an aqueous medium, or a step of mixing the raw polyester with an organic solvent and then adding the aqueous medium to the resulting mixture to emulsify the raw polyester therein, thereby obtaining a dispersion of polyester particles, and a step of subjecting the dispersion of polyester particles to aggregation and unification, for the purpose of improving a low-temperature fixing property and an anti-hot offset property of the toner.

Patent Document 5 discloses a process for producing a toner which includes a step of subjecting a dispersion of toner particles containing core particles produced by aggregating resin particles, pigment particles and wax particles to reslurry washing treatment with an alkali solution having a pH of 8 to 12, and a step of subjecting the dispersion of the toner particles to reslurry washing treatment with an acid solution having a pH of 2 to 6 wherein the process further includes a flow-through water-washing treatment step with the acid solution and a flow-through water-washing treatment step with the alkali solution between the above reslurry washing treatment steps, for the purpose of increasing a life of the toner and preventing occurrence of lacks in toner images or toner cloud upon transfer of the toner.

Patent Document 6 discloses a process for producing a toner for developing electrostatic images in which a ratio between an amount of Na ions on a surface of smaller-diameter particles of the toner and an amount of Na ions on a surface of larger-diameter particles of the toner satisfies a specific relationship, for the purpose of improving a tribo-charging property of the toner and efficiently removing discharge products deposited on a surface of an image-bearing member. The production process of Patent Document 6 includes a step of washing the toner with a treating solution having a pH of not less than 9 and not more than 10, a step of adjusting a pH of the toner to 4 or less and then washing the toner while being treated with an ultrasonic wave, and a step of washing the toner with ion-exchanged water.

Patent Document 7 discloses a process for producing a toner for electrophotography which includes a step of obtaining a dispersion of toner particles containing a polyester in an aqueous medium in the presence of a surfactant and a step of washing the resulting toner particles with an alcohol aqueous solution containing an alcohol having 1 to 5 carbon atoms in an amount of not less than 0.1% by weight and less than 5% by weight, for the purpose of improving a storage stability and a developability of the toner.

CITATION LIST

Patent Document

[Patent Document 1] JP-A-2009-75342
[Patent Document 2] JP-A-2009-122674
[Patent Document 3] JP-A-2008-164808
[Patent Document 4] WO2010/27071
[Patent Document 5] JP-A-2010-113112
[Patent Document 6] JP-A-2010-78993
[Patent Document 7] JP-A-2010-39102

SUMMARY OF THE INVENTION

Technical Problem

When using a release agent in a toner, it is possible to lower a fixing temperature of the toner owing to melting characteristics of the releasing agent. As a result, it is possible to obtain a toner which is capable of reducing a power consumption of printers, and thus is suitable for high-speed printing. However, the toner containing such a releasing agent tends to cause various problems such as toner cloud within printers, deterioration in quality of printed images such as uneven dots in the printed images, deterioration in heat-resistant storage property as a stability upon high-temperature storage of the toner, deterioration in tribocharging property of the toner, and the like.

A problem to be solved by the present invention is to provide a toner for electrophotography which exhibits both a good low-temperature fixing property and a good tribocharging property and suffers from less toner cloud, and a process for producing the toner.

Another problem to be solved by the present invention is to provide a toner for electrophotography which has a good low-temperature fixing property and suffers from less toner cloud, and is excellent in dot reproducibility in printed images, and a process for producing the toner.

A further problem to be solved by the present invention is to provide a toner for electrophotography which exhibits both a good low-temperature fixing property and a good tribocharging property under high-temperature and high-humidity conditions, and is also excellent in heat-resistant storage property, and a process for producing the toner.

Solution to Problem

The present inventors have considered that locating positions and conditions of the constituting resins and releasing agent in the toner have large influences on fixing temperature, tribocharging property and toner cloud, and have made various studies and researches. As a result, it has been found that when fusing aggregated particles containing resin particles and releasing agent particles in an aqueous mixed solution which contains the aggregated particles and an anionic surfactant having a specific polyethylene glycol moiety and exhibits a specific pH value, it is possible to obtain a toner for electrophotography which is excellent in both of low-temperature fixing property and tribocharging property, and suffers from less scattering.

In addition, the present inventors have considered that locating positions and conditions of the constituting resins and releasing agent in the toner have large influences on fixing temperature and toner cloud and quality of the printed images, and have made various studies and researches. As a result, it has been found that when fusing aggregated particles containing resin particles and releasing agent particles in an aqueous mixed solution which contains the aggregated particles and an anionic surfactant having a specific structure and exhibits a specific pH value, it is possible to obtain a toner for electrophotography which has a good low-temperature fixing property and suffers from less toner cloud, and is excellent in dot reproducibility in the printed images.

Further, the present inventors have considered that locating positions and conditions of the constituting resins and releasing agent in the toner have large influences on fixing temperature, tribocharging property and heat-resistant storage property of the toner, and have made various studies and researches. As a result, it has been found that when fusing aggregated particles containing resin particles and releasing agent particles in an aqueous mixed solution which contains the aggregated particles and a surfactant and exhibits a specific pH value, adjusting a pH of the resulting dispersion to a specific value and then removing a liquid portion therefrom, it is possible to obtain a toner for electrophotography which is excellent in both of low-temperature fixing property and tribocharging property under high-temperature and high-humidity conditions, and also excellent in heat-resistant storage property.

That is, the present invention relates to the following aspects [1] to [5].

[1] A process for producing a toner for electrophotography, including the step of fusing aggregated particles containing resin particles (A) and releasing agent particles in an aqueous mixed solution containing the aggregated particles and an anionic surfactant having a polyalkylene glycol moiety with an average molar number of addition of an alkylene oxide having 2 to 3 carbon atoms of from 5 to 100 after and/or while adjusting a pH value of the aqueous mixed solution to 2.0 to 6.0 as measured at 25° C.

[2] A process for producing a toner for electrophotography, including the step of fusing aggregated particles containing resin particles (A) and releasing agent particles in an aqueous mixed solution containing the aggregated particles and an anionic surfactant having a polyethylene glycol moiety with an average molar number of addition of ethylene oxide of from 5 to 100 after and/or while adjusting a pH value of the aqueous mixed solution to 2.5 to 6.0 as measured at 25° C. (hereinafter referred to as a "first embodiment of the present invention").

[3] A process for producing a toner for electrophotography, including the step of fusing aggregated particles containing resin particles (A) and releasing agent particles in an aqueous mixed solution containing the aggregated particles and an anionic surfactant represented by the following formula (1) after and/or while adjusting a pH value of the aqueous mixed solution to 2.0 to 6.0 as measured at 25° C. (hereinafter referred to as a "second embodiment of the present invention"):

(1)

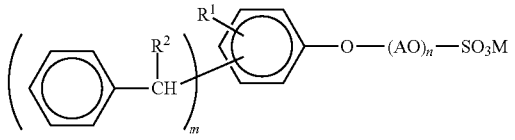

wherein $R^1$ is a hydrogen atom or an alkyl group having 1 to 12 carbon atoms; $R^2$ is a hydrogen atom or a methyl group; m is a number of 1 to 4 on average; AO is an ethyleneoxy group and/or a propyleneoxy group; n is a number of 5 to 100 on average; and M is ammonium, tetraalkyl ammonium or an alkali metal.

[4] A process for producing a toner for electrophotography including the following steps (X), (5) and (6) (hereinafter referred to as a "third embodiment of the present invention"):

Step (X): fusing aggregated particles containing resin particles (A) and releasing agent particles in an aqueous mixed solution containing the aggregated particles and an anionic surfactant having a polyalkylene glycol moiety with an average molar number of addition of an alkylene oxide having 2 to 3 carbon atoms of from 5 to 100 after and/or while adjusting a pH value of the aqueous mixed solution to 2.0 to 5.0 as measured at 25° C.;

Step (5): adjusting a pH value of a dispersion of fused particles obtained in the step (X) to 5.5 to 7.5 as measured at 25° C.; and Step (6): removing a liquid portion from the dispersion of the fused particles obtained in the step (5), to obtain toner particles.

[5] A toner for electrophotography produced by the process as described in any one of the above aspects [1] to [4].

Advantageous Effects of Invention

According to the present invention, there is provided a toner for electrophotography which exhibits both a good low-temperature fixing property and a good tribocharging property and hardly suffers from toner cloud, and a process for producing the toner.

In addition, according to the present invention, there is provided a toner for electrophotography which has a good low-temperature fixing property and hardly suffers from toner cloud, and is excellent in dot reproducibility in resulting printed images, and a process for producing the toner.

Further, according to the present invention, there is provided a toner for electrophotography which exhibits both a good low-temperature fixing property and a good tribocharging property under high-temperature and high-humidity conditions, and is also excellent in heat-resistant storage property, and a process for producing the toner.

DESCRIPTION OF EMBODIMENTS

The process for producing a toner for electrophotography according to the present invention includes the step of fusing aggregated particles containing resin particles (A) and releasing agent particles in an aqueous mixed solution containing the aggregated particles and an anionic surfactant having a polyalkylene glycol moiety with an average molar number of addition of an alkylene oxide having 2 to 3 carbon atoms of from 5 to 100 after and/or while adjusting a pH value of the aqueous mixed solution to 2.0 to 6.0 as measured at 25° C.

In particular, the first embodiment of the process for producing a toner for electrophotography according to the present invention includes the step of fusing aggregated particles containing resin particles (A) and releasing agent particles in an aqueous mixed solution containing the aggregated particles and an anionic surfactant having a polyethylene glycol moiety with an average molar number of addition of ethylene oxide of from 5 to 100 after and/or while adjusting a pH value of the aqueous mixed solution to 2.5 to 6.0 as measured at 25° C.

The reason why the toner for electrophotography obtained according to the first embodiment of the present invention exhibits both a good low-temperature fixing property and a good tribocharging property and hardly suffers from toner cloud is considered as follows, although it is not clearly determined.

That is, in the first embodiment of the present invention, when the aggregated particles containing the resin particles (A) and the releasing agent particles are fused in the aqueous medium, a pH value (as measured at 25° C.) of the aqueous mixed solution containing the aggregated particles is adjusted to 2.5 to 6.0. When the aggregated particles are fused at the pH value of such an acid range, a dispersing condition of the resin particles becomes unstable, so that fusion of the particles rapidly occurs. For this reason, the fusion of the particles is completed before dissolution or separation of the releasing agent occurs. Therefore, it is considered that even though the releasing agent is compounded in a toner in such a large amount that the toner can effectively exhibit a low-temperature fixing property, exposure of the releasing agent to a surface of the toner can be suppressed, so that the resulting toner exhibits a good tribocharging property and hardly suffers from toner cloud.

On the other hand, when the liquid property is adjusted to a weakly acidic condition, the particles tend to be deteriorated in stability, so that not only fusion of the resin particles (A) but also fusion of the aggregated particles may be accelerated. However, in the present invention, by incorporating the anionic surfactant having a polyethylene glycol moiety with an average molar number of addition of ethylene oxide of from 5 to 100 into the aqueous mixed solution, fusion of the aggregated particles can be prevented owing to a steric repulsion property or an electrostatic repulsion property of the anionic surfactant, resulting in production of the toner having a sharp particle size distribution.

As described above, the thus obtained toner containing the releasing agent has a sharp particle size distribution. Therefore, it is considered that the toner for electrophotography according to the first embodiment of the present invention can exhibit both a good low-temperature fixing property and a good tribocharging property, and hardly suffers from toner cloud.

In addition, the second embodiment of the process for producing a toner for electrophotography according to the present invention includes the step of fusing aggregated particles containing resin particles (A) and releasing agent particles in an aqueous mixed solution containing the aggregated particles and an anionic surfactant represented by the above formula (1) after and/or while adjusting a pH value of the aqueous mixed solution to 2.0 to 6.0 as measured at 25° C.

The reason why the toner for electrophotography obtained according to the second embodiment of the present invention can exhibit a good low-temperature fixing property, hardly suffers from toner cloud and is also excellent in dot reproducibility in the resulting printed images, is considered as follows, although it is not clearly determined.

That is, in the second embodiment of the present invention, when the aggregated particles containing the resin particles (A) and the releasing agent particles are fused in the aqueous medium, a pH value (as measured at 25° C.) of the aqueous mixed solution containing the aggregated particles is adjusted to 2.0 to 6.0. When the aggregated particles are fused at the pH value of such an acid range, a dispersing condition of the resin particles becomes unstable, so that fusion of the particles rapidly occurs. For this reason, the fusion of the particles is completed before dissolution or separation of the releasing agent occurs. Therefore, it is considered that even though the releasing agent is compounded in a toner in such a large amount that the toner can effectively exhibit a low-temperature fixing property, exposure of the releasing agent to a surface of the toner can be suppressed, so that toner cloud can also be suppressed.

On the other hand, when the pH value of the aqueous mixed solution is adjusted to a weak acidity, the particles tend to be deteriorated in stability, so that not only fusion of the resin particles (A) but also fusion of the aggregated particles may be accelerated. However, in the second embodiment of the present invention, by incorporating the anionic surfactant represented by the above formula (1) in the aqueous mixed solution, it is considered that the anionic surfactant is localized on the surface of the respective aggregated particles owing to an aromatic group of the anionic surfactant having a high affinity to the resins, so that fusion of the aggregated particles can be prevented owing to a steric repulsion property of an alkyleneoxy moiety therein or an electrostatic repulsion property of an anionic group therein, resulting in production of the toner having a sharp particle size distribution. For this reason, it is considered that toner cloud can be reduced and variation in distribution of the toner upon development or transferring can be suppressed, so that the resulting toner is excellent in dot reproducibility in printed images and quality of the printed images.

As described above, the toner contains the releasing agent and has a sharp particle size distribution. Therefore, it is considered that the toner for electrophotography according to the second embodiment of the present invention can exhibit a good low-temperature fixing property, hardly suffers from toner cloud, and is also excellent in dot reproducibility in the resulting printed images.

Further, the third embodiment of the process for producing a toner for electrophotography according to the present invention includes the following steps (X), (5) and (6).

Step (X): fusing aggregated particles containing resin particles (A) and releasing agent particles in an aqueous mixed solution containing the aggregated particles and an anionic surfactant having a polyalkylene glycol moiety with an average molar number of addition of an alkylene oxide having 2 to 3 carbon atoms of from 5 to 100 after and/or while adjusting a pH value of the aqueous mixed solution to 2.0 to 5.0 as measured at 25° C.;

Step (5): adjusting a pH value of a dispersion of fused particles obtained in the step (X) to 5.5 to 7.5 as measured at 25° C.; and Step (6): removing a liquid portion from the dispersion of the fused particles obtained in the step (5), to obtain toner particles.

The reason why the toner for electrophotography obtained according to the third embodiment of the present invention can exhibit both a good low-temperature fixing property and a good tribocharging property under high-temperature and high-humidity conditions and is also excellent in heat-resistant storage property, is considered as follows, although it is not clearly determined.

That is, in the step (X) in the third embodiment of the present invention, when the aggregated particles containing the resin particles (A) and the releasing agent particles are fused in the aqueous medium, a pH value (as measured at 25° C.) of the aqueous mixed solution containing the aggregated particles is adjusted to 2.0 to 5.0. When the aggregated particles are fused at the pH value of such an acid range, a dispersing condition of the resin particles becomes unstable, so that fusion of the particles rapidly occurs. For this reason, the fusion of the particles is completed before dissolution or separation of the releasing agent occurs. Therefore, it is considered that even though the releasing agent is compounded in a toner in such a large amount that the toner can effectively exhibit a low-temperature fixing property, exposure of the releasing agent to a surface of the toner can be suppressed, so that the resulting toner can also be enhanced in tribocharging property.

On the other hand, it is considered that the surfactant incorporated into the aqueous mixed solution is localized on the surface of the respective aggregated particles, so that fusion between the aggregated particles can be effectively prevented, resulting in production of the toner having a sharp particle size distribution.

Further, in the step (5) in the third embodiment of the present invention, a pH value of the dispersion of the fused particles obtained in the step (X) is adjusted to 5.5 to 7.5 as measured at 25° C., and in the step (6), the liquid portion is removed by filtration from the dispersion to obtain toner particles. When the solid-liquid separation is carried out by adjusting a liquid property of the dispersion to the above pH range, i.e., in a pH value ranging from neutral to weak acidity, it is possible to suppress swelling or dissolution of the resins in the resin particles while fully removing the surfactant and the like deposited on a surface of the toner. Therefore, it is considered that the resulting toner can be enhanced in both of a tribocharging property, in particular, a tribocharging property under high-temperature and high-humidity conditions, and a heat-resistant storage property.

In the following, the respective components and steps and the like used in the present invention, are explained.

[Resin Particles (A)]

In the present invention, the resin particles (A) preferably contain a crystalline polyester (a). The content of the crystalline polyester (a), if any, in the resin particles (A) is preferably from 1 to 50% by weight, more preferably from 10 to 50% by weight, still more preferably from 10 to 30% by weight and especially preferably from 13 to 20% by weight on the basis of the weight of resins constituting the resin particles (A) from the viewpoints of enhancing a low-temperature fixing property of the toner and preventing occurrence of hot offset.

(Crystalline Polyester (a))

The crystalline polyester (a) used in the present invention means those polyesters having a crystallinity index of from 0.6 to 1.4 wherein the crystallinity index is defined by a ratio of a softening point to an endothermic maximum peak temperature, i.e., "softening point (° C.)/endothermic maximum peak temperature (° C.)", as measured by a differential scanning colorimeter (DSC). The crystallinity index of the crystalline polyester (a) is preferably from 0.8 to 1.3, more preferably from 0.9 to 1.2 and still more preferably from 0.9 to 1.1 from the viewpoint of a good low-temperature fixing property of the resulting toner.

The crystalline polyester (a) preferably contains an acid group at a terminal end of a molecule thereof from the viewpoints of good dispersion stability and emulsifiability of the dispersion of the resin particles (A). Examples of the acid group include a carboxyl group, a sulfonic group, a phosphonic group and a sulfinic group. Among these acid groups, preferred is a carboxyl group from the viewpoint of satisfying both of a good dispersibility of the resins and a good storage stability of the resulting toner.

The melting point of the crystalline polyester (a) is preferably from 50 to 150° C., more preferably from 55 to 130° C., still more preferably from 60 to 90° C. and especially preferably from 60 to 80° C. from the viewpoints of good low-temperature fixing property, tribocharging property, toner cloud, storage stability and heat-resistant storage property of the resulting toner.

The softening point of the crystalline polyester (a) is preferably from 50 to 140° C., more preferably from 55 to 130° C., still more preferably from 60 to 110° C. and especially preferably from 60 to 85° C. from the same viewpoints as described above.

The number-average molecular weight of the crystalline polyester (a) is preferably from 1,500 to 50,000, more preferably from 2,000 to 10,000, still more preferably from 3,500 to 8,000 and further still more preferably from 3,000 to 5,000 from the viewpoints of a good low-temperature fixing property and a good heat-resistant storage property of the resulting toner.

The acid value of the crystalline polyester (a) is preferably from 5 to 30 mg KOH/g, more preferably from 10 to 27 mg KOH/g, still more preferably from 10 to 25 mg KOH/g, further still more preferably from 15 to 25 mg KOH/g and especially preferably from 15 to 22 mg KOH/g from the viewpoints of a good dispersion stability of the dispersion of the resin particles (A) and a good tribocharging property of the resulting toner.

Meanwhile, the crystalline polyester (a) may be used alone or in combination of any two or more kinds thereof.

In the present invention, the melting point, softening point and number-average molecular weight of the crystalline polyester (a) may be determined by the methods described in Examples below. When using two or more kinds of crystalline polyesters (a) in combination with each other, the melting point of the crystalline polyester having a largest weight ratio among the crystalline polyesters (a) contained in the resulting toner is defined as a melting point of the crystalline polyester (a) according to the present invention. Meanwhile, in the case where all of the crystalline polyesters (a) are contained at the same weight ratio, the lowest melting point among those of the crystalline polyesters is defined as a melting point of the crystalline polyester (a) according to the present invention. Also, the softening point and number-average molecular weight of the crystalline polyester (a) containing two or more kinds of crystalline polyesters are determined by measuring a softening point and a number-average molecular weight of a mixture containing all of the crystalline polyesters at their weight ratios upon use, by the methods described in Examples below.

The crystalline polyester (a) may be produced by subjecting an acid component and an alcohol component to polycondensation reaction preferably in the presence of a catalyst at a temperature of from 180 to 250° C.

Examples of the acid component include aliphatic dicarboxylic acids, alicyclic dicarboxylic acids, aromatic dicarboxylic acids, trivalent or higher valent polycarboxylic acids, and anhydrides and alkyl ($C_1$ to $C_3$) esters of these acids. Among these acids, preferred are aliphatic dicarboxylic acids from the viewpoints of good low-temperature fixing property, storage stability, heat-resistant storage property and tribocharging property of the resulting toner.

Specific examples of the aliphatic dicarboxylic acids include oxalic acid, malonic acid, maleic acid, fumaric acid, citraconic acid, itaconic acid, glutaconic acid, succinic acid, adipic acid, sebacic acid, 1,12-dodecanedioic acid, azelaic acid, n-dodecyl succinic acid and n-dodecenyl succinic acid. Among these aliphatic dicarboxylic acids, preferred are sebacic acid and 1,12-dodecanedioic acid from the viewpoints of good low-temperature fixing property, storage stability, heat-resistant storage property and tribocharging property of the resulting toner.

Specific examples of the alicyclic dicarboxylic acids include cyclohexanedicarboxylic acid and the like.

Specific examples of the aromatic dicarboxylic acids include phthalic acid, isophthalic acid and terephthalic acid.

Specific examples of the trivalent or higher valent polycarboxylic acids include trimellitic acid and pyromellitic acid.

These acids may be used alone or in combination of any two or more thereof.

Examples of the alcohol component include aliphatic diols with a main chain having 2 to 12 carbon atoms, aromatic diols, hydrogenated products of bisphenol A and trivalent or higher valent polyhydric alcohols. Among these alcohols, preferred are aliphatic diols with a main chain having 2 to 12 carbon atoms from the viewpoints of promoting a crystallizability of the polyester and enhancing a low-temperature fixing property of the resulting toner.

Among the aliphatic diols with a main chain having 2 to 12 carbon atoms, from the viewpoints of promoting a crystallizability of the polyester and enhancing a low-temperature fixing property of the resulting toner, preferred are α,ω-linear alkanediols, and more preferred are the α,ω-linear alkanediols with a main chain having 6 to 12 carbon atoms.

Specific examples of the α,ω-linear alkanediols include ethylene glycol, 1,2-propanediol, 1,3-propanediol, 1,4-butanediol, 1,5-pentanediol, 1,6-hexanediol, 1,7-heptanediol, 1,8-octanediol, 1,9-nonanediol, 1,10-decanediol and 1,12-dodecanediol. Among these α,ω-linear alkanediols, preferred are 1,6-hexanediol and 1,9-nonanediol from the viewpoints of good low-temperature fixing property, storage stability, heat-resistant storage property and tribocharging property of the resulting toner.

Specific examples of the other aliphatic diols with a main chain having 2 to 12 carbon atoms include neopentyl glycol and 1,4-butenediol.

Specific examples of the aromatic diols include alkylene ($C_2$ to $C_3$) oxide adducts (average molar number of addition: 1 to 16) of bisphenol A such as polyoxypropylene-2,2-bis(4-hydroxyphenyl)propane and polyoxyethylene-2,2-bis(4-hydroxyphenyl)propane.

Specific examples of the trivalent or higher valent polyhydric alcohols include glycerol and pentaerythritol.

These alcohols may be used alone or in combination of any two or more thereof. From the viewpoint of promoting a crystallizability of the polyester, the content of the aliphatic diol with a main chain having 2 to 12 carbon atoms in the alcohol component is preferably from 80 to 100 mol % and more preferably from 90 to 100 mol %.

From the viewpoint of a high efficiency of the polycondensation reaction, as the catalyst, there are preferably used tin compounds or titanium compounds, and more preferably tin compounds. Examples of the tin compounds include tin di(2-ethyl hexanoate) and dibutyl tin oxide.

Examples of the titanium compounds include titanium diisopropylate bistriethanol aminate and the like.

The amount of the catalyst used is not particularly limited, and is preferably from 0.01 to 1 part by weight and more preferably from 0.1 to 0.6 parts by weight on the basis of 100 parts by weight of a total amount of the acid component and the alcohol component.

The polycondensation reaction is preferably carried out by charging the acid component and the alcohol component into a reaction vessel and maintaining the contents of the reaction vessel at a temperature of from 140 to 200° C. for 5 to 15 hours. Thereafter, the catalyst is added to the reaction vessel, and the contents of the reaction vessel are maintained at a temperature of from 140 to 200° C. for 1 to 5 hours to allow the reaction to proceed, and then the reaction pressure is reduced to 5.0 to 20 kPa under which the reaction solution is maintained for 1 to 10 hours to thereby obtain the crystalline polyester as aimed.

(Amorphous Polyester (c))

The resin particles (A) preferably further contain amorphous polyester (c) from the viewpoints of enhancing a storage stability, a heat-resistant storage property and a tribocharging property of the toner and preventing occurrence of hot offset while maintaining a good low-temperature fixing property of the toner. The total amount of the crystalline polyester (a) and the amorphous polyester (c) in the resin particles (A) is preferably from 50 to 100% by weight, more preferably from 80 to 100% by weight, still more preferably from 90 to 100% by weight and especially preferably substantially 100% by weight on the basis of the weight of the resins constituting the resin particles (A) from the viewpoints of enhancing a low-temperature fixing property of the resulting toner. The weight ratio of the crystalline polyester (a) to the amorphous polyester (c) ((a)/(c)) in the resin particles (A) is preferably from 5/95 to 50/50, more preferably from 5/95 to 40/60, still more preferably from 10/90 to 30/70, further still more preferably from 13/87 to 25/75, and especially preferably from 15/85 to 20/80 from the viewpoints of enhancing a low-temperature fixing property, a storage stability, a heat-resistant storage property and a tribocharging property of the resulting toner and preventing occurrence of hot offset.

As the amorphous polyester (c) which may be contained in the resin particles (A), there is preferably used the same amorphous polyester as the below-mentioned amorphous polyester (b). The composition of a resin of the amorphous polyester (c) may be either the same as or different from that of the amorphous polyester (b). However, the use of the resin having same composition for the amorphous polyesters (b) and (c) is preferred from the viewpoints of control of aggregation and a good low-temperature fixing property of the toner.

The amorphous polyester (c) may be produced by subjecting an acid component and an alcohol component to polycondensation reaction. The preferred acid component and alcohol component of the amorphous polyester (c) may be the same as those of the amorphous polyester (b). The acid component and the alcohol component may be constituted from two or more kinds of acids and alcohols, respectively. Specific examples of the preferred acid component include dicarboxylic acids, trivalent or higher valent polycarboxylic acids, and anhydrides and alkyl ($C_1$ to $C_3$) esters of these acids. Among these acids, preferred are dicarboxylic acids.

Examples of the preferred dicarboxylic acids include aromatic dicarboxylic acids, and succinic acids substituted with an alkyl group having 1 to 20 carbon atoms or an alkenyl group having 2 to 20 carbon atoms.

Among the aromatic dicarboxylic acids, preferred is terephthalic acid. Specific examples of the preferred succinic acids substituted with an alkyl group having 1 to 20 carbon atoms or an alkenyl group having 2 to 20 carbon atoms include dodecenyl succinic acid. Specific examples of the preferred trivalent or higher valent polycarboxylic acids include trimellitic acid and trimellitic anhydride.

Examples of the preferred alcohol component include aromatic diols. Specific examples of the preferred aromatic diols include alkylene ($C_2$ to $C_3$) oxide adducts (average molar number of addition: 1 to 16) of bisphenol A such as polyoxypropylene-2,2-bis(4-hydroxyphenyl)propane and polyoxyethylene-2,2-bis(4-hydroxyphenyl)propane.

The glass transition point, softening point, number-average molecular weight and acid value of the amorphous polyester (c) are preferably within the same ranges of those of the amorphous polyester (b).

The amorphous polyesters (c) may be used alone or in combination of any two or more kinds thereof. From the viewpoints of good low-temperature fixing property, anti-offset property and durability of the resulting toner, the amorphous polyester (c) preferably contains two kinds of polyesters which are different in softening point from each other. Among the two kinds of polyesters which are different in softening point from each other, one polyester (c-1) preferably has a softening point of not lower than 70° C. and lower than 115° C., whereas the other polyester (c-2) preferably has a softening point of not lower than 115° C. and not higher than 165° C. The weight ratio of the polyester (c-1) to the polyester (c-2) ((c-1)/(c-2)) in the amorphous polyester (c) is preferably from 10/90 to 90/10 and more preferably from 50/50 to 90/10.

The resin particles (A) may also contain resins other than the crystalline polyester (a) and the amorphous polyester (c) unless the effects of the present invention are adversely influenced. Examples of the other resins include styrene-acryl copolymers, epoxy resins, polycarbonates and polyurethanes.

In addition, the resin particles (A) may also contain a releasing agent and an antistatic agent unless the effects of the present invention are adversely influenced. Further, the resin particles (A) may also contain other additives such as a reinforcing filler such as fibrous substances, an antioxidant and an anti-aging agent, if required.

The resin particles (A) may be in the form of either particles of a resin solely or particles of a colorant-containing resin. However, from the viewpoint of obtaining a toner having a sharp particle size distribution, the resin particles (A) preferably contain a colorant, i.e., are preferably in the form of colorant-containing resin particles.

The content of the colorant in the resin particles (A) which are in the form of colorant-containing resin particles is preferably from 1 to 20 parts by weight and more preferably from 5 to 10 parts by weight on the basis of 100 parts by weight of the resins constituting the resin particles (A).

(Colorant)

In the present invention, the colorant may be used in the form of a dispersion of colorant particles in an aqueous medium using a surface-treating agent or a dispersant or may be incorporated into resin particles such as the resin particles (A). From the viewpoint of obtaining a toner having a sharp particle size distribution, the colorant is preferably incorporated into the resin particles (A).

The colorant may be either a pigment or a dye. From the viewpoint of a high image density of the toner, the pigment is preferably used.

Specific examples of the pigment include carbon blacks, inorganic composite oxides, Chrome Yellow, Benzidine Yellow, Brilliant Carmine 3B, Brilliant Carmine 6B, red iron oxide, Aniline Blue, ultramarine blue, copper phthalocyanine and Phthalocyanine Green. Among these pigments, preferred is copper phthalocyanine.

Specific examples of the dye include acridine dyes, azo dyes, benzoquinone dyes, azine dyes, anthraquinone dyes, indigo dyes, phthalocyanine dyes and Aniline Black dyes.

These colorants may be used alone or in combination of any two or more thereof.

(Production of Resin Particles (A))

The resin particles (A) are preferably produced by the method in which the resin component containing the crystalline polyester (a) and optional components such as the above colorant are dispersed in an aqueous medium to prepare a dispersion containing the resin particles (A).

As the method of obtaining the dispersion, there may be used the method of adding the resins and the like to the aqueous medium and subjecting the resulting mixture to dispersing treatment using a disperser and the like, the method of gradually adding the aqueous medium to the resins and the like to subject the resulting mixture to phase inversion emulsion, and the like. Among these methods, from the viewpoint of a good low-temperature fixing property of the obtained toner, the method using a phase inversion emulsion is preferred. In the following, the method using a phase inversion emulsion is explained.

First, the resin component containing the crystalline polyester (a), an alkali aqueous solution and the optional components such as a colorant are melted and mixed with each other to obtain a resin mixture.

When the resin component containing the crystalline polyester (a) contains a plurality of resins, the crystalline polyester (a) may be previously mixed with the other resins. Alternatively, when adding the alkali aqueous solution and the optional components, the crystalline polyester (a) and the other resins may be added simultaneously therewith, and melted and mixed with each other. For example, when the resin component containing the crystalline polyester (a) contains the amorphous polyester (c), from the viewpoint of a good low-temperature fixing property of the toner, there is preferably used the method in which the crystalline polyester (a), the amorphous polyester (c), the alkali aqueous solution and the optional components are melted and mixed with each other to obtain a resin mixture.

Upon mixing these components, a surfactant is preferably added thereto from the viewpoint of a good emulsification stability of the resins.

Examples of the alkali contained in the alkali aqueous solution include hydroxides of alkali metals such as potassium hydroxide and sodium hydroxide, and ammonia. From the viewpoint of enhancing a dispersibility of the resins, among these alkalis, preferred are potassium hydroxide and sodium hydroxide. The concentration of the alkali in the alkali aqueous solution is preferably from 1 to 30% by weight, more preferably from 1 to 25% by weight and still more preferably from 1.5 to 20% by weight.

Examples of the surfactant include a nonionic surfactant, an anionic surfactant and a cationic surfactant. Among these surfactants, preferred is a nonionic surfactant. The nonionic surfactant is preferably used in combination with the anionic surfactant or the cationic surfactant. From the viewpoint of fully emulsifying the resins, the nonionic surfactant is more preferably used in combination with the anionic surfactant.

When using the nonionic surfactant in combination with the anionic surfactant, the weight ratio of the nonionic surfactant to the anionic surfactant (nonionic surfactant/anionic surfactant) is preferably from 0.3 to 10 and more preferably from 0.5 to 5 from the viewpoint of fully emulsifying the resins.

Examples of the nonionic surfactant include polyoxyethylene alkyl aryl ethers, polyoxyethylene alkyl ethers, polyoxyethylene fatty acid esters and oxyethylene/oxypropylene block copolymers. Among these nonionic surfactants, polyoxyethylene alkyl ethers are preferred from the viewpoint of a good emulsification stability of the resins.

Specific examples of the polyoxyethylene alkyl aryl ethers include polyoxyethylene nonyl phenyl ether.

Specific examples of the polyoxyethylene alkyl ethers include polyoxyethylene oleyl ether and polyoxyethylene lauryl ether.

Specific examples of the polyoxyethylene fatty acid esters include polyethylene glycol monolaurate, polyethylene glycol monostearate and polyethylene glycol monooleate.

Specific examples of the anionic surfactant include dodecylbenzenesulfonic acid, sodium dodecylbenzenesulfonate, sodium dodecylsulfate and sodium alkylethersulfates. Among these anionic surfactants, preferred are sodium dodecylbenzenesulfonate and sodium alkylethersulfates from the viewpoint of a good emulsification stability of the resins.

Specific examples of the cationic surfactant include alkylbenzenedimethyl ammonium chlorides, alkyltrimethyl ammonium chlorides and distearyl ammonium chloride.

The content of the surfactants in the resin mixture is preferably 20 parts by weight or smaller, more preferably 15 parts by weight or smaller, still more preferably from 0.1 to 10 parts by weight and further still more preferably from 0.5 to 10 parts by weight on the basis of 100 parts by weight of the resins constituting the resin particles (A) from the viewpoints of obtaining uniform resin particles and suppressing toner cloud.

As the method of producing the resin mixture, from the viewpoint of a good low-temperature fixing property of the resulting toner, there is preferably used the method in which the resins containing the crystalline polyester (a), the alkali aqueous solution and the optional components, preferably together with the surfactants, are charged into a container, and while stirring the contents of the container using a stirrer, the resins are melted and mixed with the other components to prepare a uniform mixture.

The temperature used upon melting and mixing the resins and the like is preferably not lower than a glass transition point of the amorphous polyester (c) if the resin component containing the crystalline polyester (a) includes the amorphous polyester (c), and more preferably not lower than a melting point of the crystalline polyester (a) from the viewpoint of obtaining uniform resin particles.

Next, an aqueous medium is added to the above resin mixture to subject the mixture to phase inversion, thereby obtaining a dispersion containing the resin particles (A).

The aqueous medium used herein preferably contains water as a main component. From the viewpoint of a good environmental suitability, the water content in the aqueous medium is preferably 80% by weight or more, more preferably 90% by weight or more, still more preferably 95% by weight or more, and especially preferably substantially 100% by weight. As the water, deionized water or distilled water is preferably used.

Examples of components other than water which may be contained in the aqueous medium include water-soluble organic solvents, e.g., aliphatic alcohols having 1 to 5 carbon atoms; acetone and dialkyl ($C_1$ to $C_3$) ketones such as methyl ethyl ketone; and cyclic ethers such as tetrahydrofuran. Among these organic solvents, from the viewpoint of less inclusion into the toner, preferred are aliphatic alcohols having 1 to 5 carbon atoms which are incapable of dissolving the polyester therein, and more preferred are methanol, ethanol, isopropanol and butanol.

The temperature used upon adding the aqueous medium in the case where the resin component containing the crystalline polyester (a) further contains the amorphous polyester (c), is preferably not lower than a glass transition point of the amorphous polyester (c) from the viewpoint of obtaining uniform resin particles, and more preferably not lower than a melting point of the crystalline polyester (a) from the viewpoint of obtaining uniform resin particles.

From the viewpoint of reducing a particle size of the resin particles, the velocity of addition of the aqueous medium until terminating the phase inversion is preferably from 0.1 to 50 parts by weight/min, more preferably from 0.1 to 30 parts by weight/min, still more preferably from 0.5 to 10 parts by weight/min and further still more preferably from 0.5 to 5 parts by weight/min on the basis of 100 parts by weight of the resins constituting the resin particles (A). However, the velocity of addition of the aqueous medium after terminating the phase inversion is not particularly limited.

The amount of the aqueous medium added to the resin mixture is preferably from 100 to 2,000 parts by weight, more preferably from 150 to 1,500 parts by weight and still more preferably from 150 to 500 parts by weight on the basis of 100 parts by weight of the resins constituting the resin particles (A) from the viewpoint of obtaining uniform aggregated particles in the subsequent aggregating step. The solid content of the resulting dispersion of the resin particles is preferably from 7 to 50% by weight, more preferably from 10 to 40% by weight, still more preferably from 20 to 40% by weight and further still more preferably from 25 to 35% by weight from the viewpoints of a good stability of the dispersion of the resin particles and easiness of handling thereof. Meanwhile, the solid content means the value based on a total amount of non-volatile components such as the resins and the surfactant.

The volume-median particle size of the resin particles (A) contained in the thus obtained dispersion of the resin particles (A) is preferably from 0.02 to 2 μm. From the viewpoint of obtaining a toner capable of forming a high quality image, the volume-median particle size of the resin particles (A) is more preferably from 0.02 to 1.5 μm, still more preferably from 0.05 to 1 μm and further still more preferably from 0.05 to 0.5 p.m. Meanwhile, the volume-median particle size as used herein means a particle size at which a cumulative volume frequency calculated on the basis of a volume fraction of particles from a smaller particle size side thereof is 50%.

The coefficient of variation of particle size distribution (CV value; %) of the resin particles is preferably 40% or less, more preferably 35% or less, still more preferably 30% or less and further still more preferably 28% or less from the viewpoint of obtaining a toner capable of forming a high-quality image. Meanwhile, the CV value means the value represented by the following formula, and specifically is determined by the method described in Examples below.

CV Value(%)=[Standard Deviation of Particle Size Distribution (μm)/Volume Median Particle Size (μm)]×100.

[Releasing Agent Particles]

The releasing agent particles preferably contain a surfactant from the viewpoint of a good aggregating property. The content of the surfactant in the releasing agent particles is preferably from 0.01 to 10 parts by weight and more preferably from 0.1 to 5 parts by weight on the basis of 100 parts by weight of the releasing agent from the viewpoints of a good aggregating property of the particles and a good tribocharging property of the resulting toner.

The volume-median particle size of the releasing agent particles is preferably from 0.1 to 1 μm, more preferably from 0.1 to 0.7 μm and still more preferably from 0.1 to 0.5 μm from the viewpoints of attaining a good tribocharging property of the resulting toner and preventing occurrence of hot offset.

The CV value of the releasing agent particles is preferably from 15 to 50%, more preferably from 15 to 40% and still more preferably from 15 to 35% from the viewpoint of a good tribocharging property of the resulting toner.

(Releasing Agent)

Examples of the releasing agent include low-molecular weight polyolefins such as polyethylene, polypropylene and polybutene; silicones exhibiting a softening point upon heating; fatty acid amides such as oleamide and stearamide; vegetable waxes such as carnauba wax, rice wax and candelilla wax; animal waxes such as beeswax; mineral and petroleum waxes such as montan wax, paraffin wax and Fischer-Tropsch wax; and the like. These releasing agents may be used alone or in combination of any two or more thereof.

The melting point of the releasing agent is preferably from 65 to 100° C., more preferably from 75 to 95° C., still more preferably from 75 to 90° C. and further still more preferably from 80 to 90° C. from the viewpoints of good low-temperature fixing property, storage stability, heat-resistant storage property and tribocharging property of the resulting toner.

In the present invention, the melting point of the releasing agent may be determined by the method described in Examples below. When two or more kinds of releasing agents are used in combination, the melting point of the releasing agent as defined in the present invention means a melting point of the releasing gent having a largest weight ratio among the releasing agents contained in the resulting toner. Meanwhile, if all of the releasing agents have the same weight ratios, the lowest melting point among those of the releasing agents is regarded as the melting point of the releasing agent as defined in the present invention.

The amount of the releasing agent used is usually preferably from 1 to 20 parts by weight and more preferably from 2 to 15 parts by weight on the basis of 100 parts by weight of the resins contained in the toner from the viewpoints of enhancing a releasability of the toner to improve a low-temperature fixing property thereof and attaining a good tribocharging property of the toner.

(Production of Releasing Agent Particles)

The releasing agent particles are preferably obtained in the form of a dispersion of the releasing agent particles which is prepared by dispersing the releasing agent in an aqueous medium.

The dispersion of the releasing agent particles is preferably obtained by dispersing the releasing agent and the aqueous medium in the presence of a surfactant at a temperature not lower than a melting point of the releasing agent using a disperser. Examples of the disperser used include a homogenizer and an ultrasonic disperser.

The aqueous medium and the surfactant used for production of the releasing agent particles may be the same as those used for producing the resin mixture.

[Anionic Surfactant]

The anionic surfactant used in the present invention has a polyalkylene glycol moiety with an average molar number of addition of a $C_2$ to $C_3$ alkylene oxide of from 5 to 100. The average molar number of addition of the $C_2$ to $C_3$ alkylene oxide in the polyalkylene glycol moiety of the surfactant is from 5 to 100 mol, preferably from 8 to 47 mol, more preferably from 15 to 47 mol, still more preferably from 20 to 47 mol and further still more preferably from 20 to 30 mol from the viewpoints of attaining a good stability of the aggregated particles and a good fusibility of the resin particles as well as improving a tribocharging property, an toner cloud and a heat-resistant storage property of the resulting toner. In addition, from the viewpoints of attaining a good stability of the aggregated particles and a good fusibility of the resin particles as well as improving a tribocharging property, an toner cloud and a heat-resistant storage property of the resulting toner, the average molar number of addition of the $C_2$ to $C_3$ alkylene oxide is preferably from 6 to 50 mol, more preferably from 9 to 30 mol, still more preferably from 11 to 20 mol and further still more preferably from 12 to 15 mol.

As long as the average molar number of addition of the $C_2$ to $C_3$ alkylene oxide in the polyalkylene glycol moiety of the surfactant lies within the above specified range, the polyalkylene glycol moiety may also contain moieties derived from alkylene oxides other than ethylene oxide in a block or random manner. Examples of the alkylene oxides other than ethylene oxide include propylene oxide.

Examples of the preferred anionic surfactant include sulfuric acid ester salts and sulfonic acid salts which contain a polyethylene glycol moiety having an average molar number of addition of ethylene oxide of from 5 to 100. Among these compounds, preferred are sulfuric acid ester salts.

Examples of the preferred sulfuric acid ester salts include sulfuric acid ester salts represented by the following formula (1), polyoxyethylene alkylethersulfuric acid salts and polyoxyethylene/polyoxypropylene alkylethersulfuric acid salts. Among these sulfuric acid ester salts, more preferred are sulfuric acid ester salts represented by the following formula (1) and polyoxyethylene alkylethersulfuric acid salts, and still more preferred are sulfuric acid ester salts represented by the following formula (1).

Examples of the alkyl group contained in the polyoxyethylene-alkylethersulfuric acid salts include linear or branched alkyl groups having 8 to 18 carbon atoms.

Specific examples of the polyoxyethylene alkylethersulfuric acid salts include polyoxyethylene laurylethersulfuric acid salt, polyoxyethylene oleylethersulfuric acid salt and polyoxyethylene isoundecylethersulfuric acid salt. From the viewpoint of suppressing toner cloud, among these polyoxyethylene alkylethersulfuric acid salts, preferred is polyoxyethylene oleylethersulfuric acid salt.

As the polyoxyethylene alkylethersulfuric acid salts, there may be used sodium salts, potassium salts and lithium salts thereof. Among these metal salts, preferred are sodium salts.

Examples of the sulfonic acid salts include polyoxyalkylene alkylsulfosuccinic acid salts and the like.

From the viewpoints of improving a tribocharging property of the toner and suppressing toner cloud, the anionic surfactant used in the present invention is preferably a compound represented by the following formula (1):

(1)

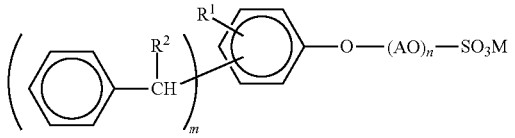

wherein $R^1$ is a hydrogen atom or an alkyl group having 1 to 12 carbon atoms; $R^2$ is a hydrogen atom or a methyl group; m is a number of 1 to 4 on average; AO is an ethyleneoxy group and/or a propyleneoxy group; n is a number of 5 to 100 on average; and M is ammonium, tetraalkyl ammonium or an alkali metal.

$R^1$ represents a hydrogen atom or an alkyl group having 1 to 12 carbon atoms. From the viewpoint of improving a tribocharging property, a toner cloud and a heat-resistant storage property of the toner, $R^1$ is preferably a hydrogen atom or an alkyl group having 1 to 3 carbon atoms, more preferably a hydrogen atom or a methyl group, and still more preferably a hydrogen atom.

From the viewpoint of obtaining a toner having a sharp particle size distribution and suppressing toner cloud as well as from the viewpoints of attaining a good stability of the aggregated particles and a good fusibility of the resin particles for improving a tribocharging property, a toner cloud and a heat-resistant storage property of the toner, $R^2$ is a hydrogen atom or a methyl group, and preferably a methyl group. Meanwhile, when m is 2 or more, the plural $R^2$ groups may be the same or different, and preferably are the same.

The anionic surfactant represented by the above formula (1) may be in the form of a mixture of compounds of the formula (1) in which m is from 1 to 4. In the formula (1), m is from 1 to 4 on average, and preferably 2 or 3 and more preferably 2 from the viewpoint of improving a tribocharging property, a toner cloud and a heat-resistant storage property of the resulting toner.

When $R^2$ is a hydrogen atom, m is preferably 2 or 3 and more preferably 3 on average.

When $R^2$ is a methyl group, m is preferably 1 or 2 and more preferably 2 on average.

In the formula (1), n is a molar number of addition of an alkyleneoxy group AO. From the viewpoints of attaining a good stability of the aggregated particles and a good fusibility of the resin particles as well as improving a tribocharging property, a toner cloud and a heat-resistant storage property of the resulting toner, n on average is from 5 to 100 mol, preferably from 6 to 50 mol, more preferably from 9 to 30 mol, still more preferably from 11 to 20 mol and further still more preferably from 12 to 15 mol.

AO represents an ethyleneoxy group and/or a propyleneoxy group wherein A represents an ethylene group ($—CH_2CH_2—$) and/or a propylene group ($—CH_2CH(CH_3)—$ or $—CH(CH_3)CH_2—$). A is preferably an ethylene group or both of an ethylene group and a propylene group, and more preferably an ethylene group. Meanwhile, when AO is a propyleneoxy group, the direction in which the propylene group is oriented is not particularly limited.

When A is an ethylene group, n on average is from 5 to 100 mol, preferably from 6 to 50 mol, more preferably from 9 to 30 mol, still more preferably from 11 to 20 mol and further still more preferably from 12 to 15 mol from the viewpoints of attaining a good stability of the aggregated particles and a good fusibility of the resin particles as well as improving a tribocharging property, a toner cloud and a heat-resistant storage property of the resulting toner.

M is preferably ammonium, tetraalkyl ammonium or an alkali metal, preferably ammonium or an alkali metal, and still more preferably ammonium, from the viewpoint of a good particle size distribution of the resulting toner.

Examples of the preferred anionic surfactant include polyoxyethylene (5 to 100) distyrenated phenylethermonosulfuric acid ester ammonium salt, polyoxypropylene (5 to 95) polyoxyethylene (95 to 5) distyrenated phenylethermonosulfuric acid ester ammonium salt and polyoxyethylene (5 to 100) tribenzylated phenylethersulfuric acid ester ammonium salt.

[Resin Particles (B)]

The resin particles (B) used in the present invention preferably contain amorphous polyester (b) from the viewpoints of good storage stability, heat-resistant storage property, toner cloud and tribocharging property of the resulting toner.

The glass transition point of the resin particles (B) may be appropriately determined according to glass transition points of resins constituting the resin particles (B) such as the amorphous polyester (b), kinds and amounts of additives used, and the like. From the viewpoints of good durability, low-temperature fixing property, tribocharging property, toner cloud, storage stability and heat-resistant storage property of the resulting toner, the glass transition point of the resin particles (B) is preferably 45° C. or higher, more preferably from 45 to 70° C., still more preferably from 50 to 70° C. and further still more preferably from 55 to 65° C.

From the viewpoints of good storage stability, heat-resistant storage property, toner cloud and tribocharging property of the resulting toner, the resin particles (B) preferably contain the amorphous polyester (b) in an amount of 70% by weight or more, more preferably 80% by weight or more, still more preferably 90% by weight or more, further still more preferably 95% by weight or more, and especially preferably substantially 100% by weight.

The resin particles (B) may contain, in addition to the amorphous polyester (b), known resins ordinarily used in toners. Examples of the resins include the crystalline polyester (a), styrene-acryl copolymers, epoxy resins, polycarbonates and polyurethane resins.

The resin particles (B) may be obtained by the same method as used for production of the above resin particles (A). In the method of producing the resin particles (B), the same alkali aqueous solution, surfactants and aqueous medium as used for production of the resin particles (A) may also be suitably used.

(Amorphous Polyester (b))

In the present invention, the amorphous resin (b) means a polyester having a crystallinity index of more than 1.4 or less than 0.6.

The crystallinity index of the amorphous resin (b) is preferably less than 0.6 or more than 1.4 but not more than 4, more preferably less than 0.6 or not less than 1.5 but not more than 4, still more preferably less than 0.6 or not less than 1.5 but not more than 3, and further still more preferably less than 0.6 or not less than 1.5 but not more than 2 from the viewpoint of a good low-temperature fixing property of the resulting toner. The crystallinity index of the amorphous resin (b) may be appropriately determined according to the kinds and proportions of the raw monomers used, production conditions (such as, reaction temperature, reaction time and cooling rate), and the like.

The amorphous polyester (b) preferably contains an acid group at a terminal end of a molecule thereof. Examples of the acid group include a carboxyl group, a sulfonic group, a phosphonic group and a sulfinic group. Among these acid groups, preferred is a carboxyl group from the viewpoint of facilitated emulsification of the polyester.

The amorphous polyester (b) may be produced by subjecting an acid component and an alcohol component to polycondensation reaction according to the same method as used for production of the above crystalline polyester (a).

Examples of the acid component include succinic acids substituted with an alkyl group having 1 to 20 carbon atoms or an alkenyl group having 2 to 20 carbon atoms and other dicarboxylic acids, trivalent or higher-valent polycarboxylic acids, and anhydrides and alkyl ($C_1$ to $C_3$) esters of these acids. Among these acids, preferred are dicarboxylic acids.

Specific examples of the succinic acids substituted with an alkyl group having 1 to 20 carbon atoms or an alkenyl group having 2 to 20 carbon atoms include dodecylsuccinic acid, dodecenylsuccinic acid and octenylsuccinic acid.

Specific examples of the dicarboxylic acids include phthalic acid, isophthalic acid, terephthalic acid, sebacic acid, fumaric acid, maleic acid, adipic acid, azelaic acid, succinic acid and cyclohexanedicarboxylic acid. Among these dicarboxylic acids, preferred are fumaric acid and terephthalic acid, and more preferred is fumaric acid.

Specific examples of the trivalent or higher-valent polycarboxylic acids include trimellitic acid, 2,5,7-naphthalene-tricarboxylic acid and pyromellitic acid. Among these polycarboxylic acids, preferred are trimellitic acid and trimellitic anhydride from the viewpoint of a good anti-hot offset property.

These acid components may be used alone or in combination of any two or more thereof.

The amorphous polyester (b) preferably contains at least one kind of amorphous polyester (b) obtained using an acid component containing a trivalent or higher-valent polycarboxylic acid or an anhydride or an alkyl ester thereof, preferably trimellitic acid or trimellitic anhydride, from the viewpoint of a good anti-offset property of the resulting toner.

As the alcohol component, there may be use the same alcohol components as used for production of the crystalline polyester (a). Among these alcohol components, from the viewpoint of obtaining the amorphous polyester, preferred are aromatic diols, and more preferred are allylene ($C_2$ to $C_3$) oxide adducts (average molar number of addition: 1 to 16) of bisphenol A such as polyoxypropylene-2,2-bis(4-hydroxyphenyl)propane and polyoxyethylene-2,2-bis(4-hydroxyphenyl)propane.

These alcohol components may be used alone or in combination of any two or more thereof.

The glass transition point of the amorphous polyester (b) is preferably from 50 to 70° C., more preferably from 55 to 68° C., still more preferably from 58 to 66° C. and further still more preferably from 58 to 65° C. from the viewpoints of good durability, low-temperature fixing property, tribocharging property, toner cloud, storage stability and heat-resistant storage property of the resulting toner.

Form the same viewpoints, the softening point of the amorphous polyester (b) is preferably from 70 to 165° C., more preferably from 70 to 140° C., still more preferably from 90 to 140° C. and especially preferably from 100 to 130° C.

Meanwhile, when the amorphous polyester (b) is in the form of a mixture of two or more kinds of amorphous polyesters, the glass transition point and softening point of the amorphous polyester (b) are respectively determined from the values of a glass transition point and a softening point of a mixture of two or more kind of amorphous polyesters as measured according to the method described in Examples below.

The number-average molecular weight of the amorphous polyester (b) is preferably from 1,000 to 50,000, more preferably from 1,000 to 10,000, still more preferably from 1,500 to 10,000, further still more preferably from 2,000 to 8,000 and especially preferably from 2,000 to 4,000 from the viewpoints of good durability, low-temperature fixing property, storage stability and heat-resistant storage property of the resulting toner.

The acid value of the amorphous polyester (b) is preferably from 6 to 35 mg KOH/g, more preferably from 10 to 35 mg KOH/g and still more preferably from 15 to 35 mg KOH/g from the viewpoint of well emulsifying the resins in the aqueous medium.

The amorphous polyester (b) preferably contain two or more kinds of polyesters which are different in softening point from each other from the viewpoints of good low-temperature fixing property, anti-offset property, tribocharging property, toner cloud and durability of the resulting toner. Among the two kinds of polyesters which are different in softening point from each other, the softening point of one polyester (b-1) is preferably not lower than 70° C. and lower than 115° C., whereas the softening point of the other polyester (b-2) is preferably not lower than 115° C. and not higher than 165° C. The weight ratio of the polyester (b-1) to the polyester (b-2) ((b-1)/(b-2)) is preferably from 10/90 to 90/10 and more preferably from 50/50 to 90/10.

Meanwhile, in the present invention, the crystalline polyester (a) and the amorphous polyesters (b) and (c) may be respectively used in the form of a modified product thereof unless the effects of the present invention are adversely influenced. As the method of modifying the respective polyesters, there may be mentioned the method of grafting or blocking the polyester with phenol, urethane, epoxy or the like, by the methods described, for example, in JP-A-11-133668, JP-A-10-239903 and JP-A-8-20636, and the method of forming composite resins containing two or more kinds of resin units including a polyester unit, and the like.

[Inorganic Acid]

In the present invention, the inorganic acid is used for adjusting a pH value of the aqueous mixed solution as measured at 25° C. which is used in the step of fusing the aggregated particles, to the range of 2.0 to 6.0.

The inorganic acid used in the fusing step is not particularly limited, and is preferably a mineral acid from the viewpoints of efficiently adjusting the pH value and efficiently fusing the aggregated particles.

Examples of the mineral acid include hydrochloric acid, sulfuric acid and nitric acid. Among these mineral acids, preferred are hydrochloric acid and sulfuric acid. In the first and second embodiments, hydrochloric acid is preferably used, whereas in the third embodiment, sulfuric acid is preferably used.

The inorganic acid is preferably used in the form of an aqueous solution thereof. The concentration of the inorganic acid in the aqueous solution is preferably from 0.1 to 5.0 N, more preferably from 0.5 to 3.0 N and still more preferably from 0.1 to 2.0 N. The unit "N" used herein means a normality of the inorganic acid (the value obtained by multiplying a concentration (mol/L) of the inorganic acid by an equivalent amount thereof).

<Process for Producing Toner for Electrophotography>

The process for producing a toner for electrophotography according to the present invention includes the step of fusing aggregated particle containing the resin particles (A) and the releasing agent particles in an aqueous mixed solution containing the aggregated particles and an anionic surfactant containing a polyalkylene glycol moiety having an average molar number of addition of a $C_2$ to $C_3$ alkylene oxide of from 5 to 100 after and/or while adjusting a pH value of the aqueous mixed solution as measured at 25° C. to 2.0 to 6.0.

The aggregated particles used in the above step are preferably aggregated particles (2) which are produced through a step (1) of mixing and aggregating the resin particles (A), the releasing agent particles and an aggregating agent in an aqueous medium to obtain aggregated particles (1), and a step (2) of adding the resin particles (B) containing the amorphous polyester (b) to the aggregated particles (1) obtained in the step (1) to obtain the aggregated particles (2).

The above step of fusing the aggregated particles preferably includes a step (4) of maintaining the aggregated particles (2) at a temperature which is not lower than the temperature lower by 10° C. than a glass transition point of the amorphous polyester (b) but not higher than the temperature higher by 5° C. than the glass transition point to obtain fussed core/shell particles ((Tg−10)° C. to (Tg+5)° C.).

In addition, as an optional step to be conducted subsequent to the step (2) but prior to the step (4), the above fusing step may also include a step (3) of adding the above anionic surfactant.

Further, an inorganic acid is preferably added in the step (3) and/or the step (4) to adjust a pH value of the solution to 2.0 to 6.0, in particular, the inorganic acid is more preferably added in the step (3) to adjust a pH value of the solution to 2.0 to 6.0 from the viewpoint of suppressing formation of coarse particles and occurrence of toner cloud.

The first embodiment of the process for producing a toner for electrophotography according to the present invention includes the step of fusing aggregated particle containing the resin particles (A) and the releasing agent particles in an aqueous mixed solution containing the aggregated particles and an anionic surfactant containing a polyethylene glycol moiety having an average molar number of addition of ethylene oxide of 5 to 100 after and/or while adjusting a pH value of the aqueous mixed solution as measured at 25° C. to 2.5 to 6.0.

Also, the second embodiment of the process for producing a toner for electrophotography according to the present invention includes the step of fusing aggregated particle containing the resin particles (A) and the releasing agent particles in an aqueous mixed solution containing the aggregated particles and an anionic surfactant represented by the above formula (1) after and/or while adjusting a pH value of the aqueous mixed solution as measured at 25° C. to 2.0 to 6.0.

Further, the third embodiment of the process for producing a toner for electrophotography according to the present invention includes, in addition to the step (step (X)) of fusing aggregated particle containing the resin particles (A) and the releasing agent particles in an aqueous mixed solution containing the aggregated particles and an anionic surfactant containing a polyalkylene glycol moiety having an average molar number of addition of a $C_2$ to $C_3$ alkylene oxide of 5 to 100 after and/or while adjusting a pH value of the aqueous mixed solution as measured at 25° C. to 2.0 to 5.0, the following steps (5) and (6).

Step (5): adjusting a pH value of a dispersion of fused particles obtained in the step of fusing the aggregated particles to 5.5 to 7.5 as measured at 25° C.; and Step (6): removing a liquid portion from the dispersion of the fused particles obtained in the step (5) by filtration to obtain toner particles.

More specifically, the process for producing a toner for electrophotography according to the present invention preferably includes the following steps (1) to (4).

Step (1): mixing and aggregating the resin particles (A), the releasing agent particles and an aggregating agent in an aqueous medium to obtain aggregated particles (1);

Step (2): adding the resin particles (B) containing the amorphous polyester (b) to the aggregated particles (1) obtained in the step (1) to obtain aggregated particles (2);

Step (3): adding the above anionic surfactant; and

Step (4): maintaining the aggregated particles (2) at a temperature which is not lower than the temperature lower by 10° C. than a glass transition point of the amorphous polyester (b) but not higher than the temperature higher by 5° C. than the glass transition point to obtain fussed core/shell particles.

In addition, in the more preferred embodiment of the present invention, in the step (3) and/or the step (4), an inorganic is added to the aqueous mixed solution to adjust a pH value thereof to 2.0 to 6.0. More specifically, after adjusting the pH value of the aqueous mixed solution to 2.0 to 6.0 in the step (3), and/or while adjusting the pH value of the aqueous mixed solution to 2.0 to 6.0 in the step (4), the aggregated particles in the aqueous mixed solution are fused to obtain fused core/shell particles.

In the following, the respective steps are explained.

[Step (1)]

In the step (1), the resin particles (A), the releasing agent particles and an aggregating agent are mixed and aggregated together in an aqueous medium to obtain aggregated particles (1).

In the step (1), first, the resin particles (A) and the releasing agent particles are mixed in the aqueous medium to obtain a mixed dispersion.

Meanwhile, in the step (1), a colorant is preferably mixed as an optional component. The colorant may be mixed as separate particles by itself or may be incorporated into the resin particles (A). From the viewpoint of control of aggregation, the colorant is preferably incorporated into the resin particles (A).

Also, in the step (1), resin particles other than the resin particles (A) may be mixed. The resin particles other than the resin particles (A) are preferably amorphous polyester-containing resin particles and more preferably resin particles having the same composition as that of the resin particles (B).

The order of mixing of the respective materials is not particularly limited, and these materials may be added either sequentially or simultaneously.

The resin particles (A) are preferably contained in the mixed dispersion in an amount of from 10 to 40 parts by weight and more preferably from 20 to 30 parts by weight, whereas the aqueous medium is preferably contained in the dispersion in an amount of from 60 to 90 parts by weight and more preferably from 70 to 80 parts by weight.

Also, the colorant is preferably contained in the mixed dispersion in an amount of from 1 to 20 parts by weight and more preferably from 3 to 15 parts by weight on the basis of 100 parts by weight of the resins constituting the resin particles (A) from the viewpoint of a high image density. Whereas, the releasing agent particles are preferably contained in the mixed dispersion in an amount of from 1 to 20 parts by weight and more preferably from 2 to 15 parts by weight on the basis of 100 parts by weight of a total amount of the resins and colorant from the viewpoints of good releasing property and tribocharging property of the resulting toner.

The mixing temperature used in the step (1) is preferably from 0 to 40° C. from the viewpoint of control of aggregation.

Next, the particles in the mixed dispersion are aggregated together to obtain a dispersion of the aggregated particles (1). In this case, an aggregating agent is preferably added to the mixed dispersion in order to conduct aggregation of the particles efficiently.

Examples of the aggregating agent used in the present invention include organic aggregating agents such as a cationic surfactant in the form of a quaternary salt and polyethyleneimine; and inorganic aggregating agents such as an inorganic metal salt, an inorganic ammonium salt and a divalent or higher-valent metal complex.

Specific examples of the inorganic metal salt include metal salts such as sodium sulfate, sodium chloride, calcium chloride and calcium nitrate; and inorganic metal salt polymers such as poly(aluminum chloride) and poly(aluminum hydroxide). Specific examples of the inorganic ammonium salt include ammonium sulfate, ammonium chloride and ammonium nitrate. Among these inorganic ammonium salts, preferred is ammonium sulfate.

The amount of the aggregating agent used is preferably 50 parts by weight or less, more preferably 40 parts by weight or less and still more preferably 30 parts by weight or less on the basis of 100 parts by weight of the resins constituting the resin particles (A) from the viewpoint of a good tribocharging property of the resulting toner, and also is preferably 1 part by weight or more, more preferably 3 parts by weight or more, and still more preferably 5 parts by weight or more on the basis of 100 parts by weight of the resins constituting the resin particles (A) from the viewpoint of a good aggregating property of the resin particles. From these viewpoints, the amount of the monovalent salt used as the aggregating agent is preferably from 1 to 50 parts by weight, more preferably from 3 to 40 parts by weight and still more preferably from 5 to 30 parts by weight on the basis of 100 parts by weight of the resins constituting the resin particles (A).

As the aggregating method, there may be used the method in which the aggregating agent, preferably an aqueous solution of the aggregating agent, is added dropwise into a container filled with the mixed dispersion. In this case, the aggregating agent may be added at one time, or intermittently or continuously. Upon and after adding the aggregating agent, the obtained dispersion is preferably fully stirred. The dropping time of the aggregating agent is preferably from 1 to 120 minutes, and the dropping temperature thereof is preferably from 0 to 50° C. from the viewpoint of control of aggregation and shortened production time of the toner.

From the viewpoint of reducing a particle size of the toner and lessening an amount of the toner scattered within printers, the volume median particle size of the obtained aggregated particles (1) is preferably from 1 to 10 μm, more preferably from 2 to 9 μm and still more preferably from 3 to 6 μm, and the CV value of the aggregated particles (1) is preferably 30% or less, more preferably 28% or less and still more preferably 25% or less.

[Step (2)]

In the step (2), the resin particles (B) containing the amorphous polyester (b) are added to the aggregated particles (1) obtained in the step (1) to obtain aggregated particles (2).

In the step (2), it is preferred that a dispersion of the resin particles (B) containing the amorphous polyester (b) be added to a dispersion of the aggregated particles (1) obtained in the step (1) to allow the resin particles (B) to further adhere to the aggregated particles (1), thereby obtaining the aggregated particles (2).

Before adding the dispersion containing the resin particles (B) (dispersion of resin particles (B)) to the dispersion containing the aggregated particles (1) (dispersion of aggregated particles (1)), the dispersion of aggregated particles (1) may be diluted by adding an aqueous medium thereto. The addition of the aqueous medium to the dispersion of aggregated particles (1) is preferred since the resin particles (B) can be more uniformly attached onto the aggregated particles (1).

When the dispersion of resin particles (B) is added to the dispersion of aggregated particles (1), the above aggregating agent may be used in order to allow the resin particles (B) to adhere to the aggregated particles (1) in an efficient manner.

As the method of adding the dispersion of resin particles (B) to the dispersion of aggregated particles (1), there may be mentioned the method in which the aggregating agent and the dispersion of resin particles (B) are added simultaneously to the dispersion of aggregated particles (1), the method in which the aggregating agent and the dispersion of resin particles (B) are added alternately to the dispersion of aggregated particles (1), the method in which the dispersion of resin particles (B) is added to the dispersion of aggregated particles (1) while gradually raising a temperature of the dispersion of aggregated particles (1). By using these methods, it is possible to prevent deterioration in aggregating property of the aggregated particles (1) and the resin particles (B) owing to decrease in concentration of the aggregating agent. From the viewpoints of a high productivity of the toner and facilitated production thereof, among these methods, there is preferably used the method in which the dispersion of resin particles (B) is added to the dispersion of aggregated particles (1) while gradually raising a temperature of the dispersion of aggregated particles (1).

The temperature used in the reaction system of the step (2) is preferably lower by 5° C. or more than a melting point of the crystalline polyester (a) contained in the resin particles (A), and also is preferably lower by 3° C. or more and more preferably lower by 5° C. or more than a glass transition point of the amorphous polyester (b). When producing the aggregated particles (2) in such a temperature range, the resulting toner can exhibit a good low-temperature fixing property and a good storage stability. The reason therefor is considered as follows although it is not clearly determined. That is, it is considered that since no fusion between the aggregated particles (2) occurs, formation of coarse particles can be prevented, and crystallizability of the crystalline polyester (a) can be maintained.

From the viewpoints of a good low-temperature fixing property, a less toner cloud and a good storage stability of the toner, the amount of the resin particles (B) added is controlled such that the weight ratio of the resin particles (B) to the resin particles (A) [resin particles (B)/resin particles (A)] is preferably from 0.3 to 1.5, more preferably from 0.3 to 1.0 and still more preferably from 0.35 to 0.75.

The dispersion of resin particles (B) may be added continuously over a predetermined period of time, or may be added at one time or intermittently in plural divided parts. The dispersion of resin particles (B) is preferably added continuously over a predetermined period of time or intermittently in plural divided parts. By adding the dispersion of resin particles (B) in the above manner, the resin particles (B) are likely to be selectively attached onto the aggregated particles (1). Among them, from the viewpoints of promotion of selective attachment of the resin particles (B) onto the aggregated particles (1) and efficient production of the toner, the dispersion of resin particles (B) is preferably added continuously over a predetermined period of time. The time period of continuously adding the dispersion of resin particles (B) to the dispersion of the aggregated particles (1) is preferably from 1 to 10 hours and more preferably from 3 to 8 hours from the viewpoints of obtaining the uniform aggregated particles (2) and shortening a production time thereof.

The volume median particle size of the aggregated particles (2) obtained in the step (2) is preferably from 1 to 10 μm, more preferably from 2 to 10 μm, still more preferably from 3 to 9 μm and further still more preferably from 4 to 6 μm from the viewpoints of obtaining a toner capable of forming images having a high image density.

The pH value of the aggregated particles (2) obtained in the step (2) is preferably from 5.5 to 7.5, more preferably from 6.0 to 7.0 and still more preferably from 6.0 to 6.5.

[Step (3)]

In the step (3), the above anionic surfactant is added. In the step (3), it is preferred that an inorganic acid is added to the dispersion of aggregated particles (2) obtained in the step (2) to adjust a pH value of the dispersion to 2.0 to 6.0.

The amount of the surfactant added is preferably from 1 to 20 parts by weight, more preferably from 1 to 10 parts by weight and still more preferably from 1.5 to 5 parts by weight on the basis of 100 parts by weight of a total amount of the resins in the reaction system from the viewpoints of suppressing formation of coarse particles and reducing a residual amount of the surfactant in the toner.

The temperature of the reaction system upon adding the surfactant and the inorganic acid thereto is not particularly limited, and is preferably from 10 to 60° C., more preferably from 20 to 57° C., still more preferably from 25 to 57° C. and further still more preferably from 25 to 45° C.

In the step (3), the inorganic acid may be added in the form of a mixture with the surfactant or may be added separately from the surfactant. When the inorganic acid is added separately from the surfactant, the order of addition of the inorganic acid and the surfactant is not particularly limited. From the viewpoint of suppressing formation of coarse particles, it is preferred that after adding the surfactant, the inorganic acid is then added.

When the inorganic acid is added in the step (3), the pH value of the resulting dispersion is decreased owing to addition of the acid. From the viewpoints of a good fusibility of the resin particles and a good stability of the aggregated particles, i.e., prevention of fusion between the aggregated particles, the amount of the inorganic acid added is preferably controlled such that the pH value of the resulting dispersion lies within the range of from 2.0 to 6.0. In the first embodiment of the present invention, the pH value of the dispersion is preferably from 2.5 to 6.0, more preferably from 3.0 to 6.0, still more preferably from 3.5 to 5.5 and further still more preferably from 4.0 to 5.0. In the second embodiment of the present invention, the pH value of the dispersion is preferably from 2.5 to 6.0, more preferably from 2.5 to 5.5, still more preferably from 2.5 to 5.0 and further still more preferably from 2.5 to 3.5 from the viewpoints of obtaining a toner having a sharp particle size distribution and suppressing toner cloud. Also, in the third embodiment of the present invention, the pH value of the dispersion is preferably from 2.5 to 5.0, more preferably from 2.5 to 4.5, still more preferably from 2.5 to 4.0 and further still more preferably from 3.0 to 4.0 from the viewpoints of improving a low-temperature fixing property, a tribocharging property, a toner cloud and a heat-resistant storage property of the resulting toner.

[Step (4)]

In the step (4), the aggregated particles (2) are maintained at a temperature which is not lower than the temperature lower by 10° C. than a glass transition point of the amorphous polyester (b) but not higher than the temperature higher by 5° C. than the glass transition point to obtain fused core/shell particles. The step (4) is preferably conducted such that the pH value of the obtained dispersion finally lies within the range of from 2.0 to 6.0. When no inorganic acid is added in the step (3), it is preferable to add the inorganic acid in the step (4).

In the step (4), the respective particles contained in the aggregated particles (2) which are attached to each other mainly by only a physical force are integrally fused together to thereby form core/shell particles.

From the viewpoints of a good fusibility of the aggregated particles and a high productivity of the toner, in the step (4), the aggregated particles (2) are maintained at a temperature which is preferably not lower than the temperature lower by 8° C. than the glass transition point of the amorphous polyester (b), more preferably not lower than the temperature lower by 6° C. than the glass transition point and still more preferably not lower than the temperature lower by 5° C. than the glass transition point. Further, from the viewpoints of attaining a good tribocharging property of the toner and suppressing toner cloud, in the step (4), the aggregated particles (2) are maintained at a temperature which is preferably not higher than the temperature higher by 10° C. than the glass transition point of the amorphous polyester (b), more preferably not higher than the temperature higher by 8° C. than the glass transition point and still more preferably not higher than the temperature higher by 6° C. than the glass transition point.

In addition, from the viewpoints of good storage stability and tribocharging property of the toner, in the step (4), the aggregated particles (2) are maintained at a temperature which is preferably not higher than the temperature lower by 5° C. than a melting point of the crystalline polyester (a), more preferably not higher than the temperature lower by 7° C. than the melting point, and still more preferably not higher than the temperature lower by 10° C. than the melting point.

Further, from the viewpoints of a good fusibility of the particles, good storage stability and tribocharging property of the toner and a high productivity of the toner, in the step (4), the aggregated particles (2) are maintained at a temperature which is preferably not lower than the temperature lower by 5° C. than a glass transition point of the resin particles (B) but not higher than the temperature higher by 10° C. than the glass transition point.

Furthermore, from the viewpoints of a good tribocharging property of the toner, in the step (4), the aggregated particles (2) are maintained at a temperature which is preferably not higher than the temperature lower by 5° C. than a melting point of the releasing agent, more preferably not higher than the temperature lower by 7° C. than the melting point, and still more preferably not higher than the temperature lower by 10° C. than the melting point.

In the step (4), from the viewpoint of a good fusibility of the particles, the aggregated particles (2) are preferably maintained at a temperature of from 55 to 70° C., more preferably from 57 to 65° C. and still more preferably from 58 to 62° C.

In the step (4), from the viewpoints of a good fusibility of the resin particles and a good stability of the aggregated particles, i.e., prevention of fusion between the aggregated particles, the pH value of the dispersion preferably lies within the range of from 2.0 to 6.0. In the first embodiment of the present invention, the pH value of the dispersion is more preferably from 2.5 to 6.0, still more preferably from 3.0 to 6.0, further still more preferably from 3.5 to 5.5 and further still more preferably from 4.0 to 5.0. In the second embodiment of the present invention, the pH value of the dispersion is more preferably from 2.5 to 6.0, still more preferably from 2.5 to 5.0, and further still more preferably from 2.5 to 3.5. Also, in the third embodiment of the present invention, the pH value of the dispersion is more preferably from 2.5 to 5.0, still more preferably from 2.5 to 4.5, further still more preferably from 2.5 to 4.0 and further still more preferably from 3.0 to 4.0.

When the inorganic acid is added in the step (4), the amount of the inorganic acid added is more preferably controlled such that the pH value of the dispersion after adding the inorganic acid thereto lies within the above specified range.

The holding time in the step (4) is preferably from 1 to 24 hours, more preferably from 1 to 18 hours, still more preferably from 2 to 12 hours and further still more preferably from 2 to 5 hours from the viewpoints of a good fusibility of the particles, good storage stability, heat-resistant storage property and tribocharging property of the toner and a high productivity of the toner.

When the inorganic acid is added in the step (4), the inorganic acid is preferably added within 3 hours, more preferably within 2 hours and still more preferably within 1 hour from the time at which the above temperature to be maintained has been reached.

In the step (4), the progress of fusion of the aggregated particles is preferably confirmed by monitoring a circularity of the core/shell particles as produced. The circularity of the core/shell particles is monitored by the method described in Examples below. When the circularity reaches 0.955 or more, the reaction system is cooled to terminate fusion of the particles. The circularity of the finally obtained core/shell particles is from 0.955 to 0.995, preferably from 0.958 to 0.985, still more preferably from 0.960 to 0.985, further still more preferably from 0.960 to 0.980 and further still more preferably from 0.965 to 0.980 from the viewpoints of good toner cloud and cleaning property of the resulting toner.

The circularity of the thus fused core/shell particles is preferably larger by 0.01 or more, more preferably larger by 0.012 or more, and still more preferably larger by 0.015 or more, than a circularity of the aggregated particles (2) from the viewpoints of enhancing a heat-resistant storage property of the toner and suppressing toner cloud.

In the step (4), it is considered that when the circularity of the particles is increased by 0.01 or more, a core portion of the respective particles is well capsulated by a shell portion thereof, so that the resulting core/shell particles can be enhanced in heat-resistant storage property and prevented from toner cloud.

The BET specific surface area of the fused core/shell particles as measured by a nitrogen adsorption method is preferably from 1.0 to 5.0 $m^2/g$, more preferably from 1.0 to 4.0 $m^2/g$, still more preferably from 1.0 to 3.5 $m^2/g$, further still more preferably from 1.5 to 3.0 $m^2/g$, further still more preferably from 1.5 to 2.5 $m^2/g$, and especially preferably from 1.3 to 2.3 $m^2/g$ from the viewpoints of good tribocharging property and storage stability of the resulting toner.

From the viewpoint of a high image quality of the toner, the volume median particle size of the core/shell particles obtained in the step (4) is preferably from 2 to 10 μm, more preferably from 2 to 8 μm, still more preferably from 2 to 7 μm, further still more preferably from 3 to 8 μm and further still more preferably from 4 to 6 μm.

Meanwhile, the average particle size of the fused core/shell particles obtained in the step (4) is preferably not larger than that of the aggregated particles (2). That is, in the step (4), the core/shell particles are preferably free from aggregation and fusion therebetween.

[Additional Treatment Step]

In the present invention, subsequent to completion of the step (4), the obtained dispersion may be subjected to a post-treatment step. In the additional treatment step, the core/shell particles are preferably isolated from the dispersion to obtain toner particles.

The core/shell particles obtained in the step (4) are present in the aqueous medium. Therefore, the dispersion is preferably first subjected to solid-liquid separation. The solid-liquid separation procedure is preferably conducted by a suction filtration method and the like.

The particles obtained by the solid-liquid separation are preferably then washed. When the resin particles (A) and (B) are produced in the presence of a nonionic surfactant, the nonionic surfactant added is also preferably removed by washing. Therefore, the resulting particles are preferably washed with an aqueous solution at a temperature not higher than a cloud point of the nonionic surfactant. The washing treatment is preferably carried out plural times.

Next, the obtained core/shell particles are preferably dried. The temperature upon drying the particles is preferably controlled such that the temperature of the core/shell particles themselves is lower by 5° C. or more, and preferably lower by 10° C. or more, than the melting point of the crystalline polyester. As the drying method, there are preferably used a vibration-type fluidization drying method, a spray-drying method, a freeze-drying method and a flash jet method and the like. The water content in the particles obtained after drying is preferably adjusted to 1.5% by weight or less and more preferably 1.0% by weight or less from the viewpoint of a less toner cloud and a good tribocharging property of the resulting toner.

[Step (5)]

In addition, in the third embodiment of the present invention, subsequent to the above step of fusing the aggregated particles, the step (5) is preferably carried out. In particular, the step (5) is more preferably carried out after the step (4).

In the step (5), the pH value of the dispersion of the fused particles obtained in the step of fusing the aggregated particles, in particular, in the step (4), is adjusted to 5.5 to 7.5 as measured at 25° C.

In the step (5), the pH value of the dispersion as measured at 25° C. is adjusted to the range of from 5.5 to 7.5, preferably from 5.5 to 7.3, more preferably from 5.7 to 7.2 and still more preferably from 6.5 to 7.1 from the viewpoints of good heat-resistant storage property, toner cloud and tribocharging property under high-temperature and high-humidity conditions of the toner.

In the step (5), the pH value of the dispersion is preferably adjusted using a base. Examples of the suitable base include alkali metal hydroxides, water-soluble amines, and organic ammonium hydroxides. Among these bases, from the viewpoint of a good heat-resistant storage property of the resulting toner, preferred are alkali metal hydroxides and water-soluble amines, and more preferred are alkali metal hydroxides.

Specific examples of the preferred alkali metal hydroxides include potassium hydroxide and sodium hydroxide.

Specific examples of the water-soluble amines include $C_1$ to $C_3$ alcohol amines. Among these alcohol amines, preferred are $C_2$ alcohol amines, and more preferred is triethanol amine.

The base is preferably added in the form of aqueous solution thereof to the dispersion of the fused particles obtained in the step of fusing the aggregated particles.

The concentration of the base in the aqueous solution is preferably from 0.1 to 30% by weight and more preferably from 1 to 10% by weight from the viewpoint of a good heat-resistant storage property of the resulting toner.

In the step (5), the reaction system is preferably maintained at a temperature of from 55 to 70° C., more preferably from 57 to 65° C. and still more preferably from 58 to 62° C. from the viewpoints of good heat-resistant storage property, toner cloud and tribocharging property under high-temperature and high-humidity conditions of the resulting toner.

The holding time to be maintained in the above temperature range in the step (5) is preferably from 0.1 to 10 hours and more preferably from 0.3 to 5 hours from the viewpoints of good heat-resistant storage property, toner cloud and tribocharging property under high-temperature and high-humidity conditions of the resulting toner. Meanwhile, while maintaining the reaction system in the step (5) in the above temperature range, the dispersion is preferably stirred, and after the elapse of the above holding time, the dispersion is preferably cooled to a temperature of from 20 to 30° C.

[Step (6)]

In the step (6), a liquid portion is removed from the dispersion of fused particles obtained in the step (5) to obtain toner particles.

The fused particles obtained in the step (5) are present in the aqueous medium in the form of a dispersion thereof. Therefore, in the step (6), the liquid portion is removed from the dispersion. The step (6) is carried out for the purpose of removing the surfactant or the like from the surface of the toner particles to ensure a good tribocharging property of the resulting toner.

As the method of removing the liquid portion from the dispersion, there are preferably used a pressure filtration method, a reduced pressure filtration method, and a centrifugal separation method. Among these methods, preferred is a pressure filtration method, and more preferred is combination of a pressure filtration method and a reduced pressure filtration method.

As the preferred pressure filtration method, there may be mentioned a method using a filter press. As the preferred reduced pressure filtration method, there may be mentioned a suction filtration method using a Buchner funnel.

In the step (6), the fuse particles are preferably washed while or after removing the liquid portion from the dispersion thereof. In particular, when removing the liquid portion from the dispersion by any of a pressure filtration method, a reduced pressure filtration method and a centrifugal separation method, a solvent used for the washing is preferably flowed through a layer of the fused particles from which the liquid portion has been removed.

The solvent used for the washing is preferably an aqueous solvent and more preferably water. Specifically, deionized water is preferably used as the solvent.

When allowing the water to flow through the layer of the fused particles, the amount of the water flowing therethrough is controlled such that the conductivity of the effluent water is preferably 1.0 mS/m or less and more preferably 0.5 mS/m or less.

When using combination of a pressure filtration method and a reduced pressure filtration method, a water-containing cake-like product obtained by the pressure filtration is further subjected to reduced pressure filtration to remove water therefrom.

Next, the obtained cake-like product is preferably dried. The drying method is not particularly limited. The cake-like product is preferably dried by flowing a gas therethrough. The drying temperature is controlled such that the temperature of the fused particles themselves is lower by 5° C. or more and preferably lower by 10° C. or more, than the melting point of the crystalline polyester. The water content in the particles after the drying is preferably 1.5% by weight or less and more preferably 1.0% by weight or less from the viewpoints of a less toner cloud and a good tribocharging property of the toner.

<Toner for Electrophotography>

(Toner)

The toner particles obtained by the drying may be directly used as a toner according to the present invention. However, the toner particles are preferably subjected to the below-mentioned surface treatment, and the thus surface-treated toner particles can be used as the toner according to the present invention.

The softening point of the resulting toner is preferably from 60 to 140° C., more preferably from 60 to 130° C. and still more preferably from 60 to 120° C. from the viewpoint of a good low-temperature fixing property of the toner. The glass transition point of the toner is preferably from 30 to 80° C. and more preferably from 40 to 70° C. from the viewpoints of good low-temperature fixing property, durability, storage stability and heat-resistant storage property of the toner.

The circularity of the toner particles is preferably from 0.955 to 0.985, more preferably from 0.955 to 0.980, and still more preferably from 0.965 to 0.980 from the viewpoints of good storage stability, toner cloud and cleaning property of the toner. The circularity of the toner particles may be measured by the below-mentioned method. Meanwhile, the circularity of the toner particles as used in the present invention means the value calculated from a ratio of a peripheral length of a circle having the same area as a projected area of a particle to a peripheral length of a projected image of the particle. As the shape of the particles is closer to a sphere, the circularity of the particles becomes closer to 1.

The toner obtained according to the process of the present invention has a core/shell structure whose shell portion preferably contains the amorphous polyester (b) in an amount of from 50 to 100% by weight, more preferably from 70 to 100% by weight and still more preferably from 90 to 100% by weight.

The volume median particle size of the toner is preferably from 1 to 10 μm, more preferably from 2 to 8 μm, still more preferably from 3 to 7 μm and further still more preferably from 4 to 6 μm from the viewpoints of a high image quality and a high productivity of the toner.

The CV value of the toner is preferably 30% or less, more preferably 27% or less, still more preferably 25% or less and further still more preferably 22% or less from the viewpoints of a high image quality and a high productivity of the toner.

(External Additives)

The thus obtained toner particles may be directly used as the toner for electrophotography according to the present invention. However, the toner particles are preferably subjected to surface treatment with an external additive such as a fluidizing agent, and the resulting surface treated toner particles may be used as the toner for electrophotography according to the present invention.

Examples of the external additive include optional fine particles, for example, inorganic fine particles such as hydrophobic silica fine particles, titanium oxide fine particles, alumina fine particles, cerium oxide fine particles and carbon blacks; and polymer fine particles such as fine particles of polycarbonates, polymethyl methacrylate, silicone resins. Among these fine particles, preferred are hydrophobic silica fine particles.

When subjecting the toner particles to surface treatment with the external additive, the amount of the external additive added to the toner is preferably from 1 to 5 parts by weight, more preferably from 1 to 3.5 parts by weight and still more preferably from 1 to 3 parts by weight on the basis of 100 parts by weight of the toner particles before being treated with the external additive.

The toner for electrophotography obtained according to the present invention can be used as one-component system developer, or can be mixed with a carrier to form a two-component system developer.

EXAMPLES

Various properties of polyesters, rein particles, toners, were measured and evaluated by the following methods.

[Acid Value of Polyesters]

Determined according to JIS K0070 except that chloroform was used as a solvent for the measurement.

[Softening Point, Endothermic Maximum Peak Temperature, Melting Point and Glass Transition Point of Polyesters]

(1) Softening Point

Using a flow tester "CFT-500D" (tradename) available from Shimadzu Corporation, 1 g of a sample was extruded through a nozzle having a die pore diameter of 1 mm and a length of 1 mm while heating the sample at a temperature rise rate of 6° C./min and applying a load of 1.96 MPa thereto by a plunger. The softening point was determined as the temperature at which a half amount of the sample was flowed out when plotting a downward movement of the plunger of the flow tester relative to the temperature.

(2) Endothermic Maximum Peak Temperature, Melting Point and Glass Transition Point Using a differential scanning calorimeter ("Pyris 6 DSC" (tradename) commercially available from PerkinElmer Co., Ltd.), the sample was heated to 200° C. and then cooled from 200° C. to 0° C. at a temperature drop rate of 50° C./min, and thereafter heated again at temperature rise rate of 10° C./min to prepare an endothermic characteristic curve thereof. Among the endothermic peaks observed in the characteristic curve, the temperature of the peak having a largest peak area was regarded as an endothermic maximum peak temperature. Also, in the case of a crystalline polyester, the peak temperature was regarded as a melting point thereof. In the case of amorphous polyester, if any endothermic peak was observed in a characteristic curve thereof, the endothermic peak temperature observed was regarded as a glass transition point thereof. Whereas, when a shift of the characteristic curve was observed without any peaks, the temperature at which a tangential line having a maximum inclination of the curve in the portion of the curve shift was intersected with an extension of the baseline on the high-temperature side of the curve shift was read as the glass transition point.

[Glass Transition Point of Resin Particles (B) Containing Amorphous polyester (b)]

The glass transition point of the resin particles (B) was determined by subjecting a dispersion of the resin particles (B) to freeze-drying to remove a solvent therefrom and measuring a glass transition point of the resulting dried solid product by the above-mentioned method.

The freeze-drying of the resin particles (B) was conducted as follows. That is, using a freeze dryer ("FDU-2100" and "DRC-1000" (tradenames) both available from Tokyo Rikakikai Co., Ltd.), 30 g of the dispersion of the resin particles (B) were vacuum-dried at −25° C. for 1 hour, at −10° C. for 10 hours and then at 25° C. for 4 hours until the water content therein reached 1% by weight or less. Also, the water content was measured as follows. That is, using an infrared moisture meter "FD-230" (tradename) available from Kett Electric Laboratory, 5 g of the sample obtained after being dried were subjected to measurement of a water content thereof at a drying temperature of 150° C. under a measuring mode 96 (monitoring time: 2.5 min/variation range: 0.05%).

The glass transition point of the resin particles was measured by the same method as used above for measuring the glass transition point of the polyester.

[Number-Average Molecular Weight of Polyesters]

The number-average molecular weight was calculated from the molecular weight distribution measured by gel permeation chromatography according to the following method.

(1) Preparation of Sample Solution

The polyester was dissolved in chloroform to prepare a solution thereof having a concentration of 0.5 g/100 mL. The resultant solution was then filtered through a fluororesin filter having a pore size of 2 μm ("FP-200" (tradename) commercially available from Sumitomo Electric Industries, Ltd.) to remove insoluble components therefrom, thereby preparing a sample solution.

(2) Measurement of Molecular Weight Distribution

Chloroform as a dissolvent was allowed to flow through a column at a flow rate of 1 mL/min, and the column was stabilized in a thermostat at 40° C. Two hundreds microliters of the sample solution were injected to the column to measure a molecular weight distribution of the sample. The molecular weight of the sample was calculated on the basis of a calibration curve previously prepared. The calibration curve of the molecular weight was prepared by using several kinds of monodisperse polystyrenes (those polystyrenes having molecular weights of $1.11\times10^6$, $3.97\times10^5$, $1.89\times10^5$, $9.89\times10^4$, $1.71\times10^4$, $9.49\times10^3$, $5.87\times10^3$, $1.01\times10^3$, and $5.00\times10^2$ all available from Tosoh Corporation) as standard samples.

Measuring Apparatus: HPLC "LC-9130NEXT" (tradename) commercially available from Japan Analytical Industry Co., Ltd.

Column: "JAIGEL-2.5-H-A"+"JAIGEL-MH-A" (tradenames) both commercially available from Japan Analytical Industry Co., Ltd.

[Volume Median Particle Size ($D_{50}$) and Particle Size Distribution of Resin Particles and Releasing Agent Particles]

(1) Measuring Apparatus: Laser diffraction particle size analyzer ("LA-920" (tradename) commercially available from HORIBA, Ltd.)

(2) Measuring Conditions: Using a cell for the measurement which was filled with distilled water, a volume median particle size ($D_{50}$) of the particles was measured at a temperature at which an absorbance thereof was fallen within an adequate range. Also, the CV value was calculated according to the following formula:

$$\text{CV Value}(\%)=(\text{Standard Deviation of Particle Size Distribution}/\text{Volume Median Particle Size})\times100.$$

[Concentration of Solid Components in Dispersion of Resin Particles]

Using an infrared moisture meter "FD-230", 5 g of a dispersion of resin particles were subjected to measurement of a water content (%) thereof at a drying temperature of 150° C. under a measuring mode 96 (monitoring time: 2.5 min/variation range: 0.05%). The concentration of solid components in the dispersion was calculated according to the following formula:

$$\text{Solid concentration}(\text{wt }\%)=100-M$$

wherein M is a water content (%) which is represented by the formula: $[(W-W_0)/W]\times100$ wherein W is a weight of the sample before measurement (initial weight of the sample); and $W_0$ is a weight of the sample after measurement (absolute dry weight).

[Volume Median Particle Size ($D_{50}$) and Particle Size Distribution of Toner (Particles) and Aggregated Particles]

The volume median particle size of the toner (particles) was measured in the following manner.

Measuring Apparatus: "Coulter Multisizer III" (tradename) commercially available from Beckman Coulter Inc.

Aperture Diameter: 50 μm

Analyzing Software: "Multisizer III Ver. 3.51" (tradename) commercially available from Beckman Coulter Inc.

Electrolyte Solution: "Isotone II" (tradename) commercially available from Beckman Coulter Inc.

Dispersing Solution: A polyoxyethylene lauryl ether "EMALGEN 109P" (tradename) (HLB: 13.6) commercially available from Kao Corporation was dissolved in the above electrolyte solution to prepare a dispersion having a concentration of 5% by weight.

Dispersing Conditions: Ten milligrams of a toner sample to be measured were added to 5 mL of the dispersing solution, and dispersed using an ultrasonic disperser for 1 minute. Thereafter, 25 mL of the electrolyte solution were added to the resulting dispersion, and the obtained mixture was further dispersed using the ultrasonic disperser for 1 minute to prepare a sample dispersion.

Measuring Conditions: The thus-prepared sample dispersion was added to 100 mL of the electrolyte solution, and after controlling a concentration of the resultant dispersion such that the determination for particle sizes of 30,000 particles was completed within 20 seconds, the particle sizes of 30,000 particles were measured under such a concentration condition, and a volume median particle size ($D_{50}$) thereof was determined from the particle size distribution.

Also, the CV value was calculated according to the following formula:

$$\text{CV Value}(\%)=(\text{Standard Deviation of Particle Size Distribution}/\text{Volume Median Particle Size})\times 100.$$

The volume median particle sizes of the aggregated particles or the aggregated particles (2) were measured by the same method as used above for measuring the volume median particle size of the toner (particles) except for using the dispersion of the aggregated particles or the aggregated particles (2) as the sample dispersion.

[Circularity of Core/Shell Particles and Toner]

Preparation of Dispersion: The dispersion of core/shell particles was prepared by diluting the core/shell particles with deionized water such that a solid concentration of the core/shell particles in the obtained dispersion was from 0.001 to 0.05%. Also, the dispersion of a toner was prepared as follows. That is, 50 mg of the toner were added to 5 mL of a 5 wt % polyoxyethylene lauryl ether (EMALGEN 109P) aqueous solution, dispersed using an ultrasonic disperser for 1 minute. Thereafter, 20 mL of distilled water were added to the resulting dispersion, and the obtained mixture was further dispersed using the ultrasonic disperser for 1 minute to prepare the dispersion of the toner.

Measuring Apparatus: Flow-type particle image analyzer "FPIA-3000" (tradename) available from Sysmex Corp.

Measuring Mode: HPF measuring mode

[BET Specific Surface Area of Toner Particles]

The BET specific surface area of the toner particles was measured using "Micromeritics Flow Sorb III" (tradename) available from Shimadzu Corporation, under the following conditions.

Amount of Toner Sample: 0.09 to 0.11 g

Deaeration Conditions: 40° C.; 10 min

Adsorbing Gas: Nitrogen gas

[Evaluation of Low-Temperature Fixing Property of Toner]

A solid image was outputted and printed on a wood-free paper ("J Paper" available from Fuji Xerox Co., Ltd.; size: A4) using a commercially available printer "Microline 5400" (tradename) available from Oki Data Corporation. The solid image thus outputted was an unfixed solid image having a length of 50 mm which was printed on the above A4 paper except for its top margin of the A4 paper extending 5 mm from a top end thereof such that an amount of the toner deposited on the paper was from 0.42 to 0.48 mg/cm$^2$.

Next, the thus obtained unfixed solid image on the paper was fixed by passing the paper through the same printer mounted with a fuser which was modified so as to variably control its fixing temperature. Upon fixing, the temperature of the fuser was adjusted to 100° C., and the fixing speed thereof was adjusted to 1.5 seconds per sheet in a longitudinal direction of the A4 paper, thereby obtaining a printed paper.

In addition, the same fixing procedure was conducted while increasing the fixing temperature at intervals of 5° C., thereby obtaining printed papers.

A mending tape ("Scotch Mending Tape 810" (tradename) available from Sumitomo 3M Limited; width: 18 mm) was cut into a length of 50 mm and lightly attached to a portion of the respective printed papers extending from its top margin above an upper end of the solid image to the solid image-formed portion. Then, a weight of 500 g was rested on the tape and reciprocated by one stroke over the tape at a speed of 10 mm/s while press-contacting with the tape. Thereafter, the attached tape was peeled off from its lower end side at a peel angle of 180° and a peel speed of 10 mm/s, thereby obtaining the printed papers from which the tape had been peeled off. At each time of before attaching the tape to the printed paper and after peeling-off the tape therefrom, each of the printed papers was placed on 30 sheets of a wood-free paper "EXCELLENT WHITE PAPER" (size: A4) available from Oki Data Corporation, to measure a reflection image density of the fixed image portion thereof using a colorimeter "SpectroEye" (tradename) available from GretagMacbeth, under the light irradiating conditions including a standard light source $D_{50}$, an observation visual field of 2°, and a density standard DIN NB based on an absolute white color. The fixing rate of the toner was calculated from the thus measured reflection image densities according to the following formula.

$$\text{Fixing Rate}=(\text{Reflection image density after peeling-off the tape}/\text{Reflection image density before attaching the tape})\times 100$$

The temperature at which the fixing rate first reached 90% or higher was defined as a minimum fixing temperature. The lower the minimum fixing rate, the more excellent the low-temperature fixing property of the toner becomes.

[Evaluation Method of Toner cloud of Toner]

The following procedures all were carried out at room temperature (25° C.) and a relative humidity of 50% RH. At first, 0.7 g of a toner and 9.3 g of a silicone ferrite carrier (available from Kanto Denka Kogyo Co., Ltd.; average particle size: 40 μm) were charged into a 20-mL cylindrical polypropylene bottle available from Nikko Co., Ltd., and stirred by shaking 10 times in each of vertical and horizontal directions. Thereafter, the resulting mixture was stirred by a ball mill for 10 minutes.

A developing roller (diameter: 42 mm) was dismounted from a commercially available printer "Microline 5400" (tradename) available from Oki Data Corporation, and modified so as to rotate at a variable speed. The thus modified developing roller was used as an external developing roller device. The developing roller as the external developing roller device was rotated at 10 revolutions/min, and a developer (mixture of a toner and a silicone ferrite carrier) was attached onto the developing roller. After uniformly attaching the developer over the developing roller, the developing roller was temporarily stopped. Then, the rotating speed of the developing roller was changed to 45 revolutions/min to measure the number of toner particles scattered when rotating the developer roller for 1 minute using a digital dust meter "Model P-5" available from Shibata Science Technology Ltd.

The toner cloud of the toner was evaluated by the number of the toner particles scattered. The smaller the number of particles is, the lower the toner cloud generates.

[Evaluation of Tribocharging Property of Toner]

A 50-cc cylindrical polypropylene bottle available from Nikko Co., Ltd., was charged with 2.1 g of a toner and 27.9 g of a silicone ferrite carrier (available from Kanto Denka Kogyo Co., Ltd.; average particle size: 40 μm) at 25° C. and 50% RH, and the contents of the bottle were shaken 10 times in each of vertical and horizontal directions. Thereafter, the resulting mixture was stirred by a tumbler mixer for 1 hour to measure a charge amount on the toner for the mixing time of 1 hour using a q/m meter available from EPPING. The higher the absolute value of the thus measured charge amount, the more excellent the tribocharging property of the toner becomes.

Meanwhile, a measuring device, measuring conditions set and the like, were as follows.

Measuring Device: q/m meter available from EPPING

Measuring Conditions Set: mesh size: 635 meshes (opening: 24 μm; stainless steel screen); soft blow, blow pressure (600 V)

Suction Time: 90 seconds

Charge Amount (μC/g)=(total electricity (μC) after 90 seconds)/(amount (g) of toner sucked)

[Evaluation of Dot reproducibility in Printed Images]

Using a printer "Microline 5400" (tradename) (resolution: 600×600 dpi) available from Oki Data Corporation, a half tone image of 2 by 2 (2 dots and 2 spaces) was outputted as an unfixed image on a "J Paper" available from Fuji Xerox Co., Ltd., as a printing medium, and dots (5×5) on the outputted unfixed image were observed in an enlarged scale using an optical microscope "VHX-100" available from Keyence Corporation. A portion of the dot images to which the underlying paper was exposed was regarded as a portion where missing dots occurred. The extent of lack of dot images was evaluated by the number of the missing dots according to the following ratings. The smaller number of missing dots indicates a more excellent reproducibility of dots in the printed images.

A: One or less missing dot among 25 dots

B: Not less than 2 and not more than 5 missing dots among 25 dots

C: Six or more missing dots among 25 dots

[Evaluation of Heat-Resistant Storage Property of Toner]

A 100-mL wide-mouthed polymer bottle was charged with 20 g of the toner and hermetically sealed, and allowed to stand at 53° C. for 24 hours. Thereafter, the sealed bottle filled with the toner was further allowed to stand at 25° C. for 12 hours or longer for cooling. Next, a 250 μm-mesh sieve was fitted to a vibrating table of a powder tester (tradename) available from Hosokawa Micron Corporation, and 20 g of the above toner were placed on the sieve and vibrated for 30 seconds to measure a weight of the toner as a residue on the sieve. The smaller the weight value, the more excellent the heat-resistant storage property of the toner becomes.

[Evaluation of Tribocharging Property of Toner Under Normal-Temperature and Normal-Humidity Conditions (Under NN Environmental Conditions)]

A 50-cc cylindrical polypropylene bottle available from Nikko Co., Ltd., was charged with 2.1 g of a toner and 27.9 g of a silicone ferrite carrier (available from Kanto Denka Kogyo Co., Ltd.; average particle size: 40 μm) at 25° C. and 50% RH, and the contents of the bottle were shaken 10 times in each of vertical and horizontal directions. Thereafter, the resulting mixture was stirred by a tumbler mixer at a rate of 90 r/min for 1 hour to measure a charge amount on the toner for the mixing time of 1 hour using a q/m meter available from EPPING. The higher the absolute value of the charge amount, the more excellent the tribocharging property of the toner becomes.

Meanwhile, a measuring device, measuring conditions set and the like, were as follows.

Measuring Device: q/m meter available from EPPING

Measuring Conditions Set: mesh size: 635 meshes (opening: 24 μm; stainless steel screen); soft blow, blow pressure (1,000 V)

Suction Time: 90 seconds

Charge Amount (μC/g)=(total electricity (μC) after 90 seconds)/(amount (g) of toner sucked)

[Evaluation of Tribocharging Property of Toner Under High-Temperature and High-Humidity Conditions (Under HH Environmental Conditions)]

The toner after subjected to the above evaluation for tribocharging property under the normal-temperature and normal-humidity conditions was placed under the conditions of an atmospheric temperature of 30° C. and a relative humidity of 85% (under high-temperature and high-humidity environmental conditions), and allowed to stand under the conditions for 12 hours. Thereafter, the environmental conditions under which the toner was placed was changed from the high-temperature and high-humidity environmental conditions to the conditions of 25° C. and 50% RH, and the toner was stirred by a ball mill for 1 minute under the latter conditions to evaluate a tribocharging property of the toner by the same method as used above under the normal-temperature and normal-humidity conditions. The higher the absolute value of the charge amount, the more excellent the tribocharging property of the toner becomes.

Production of Polyesters

Production Example 1

Production of Crystalline Polyester X1

An inside atmosphere of a four-necked flask equipped with a nitrogen inlet tube, a dehydration tube, a stirrer and a thermocouple was replaced with nitrogen, and 3,936 g of 1,9-nonanediol and 4,848 g of sebacic acid were charged into the flask. The contents of the flask were heated to 140° C. while stirring and held at 140° C. for 3 hours, and then heated from 140° C. to 200° C. over 10 hours. Thereafter, 50 g of tin di(2-ethylhexanoate) were added to the flask, and the contents of the flask were further held at 200° C. for 1 hour, and then the pressure within the flask was reduced and held under 8.3 kPa for 4 hours, thereby obtaining a crystalline polyester X1. The softening point, melting point, crystallinity index, number-average molecular weight and acid value of the thus obtained crystalline polyester X1 are shown in Table 1.

Production Example 2

Production of Crystalline Polyester X2

An inside atmosphere of a four-necked flask equipped with a nitrogen inlet tube, a dehydration tube, a stirrer and a thermocouple was replaced with nitrogen, and 2,419 g of 1,6-hexanediol and 4,957 g of 1,12-dodecanedioic acid were charged into the flask. The contents of the flask were heated to 140° C. while stirring and held at 140° C. for 3 hours, and then heated from 140° C. to 200° C. over 10 hours. Thereafter, 30 g of tin di(2-ethylhexanoate) were added to the flask, and the contents of the flask were further held at 200° C. for 1 hour, and then the pressure within the flask was reduced and held under 8.3 kPa for 3 hours, thereby obtaining a crystalline polyester X2. The softening point, melting point, crystallinity index, number-average molecular weight and acid value of the thus obtained crystalline polyester X2 are shown in Table 1.

Production Example 3

Production of Amorphous Polyester Y1

An inside atmosphere of a four-necked flask equipped with a nitrogen inlet tube, a dehydration tube, a stirrer and a thermocouple was replaced with nitrogen, and 3,322 g of polyoxypropylene (2.2)-2,2-bis(4-hydroxyphenyl)propane, 31 g of polyoxyethylene (2.0)-2,2-bis(4-hydroxyphenyl)propane, 662 g of terephthalic acid and 10 g of dibutyl tin oxide were charged into the flask. The contents of the flask were heated to 230° C. in a nitrogen atmosphere while stirring and held at 230° C. for 5 hours, and then the pressure within the flask was reduced and held under 8.0 kPa for 1 hour. After returning the pressure within the flask to atmospheric pressure, the contents of the flask were cooled to 190° C., and 685 g of fumaric acid and 0.49 g of tert-butyl catechol were added to the flask. The contents of the flask were held at 190° C. for 1 hour, and then heated to 210° C. over 2 hours. Thereafter, the pressure within the flask was reduced and held under 8.0 kPa for 4 hours, thereby obtaining amorphous polyester Y1. The softening point, glass transition point, crystallinity index, number-average molecular weight and acid value of the thus obtained amorphous polyester Y1 are shown in Table 1.

Production Example 4

Production of Amorphous Polyester Y2

An inside atmosphere of a four-necked flask equipped with a nitrogen inlet tube, a dehydration tube, a stirrer and a thermocouple was replaced with nitrogen, and 1,750 g of polyoxypropylene (2.2)-2,2-bis(4-hydroxyphenyl)propane, 1,625 g of polyoxyethylene (2.0)-2,2-bis(4-hydroxyphenyl)propane, 1,145 g of terephthalic acid, 161 g of dodecenylsuccinic anhydride, 480 g of trimellitic anhydride and 10 g of dibutyl tin oxide were charged into the flask. The contents of the flask were heated to 220° C. in a nitrogen atmosphere while stirring and held at 220° C. for 5 hours. Thereafter, after confirming that the softening point of the contents of the flask reached 120° C. according to ASTM D36-86, the contents of the flask were cooled to terminate a reaction thereof, thereby obtaining amorphous polyester Y2. The softening point, glass transition point, crystallinity index, number-average molecular weight and acid value of the thus obtained amorphous polyester Y2 are shown in Table 1.

Production Example 5

Production of Amorphous Polyester Y3

An inside atmosphere of a four-necked flask equipped with a nitrogen inlet tube, a dehydration tube, a stirrer and a thermocouple was replaced with nitrogen, and 3,004 g of polyoxypropylene (2.2)-2,2-bis(4-hydroxyphenyl)propane, 996 g of fumaric acid, 2 g of tert-butyl catechol and 8 g of dibutyl tin oxide were charged into the flask. The contents of the flask were heated to 210° C. over 5 hours in a nitrogen atmosphere while stirring and held at 210° C. for 2 hours. Thereafter, the contents of the flask were reacted under 8.3 kPa until reaching a desired softening point, thereby obtaining amorphous polyester Y3. The softening point, glass transition point, crystallinity index, number-average molecular weight and acid value of the thus obtained amorphous polyester Y3 are shown in Table 1.

TABLE 1

| | | Production Example 1 Crystalline polyester X1 | Production Example 2 Crystalline polyester X2 | Production Example 3 Amorphous polyester Y1 | Production Example 4 Amorphous polyester Y2 | Production Example 5 Amorphous polyester Y3 |
|---|---|---|---|---|---|---|
| Raw monomers | Alcohol component | | | | | |
| | BPA-PO *1 | | | 3322 g (99) | 1750 g (50) | 3004 g (100) |
| | BPA-EO *2 | | | 31 g (1) | 1625 g (50) | |
| | 1,9-Nonanediol | 3936 g (100) | | | | |
| | 1,6-Hexanediol | | 2419 g (100) | | | |
| | Acid component | | | | | |
| | Sebacic acid | 4848 g (100) | | | | |
| | 1,12-Dodecanedioic acid | | 4957 g (105) | | | |
| | Terephthalic acid | | | 662 g (41.6) | 1145 g (69) | |
| | Fumaric acid | | | 685 g (61.6) | | 996 g (100) |
| | Dodecenylsuccinic acid | | | | 161 g (6) | |
| | Trimellitic anhydride | | | | 480 g (25) | |
| Esterification catalyst | Dibutyl tin oxide | | | 10 g | 10 g | 8 g |
| | Tin di(2-ethylhexanoate) | 50 g | 30 g | | | |
| Softening point (° C.) | | 78 | 78 | 107 | 122 | 100 |
| Glass transition point (° C.) | | — | — | 65 | 65 | 59 |
| Melting point (° C.) | | 72 | 74 | — | — | — |
| Acid value (mgKOH/g) | | 19.9 | 24.3 | 24.4 | 21.0 | 19.9 |

TABLE 1-continued

| | Production Example 1 Crystalline polyester X1 | Production Example 2 Crystalline polyester X2 | Production Example 3 Amorphous polyester Y1 | Production Example 4 Amorphous polyester Y2 | Production Example 5 Amorphous polyester Y3 |
|---|---|---|---|---|---|
| Number-average molecular weight | $3.9 \times 10^3$ | $3.2 \times 10^3$ | $2.4 \times 10^3$ | $2.8 \times 10^3$ | $2.5 \times 10^3$ |
| Crystallinity index | 1.1 | 1.1 | 1.5 | 1.6 | 1.5 |

Note

The numeral in each parenthesis represents a molar ratio based on 100 mol % of a total amount of alcohol component.

*1 Polyoxypropylene (2.2)-2,2-bis(4-hydroxyphenyl)propane

*2 Polyoxyethylene (2.0)-2,2-bis(4-hydroxyphenyl)propane

Production of Resin Particles and Releasing Agent Particles

Production Example 6

Preparation of Dispersion of Resin Particles (A-1)

A flask equipped with a stirrer was charged with 90 g of the crystalline polyester X1, 300 g of the amorphous polyester Y1, 210 g of the amorphous polyester Y2, 45 g of a copper phthalocyanine pigment "ECB-301" (tradename) available from Dainichiseika Color & Chemicals Mfg. Co., Ltd., 8.5 g of a polyoxyethylene alkyl ether as a nonionic surfactant "EMALGEN 150" (tradename) available from Kao Corporation, 80 g of a 15 wt % aqueous solution of sodium dodecylbenzenesulfonate as an anionic surfactant "NEOPELEX G-15" (tradename) available from Kao Corporation, and 266 g of a 5 wt % potassium hydroxide aqueous solution, and the contents of the flask were heated to 98° C. while stirring and melted, and further mixed at 98° C. for 2 hours, thereby obtaining a resin mixture.

Then, while stirring, 1,116 g of deionized water were added dropwise into the flask at a rate of 6 g/min to prepare an emulsion. Next, the obtained emulsion was cooled to 25° C. and passed through a wire mesh having a 200 mesh screen (opening: 105 μm) to obtain a dispersion of resin particles (A-1). The solid content of the thus obtained dispersion of resin particles (A-1) and the volume median particle size and CV value of the resin particles (A-1) are shown in Table 2.

Production Example 7

Preparation of Dispersion of Resin Particles (A-2)

A flask equipped with a stirrer was charged with 90 g of the crystalline polyester X2, 300 g of the amorphous polyester Y1, 210 g of the amorphous polyester Y2, 45 g of a copper phthalocyanine pigment "ECB-301" (tradename) available from Dainichiseika Color & Chemicals Mfg. Co., Ltd., 8.5 g of a polyoxyethylene alkyl ether as a nonionic surfactant "EMALGEN 150" (tradename) available from Kao Corporation, 80 g of a 15 wt % aqueous solution of sodium dodecylbenzenesulfonate as an anionic surfactant "NEOPELEX G-15" (tradename) available from Kao Corporation, and 274 g of a 5 wt % potassium hydroxide aqueous solution, and the contents of the flask were heated to 98° C. while stirring and melted, and further mixed at 98° C. for 2 hours, thereby obtaining a resin mixture.

Then, while stirring, 1,109 g of deionized water was added dropwise into the flask at a rate of 6 g/min to prepare an emulsion. Next, the obtained emulsion was cooled to 25° C. and passed through a wire mesh having a 200 mesh screen (opening: 105 μm) to obtain a dispersion of resin particles (A-2). The solid content of the thus obtained dispersion of resin particles (A-2) and the volume median particle size and CV value of the resin particles (A-2) are shown in Table 2.

Production Example 8

Preparation of Dispersion of Resin Particles (B-1)

A flask equipped with a stirrer was charged with 390 g of the amorphous polyester Y1, 210 g of the amorphous polyester Y2, 6 g of a polyoxyethylene alkyl ether as a nonionic surfactant "EMALGEN 430" (tradename) available from Kao Corporation, 40 g of a 15 wt % aqueous solution of sodium dodecylbenzenesulfonate as an anionic surfactant "NEOPELEX G-15" (tradename) available from Kao Corporation, and 268 g of a 5 wt % potassium hydroxide aqueous solution, and the contents of the flask were heated to 95° C. while stirring and melted, and further mixed at 95° C. for 2 hours, thereby obtaining a resin mixture.

Then, while stirring, 1,145 g of deionized water were added dropwise into the flask at a rate of 6 g/min to prepare an emulsion. Next, the obtained emulsion was cooled to 25° C. and passed through a wire mesh having a 200 mesh screen, and further the solid content of the resulting dispersion was adjusted to 23.5% by weight by adding deionized water thereto, thereby obtaining a dispersion of resin particles (B-1). The solid content of the thus obtained dispersion of resin particles (B-1) and the volume median particle size and CV value of the resin particles (B-1) are shown in Table 2.

Production Example 9

Preparation of Dispersion of Resin Particles (B-2)

A flask equipped with a stirrer was charged with 600 g of the amorphous polyester Y3, 6 g of a polyoxyethylene alkyl ether as a nonionic surfactant "EMALGEN 430" (tradename) available from Kao Corporation, 40 g of a 15 wt % aqueous solution of sodium dodecylbenzenesulfonate as an anionic surfactant "NEOPELEX G-15" (tradename) available from Kao Corporation, and 247 g of a 5 wt % potassium hydroxide aqueous solution, and the contents of the flask were heated to 95° C. while stirring and melted, and further mixed at 95° C. for 2 hours, thereby obtaining a resin mixture.

Then, while stirring, 1,165 g of deionized water were added dropwise into the flask at a rate of 6 g/min to prepare an emulsion. Next, the obtained emulsion was cooled to 25° C. and passed through a wire mesh having a 200 mesh screen, and further the solid content of the resulting dispersion was adjusted to 23.5% by weight by adding deionized water thereto, thereby obtaining a dispersion of resin particles (B-2). The solid content of the thus obtained dispersion of resin particles (B-2) and the volume median particle size and CV value of the resin particles (B-2) are shown in Table 2.

TABLE 2

| | Production Example 6 | Production Example 7 | Production Example 8 | Production Example 9 |
|---|---|---|---|---|
| No. of resin particles | A-1 | A-2 | B-1 | B-2 |
| Crystalline polyester | X1 (15) | X2 (15) | — | — |
| Amorphous polyester | Y1 (50)<br>Y2 (35) | Y1 (50)<br>Y2 (35) | Y1 (65)<br>Y2 (35) | Y3 (100)<br>— |
| Volume median particle size of resin particles (μm) | 0.288 | 0.252 | 0.155 | 0.132 |
| CV value (%) | 27 | 26.5 | 25.5 | 24.1 |
| Solid content (wt %) | 32.7 | 31.1 | 23.5 | 23.5 |

Note:
The numeral in each parenthesis represents a weight percent of resins in the resin particles.

Production Example 10

Production of Dispersion of Releasing Agent Particles

A 1-L beaker was charged with 480 g of deionized water, 4.29 g of an aqueous solution of dipotassium alkenyl (mixture of hexadecenyl group and octadecenyl group) succinate "LATEMUL ASK" (tradename) (concentration of effective ingredients: 28% by weight) available from Kao Corporation, and 120 g of a carnauba wax (melting point: 85° C.; acid value: 5 mg KOH/g) available from Kato Yoko Co., Ltd., and the contents of the beaker were stirred. While maintaining the obtained dispersion at a temperature of 90 to 95° C., the dispersion was subjected to dispersing treatment for 30 minutes using an ultrasonic disperser "Ultrasonic Homogenizer 600W" (tradename) available from Nippon Seiki Co., Ltd., and then cooled to 25° C. Then, deionized water was added to the dispersion to adjust a solid content of the dispersion to 20% by weight, thereby obtaining a dispersion of releasing agent particles. The resulting releasing agent particles had a volume median particle size of 0.494 μm and a CV value of 34%.

Production of Surfactants

Production Example 11

Synthesis of Surfactant 1 (Ammonium Polyoxyethylene (8) Isoundecyl Ether Sulfate An autoclave equipped with a stirrer, a temperature controller and an automatic feeder was charged with 1,732 g of isoundecyl alcohol "EXXAL 11" (product name) available from Exxon Mobil Corp., and 5.61 g of KOH, and the contents of the autoclave were dehydrated at 110° C. under 1.3 kPa for 30 minutes. After the dehydration, an inside atmosphere of the autoclave was replaced with nitrogen, and the contents of the autoclave were heated to 155° C., and then 3,524 g of ethylene oxide (EO) were charged thereinto. The contents of the autoclave were subjected to addition reaction at 155° C. for 2 hours. The obtained reaction product was aged for 30 minutes and then cooled to 80° C. to remove unreacted EO under 4.0 kPa. After removing the unreacted EO, 6.0 g of acetic acid were added to the autoclave, and the contents of the autoclave were stirred at 80° C. for 30 minutes and then withdrawn from the autoclave, thereby obtaining an alkoxylate having an average molar number of addition of ethylene oxide of 8 mol.

A reactor equipped with a stirrer, a temperature controller and an automatic feeder was charged with 525.6 g (1 mol) of the thus obtained polyoxyethylene (8) isoundecyl alcohol, followed by subjecting the alcohol to dehydration at 110° C. under 1.3 kPa for 30 minutes. The obtained dehydrated product was cooled to 70 to 80° C., and 97.1 g (1 mol) of sulfamic acid were charged into the reactor. The contents of the reactor were heated to 110° C. and reacted for 3 hours, thereby obtaining ammonium polyoxyethylene (8) isoundecyl ether sulfate (surfactant 1).

Production Example 12

Synthesis of Surfactant 2 (Sodium Polyoxypropylene (0.4) Polyoxyethylene (8) Alkyl Ether Sulfate)

An autoclave equipped with a stirrer, a temperature controller and an automatic feeder was charged with 1,377.8 g of a $C_{12}$ alcohol "KALCOL 2098" (product name) available from Kao Corporation, 536.4 g of a $C_{14}$ alcohol "KALCOL 4098" (product name) available from Kao Corporation, and 2.72 g of KOH, and the contents of the autoclave was dehydrated at 110° C. under 1.3 kPa for 30 minutes. After the dehydration, an inside atmosphere of the autoclave was replaced with nitrogen, and the contents of the autoclave were heated 120° C., and then 230 g of propylene oxide (PO) were charged thereinto. The contents of the autoclave were subjected to addition reaction at 120° C. for 2 hours. The obtained reaction product was aged for 30 minutes and heated to 145° C. at which 3,490 g of ethylene oxide (EO) were charged into the autoclave. The contents of the autoclave were subjected to addition reaction and then aging, and further cooled to 80° C. to remove unreacted EO under 4.0 kPa. After removing the unreacted EO, 2.91 g of acetic acid were added to the autoclave, and the contents of the autoclave were stirred at 80° C. for 30 minutes and then withdrawn from the autoclave, thereby obtaining an alkoxylate having an average molar number of addition of PO of 0.4 mol and an average molar number of addition of EO of 8 mol.

The resulting alkoxylate was subjected to sulfation using $SO_3$ gas in a down-flow thin film-type reactor. The resulting sulfated product was neutralized with a NaOH aqueous solution, thereby obtaining an aqueous solution of sodium polyoxypropylene (0.4) polyoxyethylene (8) alkyl ether sulfate (surfactant 2) (solid content: 23% by weight).

Production Example 13

Synthesis of Surfactant 3 (Ammonium Salt of Polyoxyethylene (13) Distyrenated Phenyl Ether Monosulfate)

An autoclave equipped with a stirrer, a temperature controller and an ethylene oxide feeder was charged with 608 g (2 mol) of distyrenated phenol available from Kawaguchi Chemical Industry Co., Ltd., and 0.56 g (0.01 mol) of potassium hydroxide, and the contents of the autoclave was dehydrated at 110° C. under 1.3 kPa for 30 minutes. After the dehydration, an inside atmosphere of the autoclave was replaced with nitrogen, and the contents of the autoclave were heated to 145° C., and then 1,144 g (26 mol) of ethylene oxide were charged thereinto. The contents of the autoclave were subjected to addition reaction at 145° C. until reaching a constant pressure. The obtained reaction product was aged at 145° C. for 1 hour and then cooled to 80° C. Next, an inorganic alkali adsorbent was charged into the autoclave, and then separated by filtration to remove potassium hydroxide therefrom, thereby obtaining polyoxyethylene (13) distyrenated phenol having an average molar number of addition of ethylene oxide of 13 mol (in which the numeral in the parenthesis indicates an average molar number of addition of ethylene oxide; hereinafter defined in the same way).

A reactor equipped with a stirrer and a temperature controller was charged with 438.0 g (0.5 mol) of the thus obtained polyoxyethylene (13) distyrenated phenol, followed by subjecting the distyrenated phenol to dehydration at 110° C. under 1.3 kPa for 30 minutes. The obtained dehydrated product was cooled to 80° C., and then 46.1 g (0.475 mol) of sulfamic acid were charged into the reactor. The contents of the reactor were heated to 110° C. and reacted for 3 hours, thereby obtaining an ammonium salt of polyoxyethylene (13) distyrenated phenyl ether monosulfate (surfactant 3).

Production Example 14

Synthesis of Surfactant 4 (Ammonium Salt of Polyoxyethylene (20) Distyrenated Phenyl Ether Monosulfate An autoclave equipped with a stirrer, a temperature controller and an ethylene oxide feeder was charged with 608 g (2 mol) of distyrenated phenol available from Kawaguchi Chemical Industry Co., Ltd., and 0.56 g (0.01 mol) of potassium hydroxide, and the contents of the autoclave was dehydrated at 110° C. under 1.3 kPa for 30 minutes. After the dehydration, an inside atmosphere of the autoclave was replaced with nitrogen, and the contents of the autoclave were heated 145° C., and then 1,760 g (40 mol) of ethylene oxide were charged thereinto. The contents of the autoclave were subjected to addition reaction at 145° C. until reaching a constant pressure. The obtained reaction product was aged at 145° C. for 1 hour and then cooled to 80° C. Next, an inorganic alkali adsorbent was charged into the autoclave, and then separated by filtration to remove potassium hydroxide therefrom, thereby obtaining polyoxyethylene (20) distyrenated phenol having an average molar number of addition of ethylene oxide of 20 mol.

A reactor equipped with a stirrer and a temperature controller was charged with 592.0 g (0.5 mol) of the thus obtained polyoxyethylene (20) distyrenated phenol, followed by subjecting the distyrenated phenol to dehydration at 110° C. under 1.3 kPa for 30 minutes. The obtained dehydrated product was cooled to 80° C., and then 46.1 g (0.475 mol) of sulfamic acid were charged into the reactor. The contents of the reactor were heated to 110° C. and reacted for 3 hours, thereby obtaining an ammonium salt of polyoxyethylene (20) distyrenated phenyl ether monosulfate (surfactant 4).

Production Example 15

Synthesis of Surfactant 5 (Ammonium Salt of Polyoxypropylene (3) Polyoxyethylene (10) Distyrenated Phenyl Ether Monosulfate An autoclave equipped with a stirrer, a temperature controller and an ethylene oxide feeder was charged with 608 g (2 mol) of distyrenated phenol available from Kawaguchi Chemical Industry Co., Ltd., and 0.56 g (0.01 mol) of potassium hydroxide, and the contents of the autoclave was dehydrated at 110° C. under 1.3 kPa for 30 minutes. After the dehydration, an inside atmosphere of the autoclave was replaced with nitrogen, and the contents of the autoclave were heated to 120° C., and then 348 g (6 mol) of propylene oxide were charged thereinto. The contents of the autoclave were subjected to addition reaction at 120° C. until reaching a constant pressure. The obtained reaction product was aged at 120° C. for 1 hour and then subjected to dehydration at 110° C. under 1.3 kPa for 30 minutes. After the dehydration, an inside atmosphere of the autoclave was replaced with nitrogen, and the contents of the autoclave were heated 145° C., and then 880 g (20 mol) of ethylene oxide were charged thereinto. The contents of the autoclave were subjected to addition reaction at 145° C. until reaching a constant pressure. The obtained reaction product was aged at 145° C. for 1 hour and then cooled to 80° C. Next, an inorganic alkali adsorbent was charged into the autoclave, and then separated by filtration to remove potassium hydroxide therefrom, thereby obtaining polyoxypropylene (3) polyoxyethylene (10) distyrenated phenol having an average molar number of addition of propylene oxide of 3 mol and an average molar number of addition of ethylene oxide of 10 mol.

A reactor equipped with a stirrer and a temperature controller was charged with 459.0 g (0.5 mol) of the thus obtained polyoxypropylene (3) polyoxyethylene (10) distyrenated phenol, followed by subjecting the distyrenated phenol to dehydration at 110° C. under 1.3 kPa for 30 minutes. The obtained dehydrated product was cooled to 80° C., and then 46.1 g (0.475 mol) of sulfamic acid were charged into the reactor. The contents of the reactor were heated to 110° C. and reacted for 3 hours, thereby obtaining an ammonium salt of polyoxypropylene (3) polyoxyethylene (10) distyrenated phenyl ether monosulfate (surfactant 5).

Production Example 16

Synthesis of Surfactant 6 (Ammonium Salt of Polyoxyethylene (10) Tribenzylated Phenyl Ether Sulfate An autoclave equipped with a stirrer, a temperature controller and an ethylene oxide feeder was charged with 592 g (2 mol) of tribenzylated phenol available from Kawaguchi Chemical Industry Co., Ltd., and 0.56 g (0.01 mol) of potassium hydroxide, and the contents of the autoclave was dehydrated at 110° C. under 1.3 kPa for 30 minutes. After the dehydration, an inside atmosphere of the autoclave was replaced with nitrogen, and the contents of the autoclave were heated 145° C., and then 880 g (20 mol) of ethylene oxide were charged thereinto. The contents of the autoclave were subjected to addition reaction at 145° C. until reaching a constant pressure. The obtained reaction product was aged at 145° C. for 1 hour and then cooled to 80° C. Next, an inorganic alkali adsorbent was charged into the autoclave, and then separated by filtration to remove potassium hydroxide therefrom, thereby obtaining polyoxyethylene (10) tribenzylated phenol having an average molar number of addition of ethylene oxide of 10 mol.

A reactor equipped with a stirrer and a temperature controller was charged with 368.0 g (0.5 mol) of the thus obtained polyoxyethylene (10) tribenzylated phenol, followed by subjecting the tribenzylated phenol to dehydration at 110° C. under 1.3 kPa for 30 minutes. The obtained dehydrated product was cooled to 80° C., and then 46.1 g (0.475 mol) of sulfamic acid were charged into the reactor. The contents of the reactor were heated to 110° C. and reacted for 3 hours, thereby obtaining an ammonium salt of polyoxyethylene (10) tribenzylated phenyl ether sulfate (surfactant 6).

Production Example 17

Synthesis of Surfactant 7 (Ammonium Salt of Polyoxyethylene (7) Distyrenated (Methyl)Phenyl Ether Monosulfate A reactor equipped with a stirrer and a temperature controller was charged with 313.0 g (0.5 mol) of polyoxyethylene (7) distyrenated methyl phenol, followed by subjecting the distyrenated methyl phenol to dehydration at 110° C. under 1.3 kPa for 30 minutes. The obtained dehydrated product was cooled to 80° C., and then 46.1 g (0.475 mol) of sulfamic acid were charged into the reactor. The contents of the reactor were heated to 110° C. and reacted for 3 hours, thereby obtaining an ammonium salt of polyoxyethylene (7) distyrenated methylphenyl ether monosulfate (surfactant 7).

[Production of Toners]

Example 101

Preparation of Toner 101

<Step (1): Preparation of Aggregated Particles (1)>

A 5-L four-necked flask equipped with a dehydration tube, a stirrer and a thermocouple was charged with 250 g of a dispersion of the resin particles (A-1), 67.4 g of deionized water and 42 g of a dispersion of the releasing agent particles, and the contents of the flask were mixed with each other at 25° C. Then, while stirring the resulting mixture, an aqueous solution prepared by dissolving 21 g of ammonium sulfate in 219 g of deionized water was added dropwise to the mixture at 25° C. over 5 minutes. Thereafter, the resulting dispersion was heated to 55° C. and held at 55° C. until a volume median particle size of aggregated particles therein reached 4.3 μm, thereby obtaining aggregated particles (1).

<Step (2): Preparation of Aggregated Particles (2)>

To the dispersion (whole amount) of the aggregated particles (1) obtained in the step (1) were added 41 g of deionized water, and the obtained dispersion of the aggregated particles (1) was cooled to 49° C. Next, while heating the dispersion from 49° C. at a temperature rise rate of 1.6° C./h, 158.5 g of a dispersion of the resin particles (B-1) were added dropwise thereinto at a dropping rate of 0.5 mL/min to obtain a dispersion of aggregated particles (2). The volume median particle size and circularity of the obtained aggregated particles (2) and the pH value of the dispersion are shown in Table 3. The temperature of the dispersion after completion of the dropping was 57° C.

<Step (3): Addition of Surfactant to Dispersion of Aggregated Particles (2) and Adjustment of pH of Dispersion>

To the dispersion (whole amount) of the aggregated particles (2) obtained in the step (2) was added a mixed aqueous solution prepared by mixing 19.9 g of an aqueous solution of sodium polyoxyethylene (18) laurylethersulfate (anionic surfactant; "LATEMUL E-118B" (tradename) available from Kao Corporation; solid content: 26% by weight) and 3,813 g of deionized water. Then, 1.0 N hydrochloric acid was added to the resulting dispersion to adjust a pH value thereof to 5.0 as measured at 25° C.

<Step (4): Fusion of Aggregated Particles (2)>

The dispersion of the aggregated particles (2) whose pH value was adjusted in the step (3) was heated to 60° C. and held at 60° C. for 5 hours to fuse the aggregated particles, thereby obtaining core/shell particles.

<Washing, Drying and Externally Adding Steps>

Next, the resulting dispersion of the core/shell particles was cooled to 25° C., and subjected to suction filtration while being held at 25° C. to separate a solid component therefrom. The thus separated solid component was washed with deionized water and then dried at 33° C., thereby obtaining toner particles. The circularity, BET specific surface area and volume median particle size of the thus obtained toner particles are shown in Table 3. One hundred parts by weight of the toner particles were charged together with 2.5 parts by weight of a hydrophobic silica ("RY50" (tradename) available from Nippon Aerosil Co., Ltd.; average particle size: 0.04 μm) and 1.0 part by weight of a hydrophobic silica ("CAB-O-SIL TS-720" (tradename) available from Cabot Corp.; average particle size: 0.012 μm) into a Henschel mixer, followed by mixing the respective materials while stirring. The resulting mixture was then allowed to pass through a 150 mesh sieve, thereby obtaining a toner 101. Performance characteristics of the thus obtained toner 101 are shown in Table 3.

Example 102

Preparation of Toner 102

<Step (1): Preparation of Aggregated Particles (1)>

A 5-L four-necked flask equipped with a dehydration tube, a stirrer and a thermocouple was charged with 250 g of a dispersion of the resin particles (A-2), 55.9 g of deionized water and 41 g of a dispersion of the releasing agent particles, and the contents of the flask were mixed with each other at 25° C. Then, while stirring the resulting mixture, an aqueous solution prepared by dissolving 20 g of ammonium sulfate in 211 g of deionized water was added dropwise to the mixture at 25° C. over 5 minutes. Thereafter, the resulting dispersion was heated to 55° C. and held at 55° C. until a volume median particle size of aggregated particles therein reached 4.3 μm, thereby obtaining aggregated particles (1).

<Step (2): Preparation of Aggregated Particles (2)>

To the dispersion (whole amount) of the aggregated particles (1) obtained in the step (1) were added 39 g of deionized water, and the obtained dispersion of the aggregated particles (1) was cooled to 49° C. Next, while heating the dispersion from 49° C. at a temperature rise rate of 1.6° C./h, 152.7 g of a dispersion of the resin particles (B-1) were added dropwise thereinto at a dropping rate of 0.5 mL/min to obtain a dispersion of aggregated particles (2). The volume median particle size and circularity of the obtained aggregated particles (2) and the pH value of the dispersion are shown in Table 3. The temperature of the dispersion after completion of the dropping was 57° C.

<Step (3): Addition of Surfactant to Dispersion of Aggregated Particles (2) and Adjustment of pH of Dispersion>

To the dispersion (whole amount) of the aggregated particles (2) obtained in the step (2) was added a mixed aqueous solution prepared by mixing 19.2 g of an aqueous solution of sodium polyoxyethylene (18) laurylethersulfate (anionic surfactant; "LATEMUL E-118B" (tradename) available from Kao Corporation; solid content: 26% by weight) and 3,675 g of deionized water. Then, 1.0 N sulfuric acid was added to the resulting dispersion to adjust a pH value thereof to 5.0 as measured at 25° C.

<Step (4): Fusion of Aggregated Particles (2)>

The dispersion of the aggregated particles (2) whose pH value was adjusted in the step (3) was heated to 60° C. and held at 60° C. for 5 hours to fuse the aggregated particles, thereby obtaining core/shell particles.

<Washing, Drying and Externally Adding Steps>

Next, the resulting dispersion of the core/shell particles was cooled to 25° C., and subjected to suction filtration while being held at 25° C. to separate a solid component therefrom. The thus separated solid component was washed with deionized water and then dried at 33° C., thereby obtaining toner particles. The circularity, BET specific surface area and volume median particle size of the thus obtained toner particles are shown in Table 3. One hundred parts by weight of the toner particles were charged together with 2.5 parts by weight of a hydrophobic silica ("RY50" (tradename) available from Nippon Aerosil Co., Ltd.; average particle size: 0.04 μm) and 1.0 part by weight of a hydrophobic silica ("CAB-O-SIL TS-720" (tradename) available from Cabot Corp.; average particle size: 0.012 μm) into a Henschel mixer, followed by mixing the respective materials while stirring. The resulting mixture was then allowed to pass through a 150 mesh sieve, thereby obtaining a toner 102. Performance characteristics of the thus obtained toner 102 are shown in Table 3.

Example 103

Preparation of Toner 103

The same procedure as in Example 101 was repeated except that in the step (4), the dispersion of the aggregated particles (2) was held at 56° C. for 5 hours, thereby obtaining a toner 103. Properties of the obtained aggregated particles (2) and toner and performance characteristics of the toner are shown in Table 3.

Example 104

Preparation of Toner 104

The same procedure as in Example 101 was repeated except that in the step (4), the dispersion of the aggregated particles (2) was held at 67° C. for 5 hours, thereby obtaining a toner 104. Properties of the obtained aggregated particles (2) and toner and performance characteristics of the toner are shown in Table 3.

Example 105

Preparation of Toner 105

The same procedure as in Example 101 was repeated except that the step (3) was changed as follows, thereby obtaining a toner 105. Properties of the obtained aggregated particles (2) and toner and performance characteristics of the toner are shown in Table 3.

<Step (3): Addition of Surfactant to Dispersion of Aggregated Particles (2) and Adjustment of pH of Dispersion>

To the dispersion (whole amount) of the aggregated particles (2) obtained in the step (2) was added a mixed aqueous solution prepared by mixing 15.7 g of an aqueous solution of sodium polyoxyethylene (47) laurylethersulfate (anionic surfactant; "LATEMUL E-150" (tradename) available from Kao Corporation; solid content: 33% by weight) and 3,813 g of deionized water. Then, 1.0 N hydrochloric acid was added to the resulting dispersion to adjust a pH value thereof to 5.0 as measured at 25° C.

Example 106

Preparation of Toner 106

The same procedure as in Example 101 was repeated except that the step (3) was changed as follows, thereby obtaining a toner 106. Properties of the obtained aggregated particles (2) and toner and performance characteristics of the toner are shown in Table 3.

<Step (3): Addition of Surfactant to Dispersion of Aggregated Particles (2) and Adjustment of pH of Dispersion>

To the dispersion (whole amount) of the aggregated particles (2) obtained in the step (2) was added a mixed aqueous solution prepared by mixing 19.9 g of an aqueous solution of sodium polyoxyethylene (23) oleylethersulfate (anionic surfactant; "LATEMUL WX" (tradename) available from Kao Corporation; solid content: 26% by weight) and 3,813 g of deionized water. Then, 1.0 N hydrochloric acid was added to the resulting dispersion to adjust a pH value thereof to 5.0 as measured at 25° C.

Example 107

Preparation of Toner 107

The same procedure as in Example 101 was repeated except that the step (3) was changed as follows, thereby obtaining a toner 107. Properties of the obtained aggregated particles (2) and toner and performance characteristics of the toner are shown in Table 3.

<Step (3): Addition of Surfactant to Dispersion of Aggregated Particles (2) and Adjustment of pH of Dispersion>

To the dispersion (whole amount) of the aggregated particles (2) obtained in the step (2) was added a mixed aqueous solution prepared by mixing 13.3 g of an aqueous solution of sodium polyoxyethylene (23) oleylethersulfate (anionic surfactant; "LATEMUL WX" (tradename) available from Kao Corporation; solid content: 26% by weight) and 3,813 g of deionized water. Then, 1.0 N hydrochloric acid was added to the resulting dispersion to adjust a pH value thereof to 5.0 as measured at 25° C.

Example 108

Preparation of Toner 108

The same procedure as in Example 101 was repeated except that the step (3) was changed as follows, thereby obtaining a toner 108. Properties of the obtained aggregated particles (2) and toner and performance characteristics of the toner are shown in Table 3.

<Step (3): Addition of Surfactant to Dispersion of Aggregated Particles (2) and Adjustment of pH of Dispersion>

To the dispersion (whole amount) of the aggregated particles (2) obtained in the step (2) was added a mixed aqueous solution prepared by mixing 6.6 g of an aqueous solution of sodium polyoxyethylene (23) oleylethersulfate (anionic surfactant; "LATEMUL WX" (tradename) available from Kao Corporation; solid content: 26% by weight) and 3,813 g of deionized water. Then, 1.0 N hydrochloric acid was added to the resulting dispersion to adjust a pH value thereof to 5.0 as measured at 25° C.

Example 109

Preparation of Toner 109

The same procedure as in Example 101 was repeated except that the step (3) was changed as follows, thereby obtaining a toner 109. Properties of the obtained aggregated particles (2) and toner and performance characteristics of the toner are shown in Table 3.

<Step (3): Addition of Surfactant to Dispersion of Aggregated Particles (2) and Adjustment of pH of Dispersion>

To the dispersion (whole amount) of the aggregated particles (2) obtained in the step (2) was added a mixed aqueous solution prepared by mixing 19.9 g of an aqueous solution of sodium polyoxyethylene (23) oleylethersulfate (anionic surfactant; "LATEMUL WX" (tradename) available from Kao Corporation; solid content: 26% by weight) and 3,813 g of deionized water. Then, 1.0 N hydrochloric acid was added to the resulting dispersion to adjust a pH value thereof to 4.5 as measured at 25° C.

Example 110

Preparation of Toner 110

The same procedure as in Example 101 was repeated except that the step (3) was changed as follows, thereby obtaining a toner 110. Properties of the obtained aggregated particles (2) and toner and performance characteristics of the toner are shown in Table 3.

<Step (3): Addition of Surfactant to Dispersion of Aggregated Particles (2) and Adjustment of pH of Dispersion>

To the dispersion (whole amount) of the aggregated particles (2) obtained in the step (2) was added a mixed aqueous solution prepared by mixing 19.9 g of an aqueous solution of sodium polyoxyethylene (23) oleylethersulfate (anionic surfactant; "LATEMUL WX" (tradename) available from Kao Corporation; solid content: 26% by weight) and 3,813 g of deionized water. Then, 1.0 N hydrochloric acid was added to the resulting dispersion to adjust a pH value thereof to 4.0 as measured at 25° C.

Example 111

Preparation of Toner 111

The same procedure as in Example 101 was repeated except that the step (3) was changed as follows, thereby obtaining a toner 111. Properties of the obtained aggregated particles (2) and toner and performance characteristics of the toner are shown in Table 3.

<Step (3): Addition of Surfactant to Dispersion of Aggregated Particles (2) and Adjustment of pH of Dispersion>

To the dispersion (whole amount) of the aggregated particles (2) obtained in the step (2) was added a mixed aqueous solution prepared by mixing 19.9 g of an aqueous solution of sodium polyoxyethylene (23) oleylethersulfate (anionic surfactant; "LATEMUL WX" (tradename) available from Kao Corporation; solid content: 26% by weight) and 3,813 g of deionized water. Then, 1.0 N hydrochloric acid was added to the resulting dispersion to adjust a pH value thereof to 5.7 as measured at 25° C.

Example 112

Preparation of Toner 112

The same procedure as in Example 101 was repeated except that the step (3) was changed as follows, thereby obtaining a toner 112. Properties of the obtained aggregated particles (2) and toner and performance characteristics of the toner are shown in Table 3.

<Step (3): Addition of Surfactant to Dispersion of Aggregated Particles (2) and Adjustment of pH of Dispersion>

To the dispersion (whole amount) of the aggregated particles (2) obtained in the step (2) was added a mixed aqueous solution prepared by mixing 5.2 g of ammonium polyoxyethylene (8) isoundecylethersulfate (surfactant 1; solid content: 100% by weight) and 3,813 g of deionized water. Then, 1.0 N hydrochloric acid was added to the resulting dispersion to adjust a pH value thereof to 5.0 as measured at 25° C.

Example 113

Preparation of Toner 113

The same procedure as in Example 101 was repeated except that the step (3) was changed as follows, thereby obtaining a toner 113. Properties of the obtained aggregated particles (2) and toner and performance characteristics of the toner are shown in Table 3.

<Step (3): Addition of Surfactant to Dispersion of Aggregated Particles (2) and Adjustment of pH of Dispersion>

To the dispersion (whole amount) of the aggregated particles (2) obtained in the step (2) was added a mixed aqueous solution prepared by mixing 22.5 g of an aqueous solution of sodium polyoxypropylene (0.4) polyoxyethylene (8) ethersulfate (surfactant 2; solid content: 23% by weight) and 3,813 g of deionized water. Then, 1.0 N hydrochloric acid was added to the resulting dispersion to adjust a pH value thereof to 5.0 as measured at 25° C.

Example 114

Preparation of Toner 114

The same procedure as in Example 101 was repeated except that the steps (3) and (4) were changed as follows, thereby obtaining a toner 114.

<Step (3): Addition of Surfactant to Dispersion of Aggregated Particles (2)>

To the dispersion (whole amount) of the aggregated particles (2) obtained in the step (2) was added a mixed aqueous solution prepared by mixing 19.9 g of an aqueous solution of sodium polyoxyethylene (23) oleylethersulfate (anionic surfactant; "LATEMUL WX" (tradename) available from Kao Corporation; solid content: 26% by weight) and 3,813 g of deionized water.

<Step (4): Fusion of Aggregated Particles (2) and Addition of Acid>

The dispersion obtained by mixing the aggregated particles (2) with the surfactant added in the step (3) was heated to 60° C. and held at 60° C. for 1 hour, and then 1.0 N hydrochloric acid was added to the dispersion to adjust a pH value thereof to 4.5 as measured at 25° C. Thereafter, the resulting mixture was held at 60° C. for 3 hours to fuse the aggregated particles, thereby obtaining core/shell particles.

Example 115

Preparation of Toner 115

The same procedure as in Example 101 was repeated except that the resin particles added in the step (2) were replaced with the resin particles (B-2), thereby obtaining a toner 115. Properties of the obtained aggregated particles (2) and toner and performance characteristics of the toner are shown in Table 3.

Comparative Example 101

Preparation of Toner 116

The same procedure as in Example 101 was repeated except that the step (3) was changed as follows, thereby obtaining a toner 116.

<Step (3): Addition of Surfactant to Dispersion of Aggregated Particles (2)>

To the dispersion (whole amount) of the aggregated particles (2) obtained in the step (2) was added a mixed aqueous solution prepared by mixing 18.5 g of an aqueous solution of sodium polyoxyethylene (2) laurylethersulfate (anionic surfactant; "EMAL E-27C" (tradename) available from Kao Corporation; solid content: 27% by weight) and 3,813 g of deionized water.

Comparative Example 102

Preparation of Toner 117

The same procedure as in Example 101 was repeated except that the step (3) was changed as follows, thereby obtaining a toner 117.

<Step (3): Addition of Surfactant to Dispersion of Aggregated Particles (2) and Adjustment of pH of Dispersion>

To the dispersion (whole amount) of the aggregated particles (2) obtained in the step (2) was added a mixed aqueous solution prepared by mixing 18.5 g of an aqueous solution of sodium polyoxyethylene (2) laurylethersulfate (anionic surfactant; "EMAL E-27C" (tradename) available from Kao Corporation; solid content: 27% by weight) and 3,813 g of deionized water. Then, 1.0 N hydrochloric acid was added to the resulting dispersion to adjust a pH value thereof to 5.0 as measured at 25° C.

Comparative Example 103

Preparation of Toner 118

The same procedure as in Example 101 was repeated except that the step (3) was changed as follows, thereby obtaining a toner 118.

<Step (3): Addition of Surfactant to Dispersion of Aggregated Particles (2) and Adjustment of pH of Dispersion>

To the dispersion (whole amount) of the aggregated particles (2) obtained in the step (2) was added a mixed aqueous solution prepared by mixing 5.0 g of sodium laurylethersulfate (anionic surfactant; "EMAL 0" (tradename) available from Kao Corporation; solid content: 100% by weight) and 3,813 g of deionized water. Then, 1.0 N hydrochloric acid was added to the resulting dispersion to adjust a pH value thereof to 5.0 as measured at 25° C.

Comparative Example 104

Preparation of Toner 119

The same procedure as in Example 101 was repeated except that the step (3) was changed as follows, thereby obtaining a toner 119.

<Step (3): Addition of Surfactant to Dispersion of Aggregated Particles (2) and Adjustment of pH of Dispersion>

To the dispersion (whole amount) of the aggregated particles (2) obtained in the step (2) was added a mixed aqueous solution prepared by mixing 31.2 g of an aqueous solution of sodium dodecylbenzenesulfonate (anionic surfactant; "NEOPELEX G-15" (tradename) available from Kao Corporation; solid content: 16% by weight) and 3,813 g of deionized water. Then, 1.0 N hydrochloric acid was added to the resulting dispersion to adjust a pH value thereof to 5.0 as measured at 25° C.

Comparative Example 105

Preparation of Toner 120

The same procedure as in Example 101 was repeated except that the step (3) was changed as follows, thereby obtaining a toner 120.

<Step (3): Addition of Surfactant to Dispersion of Aggregated Particles (2) and Adjustment of pH of Dispersion>

To the dispersion (whole amount) of the aggregated particles (2) obtained in the step (2) was added a mixed aqueous solution prepared by mixing 31.2 g of an aqueous solution of sodium dodecylbenzenesulfonate (anionic surfactant; "NEOPELEX G-15" (tradename) available from Kao Corporation; solid content: 16% by weight) and 3,813 g of deionized water. Then, 1.0 N hydrochloric acid was added to the resulting dispersion to adjust a pH value thereof to 4.5 as measured at 25° C.

Comparative Example 106

Preparation of Toner 121

The same procedure as in Example 101 was repeated except that the step (3) was changed as follows, thereby obtaining a toner 121.

<Step (3): Addition of Surfactant to Dispersion of Aggregated Particles (2) and Adjustment of pH of Dispersion>

To the dispersion (whole amount) of the aggregated particles (2) obtained in the step (2) was added a mixed aqueous solution prepared by mixing 10.0 g of an aqueous solution of sodium alkyldiphenyletherdisulfonate (anionic surfactant; "PELEX SS-H" (tradename) available from Kao Corporation; solid content: 50% by weight) and 3,813 g of deionized water. Then, 1.0 N hydrochloric acid was added to the resulting dispersion to adjust a pH value thereof to 5.0 as measured at 25° C.

Comparative Example 107

Preparation of Toner 122

The same procedure as in Example 101 was repeated except that in the step (3), no hydrochloric acid was added, thereby obtaining a toner 122.

TABLE 3

| | | | Example | | | | | | |
|---|---|---|---|---|---|---|---|---|---|
| | | | 101 | 102 | 103 | 104 | 105 | 106 | 107 |
| No. of toner | | | 101 | 102 | 103 | 104 | 105 | 106 | 107 |
| Dispersion of resin particles (A) | Properties of resins | Melting point of crystalline polyester (a) (° C.) | 72 | 74 | 72 | 72 | 72 | 72 | 72 |
| | | Glass transition temperature of amorphous polyester (c) (° C.) | 65 | 65 | 65 | 65 | 65 | 65 | 65 |
| Dispersion of resin particles (B) | Properties of resins, etc. | Glass transition temperature of amorphous polyester (b) (° C.) | 65 | 65 | 65 | 65 | 65 | 65 | 65 |

TABLE 3-continued

| | | | | | | | | | |
|---|---|---|---|---|---|---|---|---|---|
| | | Glass transition temperature of resin particles (B) (° C.) | 60 | 60 | 60 | 60 | 60 | 60 | 60 |
| Production conditions | Step (2) | Circularity of core/shell aggregated particles | 0.947 | 0.948 | 0.946 | 0.948 | 0.946 | 0.947 | 0.947 |
| | | Volume median particle size ($D_{50}$) of core/shell aggregated particles (μm) | 5.2 | 5.1 | 5.1 | 5.3 | 5.2 | 5.2 | 5.2 |
| | | pH | 6.5 | 6.5 | 6.5 | 6.5 | 6.5 | 6.5 | 6.5 |
| | Step (3) | Surfactant | E-118B | E-118B | E-118B | E-118B | E-150 | WX | WX |
| | | Amount of surfactant added (part) | 4.5 | 4.5 | 4.5 | 4.5 | 4.5 | 4.5 | 3.0 |
| | | pH | 5.0 | 5.0 | 5.0 | 5.0 | 5.0 | 5.0 | 5.0 |
| | Step (4) | Maximum temperature in fusing step (° C.) | 60 | 60 | 56 | 67 | 60 | 60 | 60 |
| | | pH | 5.0 | 5.0 | 5.0 | 5.0 | 5.0 | 5.0 | 5.0 |
| Properties of toner | Circularity | | 0.967 | 0.966 | 0.958 | 0.984 | 0.966 | 0.966 | 0.965 |
| | BET specific surface area ($m^2/g$) | | 2.4 | 2.4 | 3.0 | 1.9 | 2.5 | 2.3 | 2.4 |
| | Volume median particle size ($D_{50}$) (μm) | | 5.0 | 4.8 | 5.0 | 5.0 | 5.0 | 4.9 | 5.0 |
| Evaluation of performance characteristics of toner | Low-temperature fixing property | Minimum fixing temperature (° C.) | 120 | 120 | 120 | 120 | 120 | 120 | 120 |
| | Tribocharging property | Charge amount (μC/g) | −46 | −45 | −45 | −33 | −43 | −45 | −47 |
| | Toner cloud | Number of toner particles scattered | 65 | 71 | 101 | 187 | 85 | 60 | 63 |

Note
E-118B: Aqueous solution of sodium polyoxyethylene (18) laurylethersulfate "LATEMUL E-118B" (tradename) available from Kao Corporation
E-150: Aqueous solution of sodium polyoxyethylene (47) laurylethersulfate "LATEMUL E-150" (tradename) available from Kao Corporation
WX: Aqueous solution of sodium polyoxyethylene (23) oleylethersulfate; "LATEMUL WX" (tradename) available from Kao Corporation
The amount of a surfactant added was based on 100 parts by weight of resins.

| | | | Example | | | | | | | |
|---|---|---|---|---|---|---|---|---|---|---|
| | | | 108 | 109 | 110 | 111 | 112 | 113 | 114 | 115 |
| No. of toner | | | 108 | 109 | 110 | 111 | 112 | 113 | 114 | 115 |
| Dispersion of resin particles (A) | Properties of resins | Melting point of crystalline polyester (a) (° C.) | 72 | 72 | 72 | 72 | 72 | 72 | 72 | 72 |
| | | Glass transition temperature of amorphous polyester (c) (° C.) | 65 | 65 | 65 | 65 | 65 | 65 | 65 | 65 |
| Dispersion of resin particles (B) | Properties of resins, etc. | Glass transition temperature of amorphous polyester (b) (° C.) | 65 | 65 | 65 | 65 | 65 | 65 | 65 | 60 |
| | | Glass transition temperature of resin particles (B) (° C.) | 60 | 60 | 60 | 60 | 60 | 60 | 60 | 56 |
| Production conditions | Step (2) | Circularity of core/shell aggregated particles | 0.947 | 0.946 | 0.946 | 0.947 | 0.947 | 0.947 | 0.947 | 0.945 |
| | | Volume median particle size ($D_{50}$) of core/shell aggregated particles (μm) | 5.2 | 5.2 | 5.2 | 5.2 | 5.1 | 5.1 | 5 | 5.1 |
| | | pH | 6.2 | 6.2 | 6.2 | 6.2 | 6.2 | 6.2 | 6.2 | 6.3 |
| | Step (3) | Surfactant | WX | WX | WX | WX | 1 | 2 | WX | E-118B |
| | | Amount of surfactant added (part) | 1.5 | 4.5 | 4.5 | 4.5 | 4.5 | 4.5 | 4.5 | 4.5 |
| | | pH | 5.0 | 4.5 | 4.0 | 5.7 | 5.0 | 5.0 | 6.5*) | 5.0 |
| | Step (4) | Maximum temperature in fusing step (° C.) | 60 | 60 | 60 | 60 | 60 | 60 | 60 | 60 |
| | | pH | 5.0 | 4.5 | 4.0 | 5.7 | 5.0 | 5.0 | 4.5*) | 5.0 |

TABLE 3-continued

| | | | | | | | | | | |
|---|---|---|---|---|---|---|---|---|---|---|
| Properties of toner | Circularity | | 0.964 | 0.972 | 0.976 | 0.960 | 0.970 | 0.968 | 0.974 | 0.970 |
| | BET specific surface area ($m^2/g$) | | 2.4 | 2.0 | 1.9 | 2.8 | 2.3 | 2.4 | 2.0 | 2.0 |
| | Volume median particle size ($D_{50}$) (μm) | | 5.0 | 5.1 | 5.1 | 5.1 | 4.9 | 4.9 | 5.0 | 4.9 |
| Evaluation of performance characteristics of toner | Low-temperature fixing property | Minimum fixing temperature (° C.) | 120 | 120 | 120 | 120 | 120.0 | 120 | 120 | 120 |
| | Tribocharging property | Charge amount (μC/g) | −48 | −46 | −46 | −40 | −44 | −47 | −42 | −40 |
| | Toner cloud | Number of toner particles scattered | 62 | 57 | 62 | 135 | 79 | 83 | 70 | 101 |

Note
E-118B: Aqueous solution of sodium polyoxyethylene (18) laurylethersulfate "LATEMUL E-118B" (tradename) available from Kao Corporation
WX: Aqueous solution of sodium polyoxyethylene (23) oleylethersulfate; "LATEMUL WX" (tradename) available from Kao Corporation
The amount of a surfactant added was based on 100 parts by weight of resins.
*)In Example 114, pH was adjusted in the step (4).

| | | | Comparative Example | | | | | | |
|---|---|---|---|---|---|---|---|---|---|
| | | | 101 | 102 | 103 | 104 | 105 | 106 | 107 |
| No. of toner | | | 116 | 117 | 118 | 119 | 120 | 121 | 122 |
| Dispersion of resin particles (A) | Properties of resins | Melting point of crystalline polyester (a) (° C.) | 72 | 72 | 72 | 72 | 72 | 72 | 72 |
| | | Glass transition temperature of amorphous polyester (c) (° C.) | 65 | 65 | 65 | 65 | 65 | 65 | 65 |
| Dispersion of resin particles (B) | Properties of resins, etc. | Glass transition temperature of amorphous polyester (b) (° C.) | 65 | 65 | 65 | 65 | 65 | 65 | 65 |
| | | Glass transition temperature of resin particles (B) (° C.) | 60 | 60 | 60 | 60 | 60 | 60 | 60 |
| Production conditions | Step (2) | Circularity of core/shell aggregated particles | 0.947 | 0.947 | 0.947 | 0.947 | 0.947 | 0.947 | 0.947 |
| | | Volume median particle size ($D_{50}$) of core/shell aggregated particles (μm) | 5.2 | 5.2 | 5.2 | 5.2 | 5.2 | 5.2 | 5.2 |
| | | pH | 6.2 | 6.2 | 6.2 | 6.2 | 6.2 | 6.2 | 6.2 |
| | Step (3) | Surfactant | E-27C | E-27C | E-0 | G-15 | G-15 | SS-H | E-118B |
| | | Amount of surfactant added (part) | 4.5 | 4.5 | 4.5 | 4.5 | 4.5 | 4.5 | 4.5 |
| | | pH | 6.5 | 5.0 | 5.0 | 5.0 | 4.5 | 5.0 | 6.5 |
| | Step (4) | Maximum temperature in fusing step (° C.) | 60 | 60 | 60 | 60 | 60 | 60 | 60 |
| | | pH | 6.5 | 5.0 | 5.0 | 5.0 | 4.5 | 5.0 | 6.5 |
| Properties of toner | Circularity | | 0.949 | 0.964 | 0.965 | 0.959 | 0.964 | 0.964 | 0.951 |
| | BET specific surface area ($m^2/g$) | | 16.5 | 2.4 | 2.4 | 2.8 | 2.4 | 2.4 | 15.7 |
| | Volume median particle size ($D_{50}$) (μm) | | 5.2 | 16.8 | 17.8 | 5.8 | 7.9 | 18.7 | 5.2 |
| Evaluation of performance characteristics of toner | Low-temperature fixing property | Minimum fixing temperature (° C.) | ** | ** | ** | 120 | 120 | ** | ** |
| | Tribocharging property | Charge amount (μC/g) | −20 | −15 | −13 | −28 | −27 | −16 | −14 |
| | Toner cloud | Number of toner particles scattered | 453 | 571 | 584 | 195 | 204 | 597 | 607 |

Note
E-27C: Aqueous solution of sodium polyoxyethylene (2) laurylethersulfate "EMAL E-27C" (tradename) available from Kao Corporation
E-0: Aqueous solution of sodium laurylethersulfate "EMAL 0" (tradename) available from Kao Corporation
G-15: Aqueous solution of sodium dodecylbenzenesulfonate "NEOPELEX G-15" (tradename) available from Kao Corporation
SS-H: Aqueous solution of sodium alkyldiphenyletherdisulfonate "PELEX SS-H" (tradename) available from Kao Corporation
The amount of a surfactant added was based on 100 parts by weight of resins.
**: Unprintable and unevaluable From Table 3, it was confirmed that the toners for electrophotography obtained in Examples according to the present invention all were excellent in any of low-temperature fixing property, toner cloud and tribocharging property as compared to those toners obtained in Comparative Examples. Therefore, the toner for electrophotography produced according to the first embodiment of the present invention can satisfy both of a good low-temperature fixing property and a good tribo-charging property, and an amount of the toner scattered can be reduced.

Example 201

Preparation of Toner 201

<Step (1): Preparation of Aggregated Particles (1)>

A 5-L four-necked flask equipped with a dehydration tube, a stirrer and a thermocouple was charged with 250 g of a dispersion of the resin particles (A-1), 67.4 g of deionized water and 42 g of a dispersion of the releasing agent particles, and the contents of the flask were mixed with each other at 25° C. Then, while stirring the resulting mixture, an aqueous solution prepared by dissolving 21 g of ammonium sulfate in 219 g of deionized water was added dropwise to the mixture at 25° C. over 5 minutes. Thereafter, the resulting dispersion was heated to 55° C. and held at 55° C. until a volume median particle size of aggregated particles therein reached 4.3 μm, thereby obtaining aggregated particles (1).

<Step (2): Preparation of Aggregated Particles (2)>

To the dispersion (whole amount) of the aggregated particles (1) obtained in the step (1) were added 41 g of deionized water, and the obtained dispersion of the aggregated particles (1) was cooled to 49° C. Next, while heating the dispersion from 49° C. at a temperature rise rate of 1.6° C./h, 158.5 g of a dispersion of the resin particles (B-1) were added dropwise thereinto at a dropping rate of 0.5 mL/min to obtain a dispersion of aggregated particles (2). The volume median particle size and circularity of the obtained aggregated particles (2) and the pH value of the dispersion are shown in Table 4. The temperature of the dispersion after completion of the dropping was 57° C.

<Step (3): Addition of Surfactant to Dispersion of Aggregated Particles (2) and Adjustment of pH of Dispersion>

To the dispersion (whole amount) of the aggregated particles (2) obtained in the step (2) was added a mixed aqueous solution prepared by mixing 3.5 g of an ammonium salt of polyoxyethylene (13) distyrenated phenylethermonosulfate (surfactant 3) and 3,813 g of deionized water. Then, 2.0 N sulfuric acid was added to the resulting dispersion to adjust a pH value thereof to 3.5 as measured at 25° C.

<Step (4): Fusion of Aggregated Particles (2)>

The dispersion of the aggregated particles (2) whose pH value was adjusted in the step (3) was heated to 60° C. and held at 60° C. for 3 hours to fuse the aggregated particles, thereby obtaining core/shell particles.

<Washing, Drying and Externally Adding Steps>

Next, the resulting dispersion of the core/shell particles was cooled to 25° C., and subjected to suction filtration while being held at 25° C. to separate a solid component therefrom. The thus separated solid component was washed with deionized water and then dried at 33° C., thereby obtaining toner particles. The circularity, BET specific surface area and volume median particle size of the thus obtained toner particles are shown in Table 4. One hundred parts by weight of the toner particles were charged together with 2.5 parts by weight of a hydrophobic silica ("RY50" (tradename) available from Nippon Aerosil Co., Ltd.; average particle size: 0.04 μm) and 1.0 part by weight of a hydrophobic silica ("CAB-O-SIL TS-720" (tradename) available from Cabot Corp.; average particle size: 0.012 μm) into a Henschel mixer, followed by mixing the respective materials while stirring. The resulting mixture was then allowed to pass through a 150 mesh sieve, thereby obtaining a toner 201. The evaluation results of the thus obtained toner are shown in Table 4.

Example 202

Preparation of Toner 202

<Step (1): Preparation of Aggregated Particles (1)>

A 5-L four-necked flask equipped with a dehydration tube, a stirrer and a thermocouple was charged with 250 g of a dispersion of the resin particles (A-2), 55.9 g of deionized water and 41 g of a dispersion of the releasing agent particles, and the contents of the flask were mixed with each other at 25° C. Then, while stirring the resulting mixture, an aqueous solution prepared by dissolving 20 g of ammonium sulfate in 211 g of deionized water was added dropwise to the mixture at 25° C. over 5 minutes. Thereafter, the resulting dispersion was heated to 55° C. and held at 55° C. until a volume median particle size of aggregated particles therein reached 4.3 μm, thereby obtaining aggregated particles (1).

<Step (2): Preparation of Aggregated Particles (2)>

To the dispersion (whole amount) of the aggregated particles (1) obtained in the step (1) were added 39 g of deionized water, and the obtained dispersion of the aggregated particles (1) was cooled to 49° C. Next, while heating the dispersion from 49° C. at a temperature rise rate of 1.6° C./h, 152.7 g of a dispersion of the resin particles (B-1) were added dropwise thereinto at a dropping rate of 0.5 mL/min to obtain a dispersion of aggregated particles (2). The volume median particle size and circularity of the obtained aggregated particles (2) and the pH value of the dispersion are shown in Table 4. The temperature of the dispersion after completion of the dropping was 57° C.

<Step (3): Addition of Surfactant to Dispersion of Aggregated Particles (2) and Adjustment of pH of Dispersion>

To the dispersion (whole amount) of the aggregated particles (2) obtained in the step (2) was added a mixed aqueous solution prepared by mixing 3.5 g of an ammonium salt of polyoxyethylene (13) distyrenated phenylethermonosulfate (surfactant 3) and 3,813 g of deionized water. Then, 1.0 N sulfuric acid was added to the resulting dispersion to adjust a pH value thereof to 3.5 as measured at 25° C.

<Step (4): Fusion of Aggregated Particles (2)>

The dispersion of the aggregated particles (2) whose pH value was adjusted in the step (3) was heated to 60° C. and held at 60° C. for 5 hours to fuse the aggregated particles, thereby obtaining core/shell particles.

<Washing, Drying and Externally Adding Steps>

Next, the resulting dispersion of the core/shell particles was cooled to 25° C., and subjected to suction filtration while being held at 25° C. to separate a solid component therefrom. The thus separated solid component was washed with deionized water and then dried at 33° C., thereby obtaining toner particles. The circularity, BET specific surface area and volume median particle size of the thus obtained toner particles are shown in Table 4. One hundred parts by weight of the toner particles were charged together with 2.5 parts by weight of a hydrophobic silica ("RY50" (tradename) available from Nippon Aerosil Co., Ltd.; average particle size: 0.04 μm) and 1.0 part by weight of a hydrophobic silica ("CAB-O-SIL TS-720" (tradename) available from Cabot Corp.; average particle size: 0.012 μm) into a Henschel mixer, followed by mixing the respective materials while stirring. The resulting mixture was then allowed to pass through a 150 mesh sieve, thereby obtaining a toner 202. The evaluation results of the thus obtained toner are shown in Table 4.

Example 203

Preparation of Toner 203

The same procedure as in Example 201 was repeated except that in the step (4), the dispersion of the aggregated particles (2) was held at 56° C. for 3 hours, thereby obtaining a toner 203. Properties of the obtained aggregated particles (2) and toner and the evaluation results of performance characteristics of the toner are shown in Table 4.

Example 204

Preparation of Toner 204

The same procedure as in Example 201 was repeated except that in the step (4), the dispersion of the aggregated particles (2) was held at 65° C. for 3 hours, thereby obtaining a toner 204. Properties of the obtained aggregated particles (2) and toner and the evaluation results of performance characteristics of the toner are shown in Table 4.

Example 205

Preparation of Toner 205

The same procedure as in Example 201 was repeated except that the step (3) was changed as follows, thereby obtaining a toner 205. Properties of the obtained aggregated particles (2) and toner and the evaluation results of performance characteristics of the toner are shown in Table 4.

<Step (3): Addition of Surfactant to Dispersion of Aggregated Particles (2) and Adjustment of pH of Dispersion>

To the dispersion (whole amount) of the aggregated particles (2) obtained in the step (2) was added a mixed aqueous solution prepared by mixing 3.5 g of an ammonium salt of polyoxyethylene (13) distyrenated phenylethermonosulfate (surfactant 3) and 3,813 g of deionized water. Then, 2.0 N sulfuric acid was added to the resulting dispersion to adjust a pH value thereof to 2.5 as measured at 25° C.

Example 206

Preparation of Toner 206

The same procedure as in Example 201 was repeated except that the step (3) was changed as follows, thereby obtaining a toner 206. Properties of the obtained aggregated particles (2) and toner and the evaluation results of performance characteristics of the toner are shown in Table 4.

<Step (3): Addition of Surfactant to Dispersion of Aggregated Particles (2) and Adjustment of pH of Dispersion>

To the dispersion (whole amount) of the aggregated particles (2) obtained in the step (2) was added a mixed aqueous solution prepared by mixing 3.5 g of an ammonium salt of polyoxyethylene (13) distyrenated phenylethermonosulfate (surfactant 3) and 3,813 g of deionized water. Then, 2.0 N sulfuric acid was added to the resulting dispersion to adjust a pH value thereof to 3.0 as measured at 25° C.

Example 207

Preparation of Toner 207

The same procedure as in Example 201 was repeated except that the step (3) was changed as follows, thereby obtaining a toner 207. Properties of the obtained aggregated particles (2) and toner and the evaluation results of performance characteristics of the toner are shown in Table 4.

<Step (3): Addition of Surfactant to Dispersion of Aggregated Particles (2) and Adjustment of pH of Dispersion>

To the dispersion (whole amount) of the aggregated particles (2) obtained in the step (2) was added a mixed aqueous solution prepared by mixing 3.5 g of an ammonium salt of polyoxyethylene (13) distyrenated phenylethermonosulfate (surfactant 3) and 3,813 g of deionized water. Then, 2.0 N sulfuric acid was added to the resulting dispersion to adjust a pH value thereof to 4.0 as measured at 25° C.

Example 208

Preparation of Toner 208

The same procedure as in Example 201 was repeated except that the step (3) was changed as follows, thereby obtaining a toner 208. Properties of the obtained aggregated particles (2) and toner and the evaluation results of performance characteristics of the toner are shown in Table 4.

<Step (3): Addition of Surfactant to Dispersion of Aggregated Particles (2) and Adjustment of pH of Dispersion>

To the dispersion (whole amount) of the aggregated particles (2) obtained in the step (2) was added a mixed aqueous solution prepared by mixing 3.5 g of an ammonium salt of polyoxyethylene (13) distyrenated phenylethermonosulfate (surfactant 3) and 3,813 g of deionized water. Then, 2.0 N sulfuric acid was added to the resulting dispersion to adjust a pH value thereof to 4.5 as measured at 25° C.

Example 209

Preparation of Toner 209

The same procedure as in Example 201 was repeated except that the steps (3) and (4) were changed as follows, thereby obtaining a toner 209. Properties of the obtained aggregated particles (2) and toner and the evaluation results of performance characteristics of the toner are shown in Table 4.

<Step (3): Addition of Surfactant to Dispersion of Aggregated Particles (2) and Adjustment of pH of Dispersion>

To the dispersion (whole amount) of the aggregated particles (2) obtained in the step (2) was added a mixed aqueous solution prepared by mixing 3.5 g of an ammonium salt of polyoxyethylene (13) distyrenated phenylethermonosulfate (surfactant 3) and 3,813 g of deionized water. Then, 2.0 N sulfuric acid was added to the resulting dispersion to adjust a pH value thereof to 5.5 as measured at 25° C.

<Step (4): Fusion of Aggregated Particles (2)>

The dispersion of the aggregated particles (2) whose pH value was adjusted in the step (3) was heated to 60° C. and held at 60° C. for 7 hours to fuse the aggregated particles, thereby obtaining core/shell particles.

Example 210

Preparation of Toner 210

The same procedure as in Example 201 was repeated except that in the step (3), the ammonium salt of polyoxyethylene (13) distyrenated phenylethermonosulfate (surfactant 3) was used in an amount of 1.72 g, thereby obtaining a toner 210. Properties of the obtained aggregated particles (2) and toner and the evaluation results of performance characteristics of the toner are shown in Table 4.

Example 211

Preparation of Toner 211

The same procedure as in Example 201 was repeated except that in the step (3), the ammonium salt of polyoxyethylene (13) distyrenated phenylethermonosulfate (surfactant 3) was used in an amount of 1.15 g, thereby obtaining a toner 211. Properties of the obtained aggregated particles (2) and toner and the evaluation results of performance characteristics of the toner are shown in Table 4.

Example 212

Preparation of Toner 212

The same procedure as in Example 201 was repeated except that in the step (3), the ammonium salt of polyoxyethylene (13) distyrenated phenylethermonosulfate (surfactant 3) was used in an amount of 5.17 g, thereby obtaining a toner 212. Properties of the obtained aggregated particles (2) and toner and the evaluation results of performance characteristics of the toner are shown in Table 4.

Example 213

Preparation of Toner 213

The same procedure as in Example 201 was repeated except that the ammonium salt of polyoxyethylene (13) distyrenated phenylethermonosulfate (surfactant 3) used in the step (3) was replaced with an ammonium salt of polyoxyethylene (20) distyrenated phenylethermonosulfate (surfactant 4), thereby obtaining a toner 213. Properties of the obtained aggregated particles (2) and toner and the evaluation results of performance characteristics of the toner are shown in Table 4.

Example 214

Preparation of Toner 214

The same procedure as in Example 201 was repeated except that the ammonium salt of polyoxyethylene (13) distyrenated phenylethermonosulfate (surfactant 3) used in the step (3) was replaced with an ammonium salt of polyoxypropylene (3) polyoxyethylene (10) distyrenated phenylethermonosulfate (surfactant 5), thereby obtaining a toner 214. Properties of the obtained aggregated particles (2) and toner and the evaluation results of performance characteristics of the toner are shown in Table 4.

Example 215

Preparation of Toner 215

The same procedure as in Example 201 was repeated except that the ammonium salt of polyoxyethylene (13) distyrenated phenylethermonosulfate (surfactant 3) used in the step (3) was replaced with an ammonium salt of polyoxyethylene (10) tribenzylated phenylethersulfate (surfactant 6), thereby obtaining a toner 215. Properties of the obtained aggregated particles (2) and toner and the evaluation results of performance characteristics of the toner are shown in Table 4.

Example 216

Preparation of Toner 216

The same procedure as in Example 201 was repeated except that the ammonium salt of polyoxyethylene (13) distyrenated phenylethermonosulfate (surfactant 3) used in the step (3) was replaced with an ammonium salt of polyoxyethylene (7) distyrenated methylphenylethermonosulfate (surfactant 7), thereby obtaining a toner 216. Properties of the obtained aggregated particles (2) and toner and the evaluation results of performance characteristics of the toner are shown in Table 4.

Example 217

Preparation of Toner 217

The same procedure as in Example 201 was repeated except that the steps (3) and (4) were changed as follows, thereby obtaining a toner 217. Properties of the obtained aggregated particles (2) and toner and the evaluation results of performance characteristics of the toner are shown in Table 4.

<Step (3): Addition of Surfactant to Dispersion of Aggregated Particles (2)>

To the dispersion (whole amount) of the aggregated particles (2) obtained in the step (2) was added a mixed aqueous solution prepared by mixing 3.5 g of an ammonium salt of polyoxyethylene (13) distyrenated phenylethermonosulfate (surfactant 3) and 3,813 g of deionized water.

<Step (4): Fusion of Aggregated Particles (2) and Addition of Acid>

The dispersion prepared by mixing the aggregated particles (2) and the surfactant added in the step (3) was heated to 60° C. and held at 60° C. for 1 hour. Then, 2.0 N sulfuric acid was added to the resulting dispersion to adjust a pH value thereof to 3.5 as measured at 25° C. Thereafter, the resulting mixture was further held at 60° C. for 2 hours to fuse the aggregated particles, thereby obtaining core/shell particles.

Example 218

Preparation of Toner 218

The same procedure as in Example 201 was repeated except that the steps (3) and (4) were changed as follows, thereby obtaining a toner 218. Properties of the obtained aggregated particles (2) and toner and the evaluation results of performance characteristics of the toner are shown in Table 4.

<Step (3): Addition of Surfactant to Dispersion of Aggregated Particles (2) and Adjustment of pH of Dispersion>

To the dispersion (whole amount) of the aggregated particles (2) obtained in the step (2) was added a mixed aqueous solution prepared by mixing 3.5 g of an ammonium salt of polyoxyethylene (13) distyrenated phenylethermonosulfate (surfactant 3) and 3,813 g of deionized water. Then, 2.0 N sulfuric acid was added to the resulting dispersion to adjust a pH value thereof to 5.0 as measured at 25° C.

<Step (4): Fusion of Aggregated Particles (2) and Addition of Acid>

The dispersion of the aggregated particles (2) whose pH value was adjusted in the step (3) was heated to 60° C. and held at 60° C. for 1 hour. Then, 2.0 N sulfuric acid was added to the resulting dispersion to adjust a pH value thereof to 3.5 as measured at 25° C. Thereafter, the resulting mixture was held at 60° C. for 30 minutes to fuse the aggregated particles, thereby obtaining core/shell particles.

Example 219

Preparation of Toner 219

The same procedure as in Example 201 was repeated except that the step (4) was changed as follows, thereby obtaining a toner 219. Properties of the obtained aggregated particles (2) and toner and the evaluation results of performance characteristics of the toner are shown in Table 4.

<Step (4): Fusion of Aggregated Particles (2)>

The dispersion of the aggregated particles (2) whose pH value was adjusted in the step (3) was heated to 70° C. and held at 70° C. for 1 hour to fuse the aggregated particles, thereby obtaining core/shell particles.

Example 220

Preparation of Toner 220

The same procedure as in Example 201 was repeated except that the resin particles added in the step (2) were replaced with the resin particles (B-2), thereby obtaining a toner 220. Properties of the obtained aggregated particles (2) and toner and the evaluation results of performance characteristics of the toner are shown in Table 4.

Comparative Example 201

Preparation of Toner 221

The same procedure as in Example 201 was repeated except that no sulfuric acid was added in the step (3), thereby obtaining a toner 221. Properties of the obtained aggregated particles (2) and toner and the evaluation results of performance characteristics of the toner are shown in Table 4. Meanwhile, among the performance characteristics of the toner, the low-temperature fixing property and dot reproducibility in printed images were not evaluated because the toner was broken upon the evaluation and therefore no evaluable printed images were obtained.

Comparative Example 202

Preparation of Toner 222

The same procedure as in Example 201 was repeated except that the step (3) was changed as follows, thereby obtaining a toner 222. Properties of the obtained aggregated particles (2) and toner and the evaluation results of performance characteristics of the toner are shown in Table 4. Meanwhile, among the performance characteristics of the toner, the low-temperature fixing property and dot reproducibility in printed images were not evaluated because the obtained printed image had a large amount of white lacking portions (stripe-like white lines owing to unprinted portions) and therefore no evaluable printed images were obtained.

<Step (3): Addition of Surfactant to Dispersion of Aggregated Particles (2) and Adjustment of pH of Dispersion>

To the dispersion (whole amount) of the aggregated particles (2) obtained in the step (2) was added a mixed aqueous solution prepared by mixing 31.2 g of an aqueous solution of sodium dodecylbenzenesulfonate (anionic surfactant; "NEOPELEX G-15" (tradename) available from Kao Corporation; solid content: 16% by weight) and 3,813 g of deionized water. Then, 2.0 N sulfuric acid was added to the resulting dispersion to adjust a pH value thereof to 3.5 as measured at 25° C.

Comparative Example 203

Preparation of Toner 223

The same procedure as in Example 201 was repeated except that the step (3) was changed as follows, thereby obtaining a toner 223. Properties of the obtained aggregated particles (2) and toner and the evaluation results of performance characteristics of the toner are shown in Table 4. Meanwhile, among the performance characteristics of the toner, the low-temperature fixing property and dot reproducibility in printed images were not evaluated because the obtained printed image had a large amount of white lacking portions (stripe-like white lines owing to unprinted portions) and therefore no evaluable printed images were obtained.

<Step (3): Addition of Surfactant to Dispersion of Aggregated Particles (2) and Adjustment of pH of Dispersion>

To the dispersion (whole amount) of the aggregated particles (2) obtained in the step (2) was added a mixed aqueous solution prepared by mixing 10.0 g of an aqueous solution of sodium alkyldiphenyletherdisulfonate (anionic surfactant; "PELEX SS-H" (tradename) available from Kao Corporation; solid content: 50% by weight) and 3,813 g of deionized water. Then, 2.0 N sulfuric acid was added to the resulting dispersion to adjust a pH value thereof to 3.5 as measured at 25° C.

Comparative Example 204

Preparation of Toner 224

The same procedure as in Example 201 was repeated except that the step (3) was changed as follows, thereby obtaining a toner 224. Properties of the obtained aggregated particles (2) and toner and the evaluation results of performance characteristics of the toner are shown in Table 4. Meanwhile, among the performance characteristics of the toner, the low-temperature fixing property and dot reproducibility in printed images were not evaluated because the obtained printed image had a large amount of white lacking portions (stripe-like white lines owing to unprinted portions) and therefore no evaluable printed images were obtained.

<Step (3): Addition of Surfactant to Dispersion of Aggregated Particles (2) and Adjustment of pH of Dispersion>

To the dispersion (whole amount) of the aggregated particles (2) obtained in the step (2) was added a mixed aqueous solution prepared by mixing 18.5 g of an aqueous solution of sodium polyoxyethylene (2) laurylethersulfate (anionic surfactant; "EMAL E-27C" (tradename) available from Kao Corporation; solid content: 27% by weight) and 3,813 g of deionized water. Then, 2.0 N sulfuric acid was added to the resulting dispersion to adjust a pH value thereof to 3.5 as measured at 25° C.

Comparative Example 205

Preparation of Toner 225

The same procedure as in Example 201 was repeated except that the step (3) was changed as follows, thereby obtaining a toner 225. Properties of the obtained aggregated particles (2) and toner and the evaluation results of performance characteristics of the toner are shown in Table 4.

<Step (3): Addition of Surfactant to Dispersion of Aggregated Particles (2) and Adjustment of pH of Dispersion>

To the dispersion (whole amount) of the aggregated particles (2) obtained in the step (2) was added a mixed aqueous solution prepared by mixing 19.9 g of an aqueous solution of sodium polyoxyethylene (18) laurylethersulfate (anionic surfactant; "LATEMUL E-118B" (tradename) available from Kao Corporation; solid content: 26% by weight) and 3,813 g of deionized water. Then, 2.0 N sulfuric acid was added to the resulting dispersion to adjust a pH value thereof to 5.0 as measured at 25° C.

TABLE 4

| | | | Example | | | | | | | | |
|---|---|---|---|---|---|---|---|---|---|---|---|
| | | | 201 | 202 | 203 | 204 | 205 | 206 | 207 | 208 | 209 |
| No. of toner | | | 201 | 202 | 203 | 204 | 205 | 206 | 207 | 208 | 209 |
| Dispersion of resin particles (A) | Properties of resins | Melting point of crystalline polyester (a) (° C.) | 72 | 74 | 72 | 72 | 72 | 72 | 72 | 72 | 72 |
| | | Glass transition temperature of amorphous polyester (c) (° C.) | 65 | 65 | 65 | 65 | 65 | 65 | 65 | 65 | 65 |
| Dispersion of resin particles (B) | Properties of resins, etc. | Glass transition temperature of amorphous polyester (b) (° C.) | 65 | 65 | 65 | 65 | 65 | 65 | 65 | 65 | 65 |
| | | Glass transition temperature of resin particles (B) (° C.) | 60 | 60 | 60 | 60 | 60 | 60 | 60 | 60 | 60 |
| Production conditions | Step (2) | Circularity of core/shell aggregated particles | 0.947 | 0.948 | 0.946 | 0.947 | 0.946 | 0.947 | 0.947 | 0.947 | 0.947 |
| | | Volume median particle size ($D_{50}$) of core/shell aggregated particles (μm) | 5.2 | 5.1 | 5.1 | 5.2 | 5.2 | 5.2 | 5.2 | 5.2 | 5.2 |
| | | pH | 6.2 | 6.2 | 6.2 | 6.2 | 6.2 | 6.2 | 6.2 | 6.2 | 6.2 |
| | Step (3) | Anionic surfactant | 3 | 3 | 3 | 3 | 3 | 3 | 3 | 3 | 3 |
| | | Amount of surfactant added (part) | 3.0 | 3.0 | 3.0 | 3.0 | 3.0 | 3.0 | 3.0 | 3.0 | 3.0 |
| | | pH | 3.5 | 3.5 | 3.5 | 3.5 | 2.5 | 3.0 | 4.0 | 4.5 | 5.5 |
| | Step (4) | Maximum temperature in fusing step (° C.) | 60 | 60 | 57 | 65 | 60 | 60 | 60 | 60 | 60 |
| | | pH after addition of acid | 3.5 | 3.5 | 3.5 | 3.5 | 2.5 | 3.0 | 4.0 | 4.5 | 5.5 |
| Properties of toner | Circularity | | 0.972 | 0.971 | 0.965 | 0.986 | 0.972 | 0.973 | 0.965 | 0.963 | 0.959 |
| | BET specific surface area ($m^2/g$) | | 1.8 | 1.8 | 2.2 | 1.7 | 1.9 | 1.8 | 2.2 | 2.3 | 2.4 |
| | Volume median particle size ($D_{50}$) (μm) | | 4.9 | 4.8 | 4.9 | 4.9 | 5.0 | 4.9 | 5.0 | 5.0 | 5.1 |
| | Particle size distribution CV value (%) | | 18.0 | 18.2 | 18.1 | 18.2 | 18.7 | 17.9 | 17.9 | 18.1 | 17.9 |
| Evaluation of performance characteristics of toner | Low-temperature fixing property | Minimum fixing temperature (° C.) | 120 | 120 | 120 | 120 | 120 | 120 | 120 | 120 | 120 |
| | Dot reproducibility in printed image | Visual observation | A | A | A | A | A | A | A | A | A |
| | Toner cloud | Number of toner particles scattered | 55 | 57 | 70 | 103 | 57 | 54 | 62 | 82 | 112 |

Note
The amount of a surfactant added was based on 100 parts by weight of resins.

| | | | Example | | | | | | | | | | |
|---|---|---|---|---|---|---|---|---|---|---|---|---|---|
| | | | 210 | 211 | 212 | 213 | 214 | 215 | 216 | 217 | 218 | 219 | 220 |
| No. of toner | | | 210 | 211 | 212 | 213 | 214 | 215 | 216 | 217 | 218 | 219 | 220 |
| Dispersion of resin particles (A) | Properties of resins | Melting point of crystalline polyester (a) (° C.) | 72 | 72 | 72 | 72 | 72 | 72 | 72 | 72 | 72 | 72 | 72 |
| | | Glass transition temperature of amorphous polyester (c) (° C.) | 65 | 65 | 65 | 65 | 65 | 65 | 65 | 65 | 65 | 65 | 65 |
| Dispersion of resin particles (B) | Properties of resins, etc. | Glass transition temperature of amorphous polyester (b) (° C.) | 65 | 65 | 65 | 65 | 65 | 65 | 65 | 65 | 65 | 65 | 60 |
| | | Glass transition temperature of resin particles (B) (° C.) | 60 | 60 | 60 | 60 | 60 | 60 | 60 | 60 | 60 | 60 | 56 |

TABLE 4-continued

| | | | | | | | | | | | | | |
|---|---|---|---|---|---|---|---|---|---|---|---|---|---|
| Production conditions | Step (2) | Circularity of core/shell aggregated particles | 0.947 | 0.947 | 0.947 | 0.947 | 0.948 | 0.947 | 0.946 | 0.946 | 0.947 | 0.946 | 0.946 |
| | | Volume median particle size ($D_{50}$) of core/shell aggregated particles (μm) | 5.2 | 5.2 | 5.2 | 5.1 | 5.1 | 5.2 | 5.1 | 5.1 | 5.2 | 5.2 | 5.1 |
| | | pH | 6.2 | 6.2 | 6.2 | 6.2 | 6.2 | 6.2 | 6.2 | 6.2 | 6.2 | 6.2 | 6.2 |
| | Step (3) | Anionic surfactant | 3 | 3 | 3 | 4 | 5 | 6 | 7 | 3 | 3 | 3 | 3 |
| | | Amount of surfactant added (part) | 1.5 | 1.0 | 4.5 | 3.0 | 3.0 | 3.0 | 3.0 | 3.0 | 3.0 | 3.0 | 3.0 |
| | | pH | 3.5 | 3.5 | 3.5 | 3.5 | 3.5 | 3.5 | 3.5 | 6.4*) | 5.0**) | 3.5 | 3.5 |
| | Step (4) | Maximum temperature in fusing step (° C.) | 60 | 60 | 60 | 60 | 60 | 60 | 60 | 60 | 60 | 70 | 60 |
| | | pH (after addition of acid) | 3.5 | 3.5 | 3.5 | 3.5 | 3.5 | 3.5 | 3.5 | 3.5*) | 3.5**) | 3.5 | 3.5 |
| Properties of toner | Circularity | | 0.969 | 0.969 | 0.973 | 0.974 | 0.970 | 0.971 | 0.970 | 0.971 | 0.972 | 0.986 | 0.976 |
| | BET specific surface area ($m^2/g$) | | 1.9 | 1.9 | 1.8 | 1.8 | 1.9 | 1.9 | 1.9 | 1.8 | 1.7 | 1.5 | 1.7 |
| | Volume median particle size ($D_{50}$) (μm) | | 4.9 | 5.1 | 4.9 | 4.8 | 4.8 | 5.0 | 4.8 | 4.8 | 4.9 | 4.8 | 4.7 |
| | Particle size distribution CV value (%) | | 18.2 | 24.7 | 17.3 | 17.6 | 18.0 | 20.1 | 19.8 | 19.8 | 19.1 | 18.7 | 17.6 |
| Evaluation of performance characteristics of toner | Low-temperature fixing property | Minimum fixing temperature (° C.) | 120 | 120 | 120 | 120 | 120 | 120 | 120 | 120 | 120 | 120 | 120 |
| | Dot reproducibility in printed image | Extent of missing dots | A | B | A | A | A | A | A | A | A | B | A |
| | Toner cloud | Number of toner particles scattered | 53 | 98 | 86 | 61 | 65 | 70 | 76 | 86 | 70 | 136 | 64 |

Note
The amount of a surfactant added was based on 100 parts by weight of resins.
*)In Example 217, pH was adjusted in the step (4).
**)In Example 218, pH was adjusted in the steps (3) and (4).

| | | | Comparative Example | | | | |
|---|---|---|---|---|---|---|---|
| | | | 201 | 202 | 203 | 204 | 205 |
| No. of toner | | | 221 | 222 | 223 | 224 | 225 |
| Dispersion of resin particles (A) | Properties of resins | Melting point of crystalline polyester (a) (° C.) | 72 | 72 | 72 | 72 | 72 |
| | | Glass transition temperature of amorphous polyester (c) (° C.) | 65 | 65 | 65 | 65 | 65 |
| Dispersion of resin particles (B) | Properties of resins, etc. | Glass transition temperature of amorphous polyester (b) (° C.) | 65 | 65 | 65 | 65 | 65 |
| | | Glass transition temperature of resin particles (B) (° C.) | 60 | 60 | 60 | 60 | 60 |
| Production conditions | Step (2) | Circularity of core/shell aggregated particles | 0.947 | 0.948 | 0.946 | 0.947 | 0.947 |
| | | Volume median particle size ($D_{50}$) of core/shell aggregated particles (μm) | 5.2 | 5.1 | 5.1 | 5.2 | 5.2 |
| | | pH | 6.2 | 6.2 | 6.2 | 6.2 | 6.2 |
| | Step (3) | Anionic surfactant | 3 | G-15 | SS-H | E-27C | E-118B |
| | | Amount of surfactant added (part) | 3.0 | 4.5 | 4.5 | 4.5 | 4.5 |
| | | pH | 6.5 | 3.5 | 3.5 | 3.5 | 5.0 |
| | Step (4) | Maximum temperature in fusing step (° C.) | 60 | 60 | 60 | 60 | 60 |
| | | pH (after addition of acid) | 6.5 | 3.5 | 3.5 | 3.5 | 5.0 |
| Properties of toner | Circularity | | 0.948 | 0.965 | 0.965 | 0.969 | 0.965 |
| | BET specific surface area ($m^2/g$) | | 17.8 | 2.4 | 2.4 | 2.3 | 2.5 |
| | Volume median particle size ($D_{50}$) (μm) | | 5.1 | 17.8 | 25.7 | 20.7 | 5.0 |

TABLE 4-continued

| | | | | | | | |
|---|---|---|---|---|---|---|---|
| | Particle size distribution CV value (%) | | 18.0 | 56.5 | 75.3 | 60.8 | 30.3 |
| Evaluation of performance characteristics of toner | Low-temperature fixing property | Minimum fixing temperature (° C.) | ** | ** | ** | ** | 120 |
| | Dot reproducibility in printed image | Extent of missing dots | ** | ** | ** | ** | C |
| | | Variation of size of dots | ** | ** | ** | ** | C |
| | Toner cloud | Number of toner particles scattered | 518 | 457 | 674 | 512 | 70 |

Note
The amount of a surfactant added was based on 100 parts by weight of resins.
G-15: Aqueous solution of sodium dodecylbenzenesulfonate "NEOPELEX G-15" (tradename) available from Kao Corporation
SS-H: Aqueous solution of sodium alkyldiphenyletherdisulfonate "PELEX SS-H" (tradename) available from Kao Corporation
E-27C: Aqueous solution of sodium polyoxyethylene (2) laurylethersulfate "EMAL E-27C" (tradename) available from Kao Corporation
E-118B: Aqueous solution of sodium polyoxyethylene (18) laurylethersulfate "LATEMUL E-118B" (tradename) available from Kao Corporation
**: Unprintable and unevaluable From Table 4, it was confirmed that the toners for electrophotography obtained in Examples according to the present invention all were excellent in any of low-temperature fixing property, toner cloud and dot reproducibility in printed images as compared to those toners obtained in Comparative Examples. Therefore, the toner for electrophotography produced according to the second embodiment of the present invention can exhibit a good low-temperature fixing property and hardly suffers from scattering, and is also excellent in dot reproducibility in the obtained printed images.

Example 301

Preparation of Toner 301

<Step (1): Preparation of Aggregated Particles (1)>

A 10-L four-necked flask equipped with a dehydration tube, a stirrer and a thermocouple was charged with 600 g of a dispersion of the resin particles (A-1), 162 g of deionized water and 101 g of a dispersion of the releasing agent particles, and the contents of the flask were mixed with each other at 25° C. Then, while stirring the resulting mixture, an aqueous solution prepared by dissolving 50 g of ammonium sulfate in 525 g of deionized water was added dropwise to the mixture at 25° C. over 5 minutes. Thereafter, the resulting dispersion was heated to 55° C. and held at 55° C. until a volume median particle size of aggregated particles therein reached 4.3 μm, thereby obtaining aggregated particles (1).

<Step (2): Preparation of Aggregated Particles (2)>

To the dispersion (whole amount) of the aggregated particles (1) obtained in the step (1) were added 97 g of deionized water, and the obtained dispersion of the aggregated particles (1) was cooled to 49° C. Next, while heating the dispersion from 49° C. at a temperature rise rate of 1.6° C./h, 380 g of a dispersion of the resin particles (B-1) were added dropwise thereinto at a dropping rate of 1.2 mL/min to obtain a dispersion of aggregated particles (2). The volume median particle size and circularity of the obtained aggregated particles (2) and the pH value of the dispersion are shown in Table 5. The temperature of the dispersion after completion of the dropping was 57° C.

<Step (3): Addition of Surfactant to Dispersion of Aggregated Particles (2) and Adjustment of pH of Dispersion>

To the dispersion (whole amount) of the aggregated particles (2) obtained in the step (2) was added a mixed aqueous solution prepared by mixing 8.3 g of an ammonium salt of polyoxyethylene (13) distyrenated phenylethermonosulfate (surfactant 3) and 8,003 g of deionized water. Then, 2.0 N sulfuric acid was added to the resulting dispersion to adjust a pH value thereof to 3.5 as measured at 25° C.

<Step (4): Fusion of Aggregated Particles (2)>

The dispersion of the aggregated particles (2) whose pH value was adjusted in the step (3) was heated to 60° C. and held at 60° C. for 3 hours to fuse the aggregated particles, thereby obtaining core/shell particles.

<Step (5): Adjustment of pH of Dispersion of Core/Shell Particles>

A 20 wt % potassium hydroxide aqueous solution was added to the dispersion of the core/shell particles obtained in the step (4) to adjust a pH value of the dispersion to 7.0 as measured at 25° C. Thereafter, the dispersion of the core/shell particles was held at 60° C. for 1 hour while stirring, and then cooled to 25° C.

<Step (6): Filtration and Washing of Dispersion of Core/Shell Particles>

The resulting dispersion of the core/shell particles was fed to a filter press "TFP-3 Type" (model name) available from Daiki Ataka Engineering Co., Ltd., under 0.3 MPa, and filtered therein to form a cake layer. Deionized water was passed through the cake layer under 0.5 MPa to wash the cake layer until a conductivity of a filtrate discharged from the filter press reached 0.5 mS/m or less. Thereafter, the cake layer was compressed under 0.7 MPa until any filtrate was no longer discharged. The thus compressed toner cake layer was withdrawn from the filter press and subjected to suction filtration using a Buchner funnel, and then air was flowed therethrough, followed by drying the cake layer, thereby obtaining toner particles. The circularity, BET specific surface area and volume median particle size of the thus obtained toner particles are shown in Table 5.

<Externally Adding Step>

One hundred parts by weight of the toner particles were charged together with 2.5 parts by weight of a hydrophobic silica ("RY50" (tradename) available from Nippon Aerosil Co., Ltd.; average particle size: 0.04 μm) and 1.0 part by weight of a hydrophobic silica ("CAB-O-SIL TS-720" (tradename) available from Cabot Corp.; average particle size: 0.012 μm) into a Henschel mixer, followed by mixing the respective materials while stirring. The resulting mixture was then allowed to pass through a 150 mesh sieve, thereby obtaining a toner 301. The evaluation results of performance characteristics of the thus obtained toner 301 are shown in Table 5.

Example 302

Preparation of Toner 302

The same procedure as in Example 301 was repeated except that the steps (1) to (4) were changed as follows, thereby obtaining a toner 302. Properties of the thus obtained toner and the evaluation results of performance characteristics of the toner are shown in Table 5.

<Step (1): Preparation of Aggregated Particles (1)>

A 10-L four-necked flask equipped with a dehydration tube, a stirrer and a thermocouple was charged with 600 g of a dispersion of the resin particles (A-2), 134 g of deionized water and 97 g of a dispersion of the releasing agent particles, and the contents of the flask were mixed with each other at 25° C. Then, while stirring the resulting mixture, an aqueous solution prepared by dissolving 49 g of ammonium sulfate in 506 g of deionized water was added dropwise to the mixture at 25° C. over 5 minutes. Thereafter, the resulting dispersion was heated to 55° C. and held at 55° C. until a volume median particle size of aggregated particles therein reached 4.3 μm, thereby obtaining aggregated particles (1).

<Step (2): Preparation of Aggregated Particles (2)>

To the dispersion (whole amount) of the aggregated particles (1) obtained in the step (1) were added 94 g of deionized water, and the obtained dispersion of the aggregated particles (1) was cooled to 49° C. Next, while heating the dispersion from 49° C. at a temperature rise rate of 1.6° C./h, 367 g of a dispersion of the resin particles (B-1) were added dropwise thereinto at a dropping rate of 1.2 mL/min to obtain a dispersion of aggregated particles (2). The volume median particle size and circularity of the obtained aggregated particles (2) and the pH value of the dispersion are shown in Table 5. The temperature of the dispersion after completion of the dropping was 57° C.

<Step (3): Addition of Surfactant to Dispersion of Aggregated Particles (2) and Adjustment of pH of Dispersion>

To the dispersion (whole amount) of the aggregated particles (2) obtained in the step (2) was added a mixed aqueous solution prepared by mixing 8.3 g of an ammonium salt of polyoxyethylene (13) distyrenated phenylethermonosulfate (surfactant 3) and 7,713 g of deionized water. Then, 2.0 N sulfuric acid was added to the resulting dispersion to adjust a pH value thereof to 3.5 as measured at 25° C.

<Step (4): Fusion of Aggregated Particles (2)>

The dispersion of the aggregated particles (2) whose pH value was adjusted in the step (3) was heated to 60° C. and held at 60° C. for 3 hours to fuse the aggregated particles, thereby obtaining core/shell particles.

Example 303

Preparation of Toner 303

The same procedure as in Example 301 was repeated except that in the step (5), the dispersion of the core/shell particles was held at 60° C. for 15 minutes while stirring, thereby obtaining a toner 303. Properties of the obtained toner and the evaluation results of performance characteristics of the toner are shown in Table 5.

Example 304

Preparation of Toner 304

The same procedure as in Example 301 was repeated except that the step (5) was changed as follows, thereby obtaining a toner 304. Properties of the obtained toner and the evaluation results of performance characteristics of the toner are shown in Table 5.

<Step (5): Adjustment of pH of Dispersion of Core/Shell Particles>

The dispersion of the core/shell particles obtained in the step (4) was cooled to 55° C., and a 20 wt % potassium hydroxide aqueous solution was added thereto to adjust a pH value of the dispersion to 7.0 as measured at 25° C. Thereafter, the dispersion of the core/shell particles was held at 55° C. for 1 hour while stirring, and then cooled to 25° C.

Example 305

Preparation of Toner 305

The same procedure as in Example 301 was repeated except that the step (5) was changed as follows, thereby obtaining a toner 305. Properties of the obtained toner and the evaluation results of performance characteristics of the toner are shown in Table 5.

<Step (5): Adjustment of pH of Dispersion of Core/Shell Particles>

The dispersion of the core/shell particles obtained in the step (4) was cooled to 40° C., and a 20 wt % potassium hydroxide aqueous solution was added thereto to adjust a pH value of the dispersion to 7.0 as measured at 25° C. Thereafter, the dispersion of the core/shell particles was held at 40° C. for 1 hour while stirring, and then cooled to 25° C.

Example 306

Preparation of Toner 306

The same procedure as in Example 301 was repeated except that the step (5) was changed as follows, thereby obtaining a toner 306. Properties of the obtained toner and the evaluation results of performance characteristics of the toner are shown in Table 5.

<Step (5): Adjustment of pH of Dispersion of Core/Shell Particles>

The dispersion of the core/shell particles obtained in the step (4) was cooled to 25° C., and a 20 wt % potassium hydroxide aqueous solution was added thereto to adjust a pH value of the dispersion to 7.0 as measured at 25° C. Thereafter, the dispersion of the core/shell particles was held at 25° C. for 1 hour while stirring.

Example 307

Preparation of Toner 307

The same procedure as in Example 301 was repeated except that in the step (5), the 20 wt % potassium hydroxide aqueous solution was added to the dispersion of the core/shell particles to adjust a pH value of the dispersion to 6.0 as measured at 25° C., thereby obtaining a toner 307. Properties of the obtained toner and the evaluation results of performance characteristics of the toner are shown in Table 5.

Example 308

Preparation of Toner 308

The same procedure as in Example 301 was repeated except that in the step (5), the 20 wt % potassium hydroxide aqueous solution was added to the dispersion of the core/shell particles to adjust a pH value of the dispersion to 5.5 as measured at 25° C., thereby obtaining a toner 308. Properties of the obtained toner and the evaluation results of performance characteristics of the toner are shown in Table 5.

Example 309

Preparation of Toner 309

The same procedure as in Example 301 was repeated except that in the step (5), the 20 wt % potassium hydroxide aqueous solution was added to the dispersion of the core/shell particles to adjust a pH value of the dispersion to 7.4 as measured at 25° C., thereby obtaining a toner 309. Properties of the obtained toner and the evaluation results of performance characteristics of the toner are shown in Table 5.

Example 310

Preparation of Toner 310

The same procedure as in Example 301 was repeated except that the ammonium salt of polyoxyethylene (13) distyrenated phenylethermonosulfate (surfactant 3) used in the step (3) was replaced with an ammonium salt of polyoxyethylene (20) distyrenated phenylethermonosulfate (surfactant 4), thereby obtaining a toner 310. Properties of the obtained toner and the evaluation results of performance characteristics of the toner are shown in Table 5.

Example 311

Preparation of Toner 311

The same procedure as in Example 301 was repeated except that the ammonium salt of polyoxyethylene (13) distyrenated phenylethermonosulfate (surfactant 3) used in the step (3) was replaced with an ammonium salt of polyoxypropylene (3) polyoxyethylene (10) distyrenated phenylethermonosulfate (surfactant 5), thereby obtaining a toner 311. Properties of the obtained toner and the evaluation results of performance characteristics of the toner are shown in Table 5.

Example 312

Preparation of Toner 312

The same procedure as in Example 301 was repeated except that the ammonium salt of polyoxyethylene (13) distyrenated phenylethermonosulfate (surfactant 3) used in the step (3) was replaced with an ammonium salt of polyoxyethylene (10) tribenzylated phenylethersulfate (surfactant 6), thereby obtaining a toner 312. Properties of the obtained toner and the evaluation results of performance characteristics of the toner are shown in Table 5.

Example 313

Preparation of Toner 313

The same procedure as in Example 301 was repeated except that the ammonium salt of polyoxyethylene (13) distyrenated phenylethermonosulfate (surfactant 3) used in the step (3) was replaced with an ammonium salt of polyoxyethylene (7) distyrenated (methyl)phenylethermonosulfate (surfactant 7), thereby obtaining a toner 313. Properties of the obtained toner and the evaluation results of performance characteristics of the toner are shown in Table 5.

Example 314

Preparation of Toner 314

The same procedure as in Example 301 was repeated except that 2.0 N sulfuric acid was added to the dispersion to adjust a pH value thereof to 2.5 as measured at 25° C., thereby obtaining a toner 314. Properties of the obtained toner and the evaluation results of performance characteristics of the toner are shown in Table 5.

Example 315

Preparation of Toner 315

The same procedure as in Example 301 was repeated except that the step (3) was changed as follows, thereby obtaining a toner 315. Properties of the obtained toner and the evaluation results of performance characteristics of the toner are shown in Table 5.

<Step (3): Addition of Surfactant to Dispersion of Aggregated Particles (2) and Adjustment of pH of Dispersion>

To the dispersion (whole amount) of the aggregated particles (2) obtained in the step (2) was added a mixed aqueous solution prepared by mixing 31.8 g of an aqueous solution of sodium polyoxyethylene (23) oleylethersulfate (anionic surfactant; "LATEMUL WX" (tradename) available from Kao Corporation; solid content: 26% by weight) and 8,003 g of deionized water. Then, 2.0 N sulfuric acid was added to the resulting dispersion to adjust a pH value thereof to 4.5 as measured at 25° C.

Example 316

Preparation of Toner 316

The same procedure as in Example 301 was repeated except that the resin particles added in the step (2) were replaced with the resin particles (B-2), thereby obtaining a toner 316. Properties of the obtained aggregated particles (2) and toner and the evaluation results of performance characteristics of the toner are shown in Table 5.

Example 317

Preparation of Toner 317

The same procedure as in Example 301 was repeated except that the 20 wt % potassium hydroxide aqueous solution used in the step (5) was replaced with triethanol amine, thereby obtaining a toner 317. The evaluation results of performance characteristics of the toner are shown in Table 5.

Example 318

Preparation of Toner 318

The same procedure as in Example 301 was repeated except that the steps (4) and (5) were changed as follows, thereby obtaining a toner 318. The evaluation results of performance characteristics of the toner are shown in Table 5.

<Step (4): Fusion of Aggregated Particles (2)>

The dispersion of the aggregated particles (2) whose pH value was adjusted in the step (3) was heated to 67° C. and held at 67° C. for 3 hours to fuse the aggregated particles, thereby obtaining core/shell particles.

<Step (5): Adjustment of pH of Dispersion of Core/Shell Particles>

The dispersion of the core/shell particles obtained in the step (4) was cooled to 60° C., and a 20 wt % potassium hydroxide aqueous solution was added thereto to adjust a pH value of the dispersion to 7.0 as measured at 25° C. Thereafter, the dispersion of the core/shell particles was held at 60° C. for 1 hour while stirring, and then cooled to 25° C.

Reference Example 301

Preparation of Toner 319

The same procedure as in Example 301 was repeated except that no step (5) was carried out, thereby obtaining a toner 319. Properties of the obtained toner and the evaluation results of performance characteristics of the toner are shown in Table 5.

Reference Example 302

Preparation of Toner 320

The same procedure as in Example 301 was repeated except that in the step (5), the 20 wt % potassium hydroxide aqueous solution was added to the dispersion of the core/shell particles to adjust a pH value of the dispersion to 4.5 as measured at 25° C., thereby obtaining a toner 320. Properties of the obtained toner and the evaluation results of performance characteristics of the toner are shown in Table 5.

Reference Example 303

Preparation of Toner 321

The same procedure as in Example 301 was repeated except that in the step (5), the 20 wt % potassium hydroxide aqueous solution was added to the dispersion of the core/shell particles to adjust a pH value of the dispersion to 8.0 as measured at 25° C., thereby obtaining a toner 321. Properties of the obtained toner and the evaluation results of performance characteristics of the toner are shown in Table 5.

Reference Example 304

Preparation of Toner 322

The same procedure as in Example 301 was repeated except that in the step (5), the 20 wt % potassium hydroxide aqueous solution was added to the dispersion of the core/shell particles to adjust a pH value of the dispersion to 8.5 as measured at 25° C., thereby obtaining a toner 322. Properties of the obtained toner and the evaluation results of performance characteristics of the toner are shown in Table 5.

Reference Example 305

Preparation of Toner 323

The same procedure as in Example 310 was repeated except that no step (5) was carried out, thereby obtaining a toner 323. Properties of the obtained toner and the evaluation results of performance characteristics of the toner are shown in Table 5.

Reference Example 306

Preparation of Toner 324

The same procedure as in Example 311 was repeated except that no step (5) was carried out, thereby obtaining a toner 324. Properties of the obtained toner and the evaluation results of performance characteristics of the toner are shown in Table 5.

Reference Example 307

Preparation of Toner 325

The same procedure as in Example 312 was repeated except that no step (5) was carried out, thereby obtaining a toner 325. Properties of the obtained toner and the evaluation results of performance characteristics of the toner are shown in Table 5.

Reference Example 308

Preparation of Toner 326

The same procedure as in Example 313 was repeated except that no step (5) was carried out, thereby obtaining a toner 326. Properties of the obtained toner and the evaluation results of performance characteristics of the toner are shown in Table 5.

Reference Example 309

Preparation of Toner 327

The same procedure as in Example 315 was repeated except that no step (5) was carried out, thereby obtaining a toner 327. Properties of the obtained toner and the evaluation results of performance characteristics of the toner are shown in Table 5.

Comparative Example 301

Preparation of Toner 328

The same procedure as in Example 301 was repeated except that no acid was added in the step (3), and no step (5) was carried out, thereby obtaining a toner 328. Properties of the obtained toner and the evaluation results of performance characteristics of the toner are shown in Table 5.

TABLE 5

| | | | Example | | | | | | | | |
|---|---|---|---|---|---|---|---|---|---|---|---|
| | | | 301 | 302 | 303 | 304 | 305 | 306 | 307 | 308 | 309 |
| No. of toner | | | 301 | 302 | 303 | 304 | 305 | 306 | 307 | 308 | 309 |
| Dispersion of resin particles (A) | Properties of resins | Melting point of crystalline polyester (a) (° C.) | 72 | 74 | 72 | 72 | 72 | 72 | 72 | 72 | 72 |
| | | Glass transition temperature of amorphous polyester (c) (° C.) | 65 | 65 | 65 | 65 | 65 | 65 | 65 | 65 | 65 |
| Dispersion of resin particles (B) | Properties of resins, etc. | Glass transition temperature of amorphous polyester (b) (° C.) | 65 | 65 | 65 | 65 | 65 | 65 | 65 | 65 | 65 |
| | | Glass transition temperature of resin particles (B) (° C.) | 60 | 60 | 60 | 60 | 60 | 60 | 60 | 60 | 60 |
| Production conditions | Step (X) | Circularity of core/shell aggregated particles | 0.947 | 0.948 | 0.946 | 0.947 | 0.946 | 0.947 | 0.947 | 0.947 | 0.947 |
| | | Volume median particle size ($D_{50}$) of core/shell aggregated particles (μm) | 5.2 | 5.1 | 5.1 | 5.2 | 5.1 | 5.1 | 5.1 | 5.1 | 5.1 |
| | | pH of core/shell aggregated particles (before addition of acid) | 6.2 | 6.2 | 6.2 | 6.2 | 6.2 | 6.2 | 6.2 | 6.2 | 6.2 |
| | | Surfactant | 3 | 3 | 3 | 3 | 3 | 3 | 3 | 3 | 3 |
| | | Amount of surfactant added (part) | 3.0 | 3.0 | 3.0 | 3.0 | 3.0 | 3.0 | 3.0 | 3.0 | 3.0 |
| | | pH after addition of acid | 3.5 | 3.5 | 3.5 | 3.5 | 3.5 | 3.5 | 3.5 | 3.5 | 3.5 |
| | | Fusing temperature (° C.) | 60 | 60 | 60 | 60 | 60 | 60 | 60 | 60 | 60 |
| | Step (5) | pH | 7.0 | 7.0 | 7.0 | 7.0 | 7.0 | 7.0 | 6.0 | 5.5 | 7.4 |
| | | Holding temperature (° C.) | 60 | 60 | 60 | 55 | 40 | 25 | 60 | 60 | 60 |
| | | Stirring (holding) time (h) | 1.0 | 1.0 | 0.25 | 1.0 | 1.0 | 1.0 | 1.0 | 1.0 | 1.0 |
| Properties of toner | Circularity | | 0.971 | 0.971 | 0.971 | 0.970 | 0.972 | 0.970 | 0.971 | 0.970 | 0.970 |
| | BET specific surface area ($m^2/g$) | | 1.8 | 1.9 | 1.8 | 1.8 | 1.7 | 1.7 | 1.7 | 1.7 | 1.9 |
| | Volume median particle size ($D_{50}$) (μm) | | 4.9 | 4.8 | 4.9 | 4.9 | 4.9 | 4.9 | 4.9 | 4.9 | 4.9 |
| | Particle size distribution CV value (%) | | 18 | 18 | 18 | 18 | 18 | 18 | 18 | 18 | 18 |
| Evaluation of performance characteristics of toner | Low-temperature fixing property | Minimum fixing temperature (° C.) | 120 | 120 | 120 | 120 | 120 | 120 | 120 | 120 | 120 |
| | Heat-resistant storage property | Weight of toner after allowed to stand at 53° C. for 24 hours (g) | 0.1 | 0.1 | 0.2 | 0.4 | 1.1 | 3.9 | 0.2 | 2.5 | 0.7 |
| | Toner cloud | Number of toner particles scattered | 51 | 54 | 54 | 52 | 54 | 55 | 55 | 65 | 94 |
| | Tribocharging property | Under NN environmental conditions (μC/g) | −47 | −44 | −44 | −47 | −46 | −45 | −45 | −44 | −43 |
| | | Under HH environmental conditions (μC/g) | −38 | −37 | −36 | −37 | −35 | −34 | −38 | −36 | −27 |

Note
The amount of a surfactant added was based on 100 parts by weight of resins.

TABLE 5-continued

| | | | Example | | | | | | | | |
|---|---|---|---|---|---|---|---|---|---|---|---|
| | | | 310 | 311 | 312 | 313 | 314 | 315 | 316 | 317 | 318 |
| No. of toner | | | 310 | 311 | 312 | 313 | 314 | 315 | 316 | 317 | 318 |
| Dispersion of resin particles (A) | Properties of resins | Melting point of crystalline polyester (a) (° C.) | 72 | 72 | 72 | 72 | 72 | 72 | 72 | 72 | 72 |
| | | Glass transition temperature of amorphous polyester (c) (° C.) | 65 | 65 | 65 | 65 | 65 | 65 | 65 | 65 | 65 |
| Dispersion of resin particles (B) | Properties of resins, etc. | Glass transition temperature of amorphous polyester (b) (° C.) | 65 | 65 | 65 | 65 | 65 | 65 | 59 | 65 | 65 |
| | | Glass transition temperature of resin articles (B) (° C.) | 60 | 60 | 60 | 60 | 60 | 60 | 56 | 60 | 60 |
| Production conditions | Step (X) | Circularity of core/shell aggregated particles | 0.947 | 0.948 | 0.948 | 0.948 | 0.947 | 0.947 | 0.946 | 0.947 | 0.947 |
| | | Volume median particle size ($D_{50}$) of core/shell aggregated articles | 5.1 | 5.1 | 5.1 | 5.1 | 5.1 | 5.1 | 5.1 | 5.2 | 5.2 |
| | | pH of core/shell aggregated particles (before addition of acid) | 6.2 | 6.2 | 6.2 | 6.2 | 6.2 | 6.2 | 6.2 | 6.2 | 6.2 |
| | | Surfactant | 4 | 5 | 6 | 7 | 3 | WX | 3 | 3 | 3 |
| | | Amount of surfactant added (part) | 3.0 | 3.0 | 3.0 | 3.0 | 3.0 | 3.0 | 3.0 | 3.0 | 3.0 |
| | | pH after addition of acid | 3.5 | 3.5 | 3.5 | 3.5 | 2.5 | 4.5 | 3.5 | 3.5 | 3.5 |
| | | Fusing temperature (° C.) | 60 | 60 | 60 | 60 | 60 | 60 | 60 | 60 | 67 |
| | Step (5) | pH | 7.0 | 7.0 | 7.0 | 7.0 | 7.0 | 7.0 | 7.0 | 7.0(*) | 7.0 |
| | | Holding temperature (° C.) | 60 | 60 | 60 | 60 | 60 | 60 | 60 | 60 | 60 |
| | | Stirring holding time | 1.0 | 1.0 | 1.0 | 1.0 | 1.0 | 1.0 | 1.0 | 1.0 | 1.0 |
| Properties of toner | Circularity | | 0.974 | 0.971 | 0.971 | 0.970 | 0.972 | 0.970 | 0.976 | 0.971 | 0.978 |
| | BET specific surface area ($m^2/g$) | | 1.9 | 1.9 | 1.9 | 1.9 | 1.9 | 2.0 | 1.7 | 1.9 | 1.6 |
| | Volume median particle size ($D_{50}$) (μm) | | 4.8 | 4.8 | 4.9 | 4.8 | 5.0 | 5.0 | 4.7 | 4.9 | 4.8 |
| | Particle size distribution CV value (%) | | 17.6 | 18.0 | 20.1 | 19.8 | 18.7 | 22.7 | 17.6 | 18.1 | 18.0 |
| Evaluation of performance characteristics of toner | Low-temperature fixing property | Minimum fixing temperature (° C.) | 120 | 120 | 120 | 120 | 120 | 120 | 120 | 120 | 120 |
| | Heat-resistant storage property | Weight of toner after allowed to stand at 53° C. for 24 hours (g) | 0.1 | 0.1 | 0.1 | 0.1 | 0.1 | 2.7 | 3.3 | 1.9 | 2.7 |
| | Toner cloud | Number of toner particles scattered | 60 | 65 | 70 | 76 | 55 | 56 | 63 | 53 | 71 |
| | Tribocharging property | Under NN environmental conditions (μC/g) | −46 | −45 | −46 | −45 | −47 | −47 | −39 | −45 | −44 |
| | | Under HH environmental conditions (μC/g) | −37 | −36 | −35 | −36 | −38 | −33 | −31 | −34 | −30 |

Note
The amount of a surfactant added was based on 100 parts by weight of resins.
WX: Aqueous solution of sodium polyoxyethylene (23) oleylethersulfate; anionic surfactant; "LATEMUL WX" (tradename) available from Kao Corp.
*: In Example 317, pH was adjusted by adding triethanol amine in the step (5).

TABLE 5-continued

| | | | Reference Example | | | | | | | | |
|---|---|---|---|---|---|---|---|---|---|---|---|
| | | | 301 | 302 | 303 | 304 | 305 | 306 | 307 | 308 | 309 |
| No. of toner | | | 319 | 320 | 321 | 322 | 323 | 324 | 325 | 326 | 327 |
| Dispersion of resin particles (A) | Properties of resins | Melting point of crystalline polyester (a) (° C.) | 72 | 72 | 72 | 72 | 72 | 72 | 72 | 72 | 72 |
| | | Glass transition temperature of amorphous polyester (c) (° C.) | 65 | 65 | 65 | 65 | 65 | 65 | 65 | 65 | 65 |
| Dispersion of resin particles (B) | Properties of resins, etc. | Glass transition temperature of amorphous polyester (b) (° C.) | 65 | 65 | 65 | 65 | 65 | 65 | 65 | 65 | 65 |
| | | Glass transition temperature of resin particles (B) (° C.) | 60 | 60 | 60 | 60 | 60 | 60 | 60 | 60 | 60 |
| Production conditions | Step (X) | Circularity of core/shell aggregated particles | 0.947 | 0.947 | 0.947 | 0.947 | 0.947 | 0.948 | 0.948 | 0.948 | 0.947 |
| | | Volume median particle size ($D_{50}$) of core/shell aggregated particles (μm) | 5.2 | 5.2 | 5.2 | 5.1 | 5.1 | 5.1 | 5.1 | 5.1 | 5.1 |
| | | pH of core/shell aggregated particles (before addition of acid) | 6.2 | 6.2 | 6.2 | 6.2 | 6.2 | 6.2 | 6.2 | 6.2 | 6.2 |
| | | Surfactant | 3 | 3 | 3 | 3 | 4 | 5 | 6 | 7 | WX |
| | | Amount of surfactant added (part) | 3.0 | 3.0 | 3.0 | 3.0 | 3.0 | 3.0 | 3.0 | 3.0 | 3.0 |
| | | pH after addition of acid | 3.5 | 3.5 | 3.5 | 3.5 | 3.5 | 3.5 | 3.5 | 3.5 | 4.5 |
| | | Fusing temperature (° C.) | 60 | 60 | 60 | 60 | 60 | 60 | 60 | 60 | 60 |
| | Step (5) | pH | — | 4.5 | 8.0 | 8.5 | — | — | — | — | — |
| | | Temperature (° C.) | — | 60 | 60 | 60 | — | — | — | — | — |
| | | Stirring (holding) time | — | 1.0 | 1.0 | 1.0 | — | — | — | — | — |
| Properties of toner | Circularity | | 0.972 | 0.972 | 0.970 | 0.971 | 0.974 | 0.970 | 0.971 | 0.970 | 0.970 |
| | BET specific surface area ($m^2$/g) | | 1.8 | 1.8 | 2.0 | 2.1 | 1.8 | 1.9 | 1.9 | 1.9 | 2.0 |
| | Volume median particle size ($D_{50}$) (μm) | | 4.9 | 4.9 | 4.9 | 4.9 | 4.8 | 4.8 | 5.0 | 4.8 | 5.0 |
| | Particle size distribution CV value % | | 18 | 18 | 18 | 18 | 17.6 | 18.0 | 20.1 | 19.7 | 22.9 |
| Evaluation of performance characteristics of toner | Low-temperature fixing property | Minimum fixing temperature (° C.) | 120 | 120 | 120 | 120 | 120 | 120 | 120 | 120 | 120 |
| | Heat-resistant storage property | Weight of toner after allowed to stand at 53° C. for 24 hours (g) | 15 | 12 | 11 | 16 | 11 | 13 | 12 | 14 | 10 |
| | Toner cloud | Number of toner particles scattered | 55 | 56 | 187 | 207 | 61 | 65 | 70 | 76 | 55 |
| | Tribocharging property | Under NN environmental conditions (μC/g) | −47 | −46 | −41 | −40 | −46 | −45 | −46 | −45 | −46 |
| | | Under HH environmental conditions (μC/g) | −13 | −16 | −15 | −9 | −12 | −17 | −13 | −14 | −16 |

Note
The amount of a surfactant added was based on 100 parts by weight of resins.
WX: Aqueous solution of sodium polyoxyethylene (23) oleylethersulfate; anionic surfactant; "LATEMUL WX" (tradename) available from Kao Corporation TABLE 5-continued

| | | | Comparative Example 301 |
|---|---|---|---|
| No. of toner | | | 328 |
| Dispersion of resin particles (A) | Properties of resins | Melting point of crystalline polyester (a) (° C.) | 72 |
| | | Glass transition temperature of amorphous polyester (c) (° C.) | 65 |
| Dispersion of resin particles (B) | Properties of resins, etc. | Glass transition temperature of amorphous polyester (b) (° C.) | 65 |
| | | Glass transition temperature of resin particles (B) (° C.) | 60 |
| Production conditions | Step (X) | Circularity of core/shell aggregated particles | 0.947 |
| | | Volume median particle size ($D_{50}$) of core/shell aggregated particles (μm) | 5.1 |
| | | pH of core/shell aggregated particles (before addition of acid) | 6.2 |
| | | Surfactant | 3 |
| | | Amount of surfactant added (part) | 3.0 |
| | | pH after addition of acid | 6.5***) |
| | | Fusing temperature (° C.) | 60 |
| | Step (5) | pH | — |
| | | Temperature (° C.) | — |
| | | Stirring (holding) time (h) | — |
| Properties of toner | Circularity | | 0.951 |
| | BET specific surface area ($m^2/g$) | | 17.8 |
| | Volume median particle size ($D_{50}$) (μm) | | 5.1 |
| | Particle size distribution CV value (%) | | 18.0 |
| Evaluation of performance characteristics of toner | Low-temperature fixing property | Minimum fixing temperature (° C.) | ** |
| | Heat-resistant storage property | Weight of toner after allowed to stand at 53° C. for 24 hours (g) | 18 |
| | Toner cloud | Number of toner particles scattered | 518 |
| | Tribocharging property | Under NN environmental conditions (μC/g) | −34 |
| | | Under HH environmental conditions (μC/g) | −17 |

Note
The amount of a surfactant added was based on 100 parts by weight of resins.
***)No acid added.
**: Unprintable and unevaluable Reference Examples 301 to 309 are capable of satisfying requirements of the first or second embodiment of the present invention, but incapable of satisfying requirements of the third embodiment of the present invention. From Table 5, it was confirmed that the toners for electrophotography obtained in Examples according to the present invention all were excellent in any of low-temperature fixing property, tribocharging property under high-temperature and high-humidity conditions and heat-resistant storage property as compared to those toners obtained in Reference Examples and Comparative Example. Therefore, the toner for electrophotography produced according to the third embodiment of the present invention can exhibit both of a good low-temperature fixing property and a good tribocharging property under high-temperature and high-humidity conditions, and is also excellent in heat-resistant storage property.

INDUSTRIAL APPLICABILITY

The toner for electrophotography produced according to the production process of the present invention exhibits both of a good low-temperature fixing property and a good tribocharging property, and hardly suffers from scattering. In addition, the toner of the present invention exhibits a good low-temperature fixing property, hardly suffers from scattering, and is excellent in dot reproducibility in the obtained printed images. Further, the toner of the present invention exhibits both of a good low-temperature fixing property and a good tribocharging property under high-temperature and high-humidity conditions, and is also excellent in heat-resistant storage property. Therefore, the toner for electrophotography produced according to the production process of the present invention can be suitably used as a toner for electrophotography which is employed in electrophotographic method, electrostatic recording method, electrostatic printing method, and the like. According to the process of the present invention, it is possible to produce the toner having the above properties in an efficient manner.

The invention claimed is:

1. A process for producing a toner for electrophotography, comprising fusing aggregated particles comprising resin particles (A) and releasing agent particles in an aqueous mixed solution comprising the aggregated particles and an anionic surfactant having a polyalkylene glycol moiety with an average molar number of addition of an alkylene oxide having 2 to 3 carbon atoms of from 5 to 100, after, while, or during and after adjusting a pH value of the aqueous mixed solution to 2.0 to 6.0 as measured at 25° C.

2. The process for producing a toner for electrophotography according to claim 1, wherein the anionic surfactant is represented by formula (1):

(1)

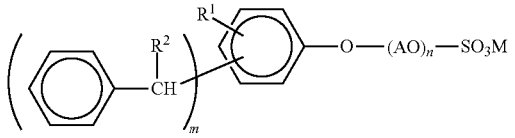

wherein $R^1$ is a hydrogen atom or an alkyl group having 1 to 12 carbon atoms; $R^2$ is a hydrogen atom or a methyl group; m is a number of 1 to 4 on average; AO is an ethyleneoxy group, a propyleneoxy group, or both; n is a number of 5 to 100 on average; and M is ammonium, tetraalkyl ammonium or an alkali metal.

3. The process for producing a toner for electrophotography according to claim 1, further comprising producing aggregated particles (ii) by:

(1) mixing and aggregating the resins particles (A), the releasing agent particles and an aggregating agent in an aqueous medium, to obtain aggregated particles (i); and (2) adding resin particles (B) comprising amorphous polyester (b) to the aggregated particles (1) obtained in said (1) mixing, to obtain the aggregated particles (ii).

4. The process for producing a toner for electrophotography according to claim 3, wherein said fusing the aggregated particles comprises (4) maintaining the aggregated particles (ii) at a temperature lower by 10° C. than a glass transition point of the amorphous polyester (b) or higher but a temperature higher by 5° C. than the glass transition point or lower, to obtain fused core/shell particles.

5. The process for producing a toner for electrophotography according to claim 4, further comprising (3) adding the anionic surfactant subsequent to said (2) adding but prior to said (4) maintaining.

6. The process for producing a toner for electrophotography according to claim 5, wherein, in said adding, in said fusing, or both, an inorganic acid is added to the aqueous mixed solution to adjust a pH value thereof to 2.0 to 6.0.

7. The process for producing a toner for electrophotography according to claim 1, further comprising:

(5) adjusting a pH value of a dispersion of fused particles obtained in said fusing the aggregated particles to 5.5 to 7.5 as measured at 25° C.; and (6) removing a liquid portion from the dispersion of the fused particles obtained in said (5) adjusting, to obtain toner particles.

8. The process for producing a toner for electrophotography according to claim 7, wherein, in said (5) adjusting, after adjusting the pH value of the dispersion of the fused particles obtained in said fusing the aggregated particles to 5.5 to 7.5 as measured at 25° C., the dispersion of the fused particles is maintained at a temperature lower by 5° C. than a glass transition point of the resin particles (B) or higher.

9. The process for producing a toner for electrophotography according to claim 7, wherein, in said (5) adjusting, the pH value of the dispersion of the fused particles as measured at 25° C. is adjusted to 5.5 to 7.5 with an alkali metal hydroxide.

10. The process for producing a toner for electrophotography according to claim 1, wherein the resin particles (A) comprise a crystalline polyester (a) having a melting point of from 60 to 90° C.

11. The process for producing a toner for electrophotography according to claim 1, wherein the resin particles (A) comprise amorphous polyester (c).

12. The process for producing a toner for electrophotography according to claim 4, wherein the fused core/shell particles have an average particle size not more than an average particle size of the aggregated particles (2).

13. The process for producing a toner for electrophotography according to claim 4, wherein the fused core/shell particles have a circularity larger by 0.01 or more than a circularity of the aggregated particles (2).

14. The process for producing a toner for electrophotography according to claim 4, wherein the temperature to be maintained in said (4) maintaining is a temperature lower by 5° C. than the glass transition point of the resin particles (B) or higher but a temperature higher by 10° C. than the glass transition point or lower.

15. The process for producing a toner for electrophotography according to claim 4, wherein the temperature to be maintained in said (4) maintaining is a temperature lower by 5° C. than a melting point of the crystalline polyester or lower.

16. The process for producing a toner for electrophotography according to claim 4, wherein the amorphous polyester (b) has a glass transition point of from 50 to 70° C.

17. The process for producing a toner for electrophotography according to claim 3, wherein the water content in the aqueous medium is substantially 100% by weight.

18. The process for producing a toner for electrophotography according to claim 3, wherein the amorphous polyester (b) comprises at least one kind of amorphous polyester (b) obtained with an acid component comprising a trivalent or higher-valent polycarboxylic acid or an anhydride or an alkyl ester thereof.

19. The process for producing a toner for electrophotography according to claim 3, wherein, in said adding, a dispersion of the resin particles (B) comprising amorphous polyester (b) is added to a dispersion of the aggregated particles (i) obtained in said mixing while gradually raising a temperature of the dispersion of the aggregated particles (i).

* * * * *